US007134229B2

(12) United States Patent
Hess et al.

(10) Patent No.: US 7,134,229 B2
(45) Date of Patent: Nov. 14, 2006

(54) FLAME SIMULATING ASSEMBLY

(75) Inventors: Kristoffer Hess, Cambridge (CA); Kelly Stinson, Kitchener (CA); Richard Adamczyk, Toronto (CA)

(73) Assignee: Dimplex North America Limited, Cambridge (CA)

( * ) Notice: Subject to any disclaimer, the term of this patent is extended or adjusted under 35 U.S.C. 154(b) by 88 days.

(21) Appl. No.: 10/759,189

(22) Filed: Jan. 20, 2004

(65) Prior Publication Data

US 2005/0072031 A1 Apr. 7, 2005

(30) Foreign Application Priority Data

Jan. 20, 2003 (CA) ..... 2416741

(51) Int. Cl.
*G09F 19/00* (2006.01)

(52) U.S. Cl. ..... 40/428; 472/65; 392/348

(58) Field of Classification Search ..... 40/428; 472/65; 392/348

See application file for complete search history.

(56) References Cited

U.S. PATENT DOCUMENTS

| | | | |
|---|---|---|---|
| 1,514,552 | A | 11/1924 | McCormick |
| 1,531,171 | A | 3/1925 | Berry et al. |
| 1,586,597 | A | 6/1926 | Berry |
| 1,719,622 | A | 7/1929 | Price |
| 1,768,284 | A | 6/1930 | Berry |
| 1,809,164 | A | 6/1931 | Gritt |
| 1,824,388 | A | 9/1931 | Birch |
| 1,827,941 | A | 10/1931 | Gross |
| 1,843,279 | A | 2/1932 | Gritt |
| 1,901,294 | A | 3/1933 | Gritt et al. |
| 2,285,535 | A | 6/1942 | Schlett |
| 2,286,246 | A | 6/1942 | Yearta |
| 2,708,114 | A | 5/1955 | Hancock |
| 2,963,807 | A | 12/1960 | Relph et al. |
| 3,119,371 | A | 1/1964 | Zuckerman |
| 3,395,475 | A | 8/1968 | Moss |
| 3,395,476 | A | 8/1968 | Moss et al. |
| 3,445,948 | A | 5/1969 | Moss et al. |
| 3,603,013 | A | 9/1971 | Reed et al. |
| 3,694,945 | A | 10/1972 | Detiker |
| 4,673,609 | A | 6/1987 | Hill |
| 4,965,707 | A | 10/1990 | Butterfield |
| 5,195,820 | A | 3/1993 | Rehberg |
| 5,525,177 | A | 6/1996 | Ross |
| 5,648,827 | A | 7/1997 | Shaw |
| 5,743,038 | A | 4/1998 | Soto |
| 5,787,618 | A | 8/1998 | Mullis |
| 6,050,011 | A | 4/2000 | Hess et al. |
| 6,269,567 | B1 * | 8/2001 | MacPherson et al. ..... 40/428 |
| 6,302,555 | B1 | 10/2001 | Bristow |
| 6,363,636 | B1 | 4/2002 | Hess et al. |
| 6,393,207 | B1 | 5/2002 | Martin et al. |
| 6,413,079 | B1 | 7/2002 | Lyons et al. |
| 6,461,011 | B1 | 10/2002 | Harrison |

(Continued)

FOREIGN PATENT DOCUMENTS

| | | |
|---|---|---|
| EP | 0 348 137 | 12/1989 |

(Continued)

*Primary Examiner*—Gary C. Hoge

(57) ABSTRACT

A flame simulating assembly for providing one or more images of flames. The flame simulating assembly has a light source, a first screen, and a second screen. Each of the first and second screens is positioned in a path of light from the light source. Also, each of the first and second screens is adapted to receive light from the light source to form one or more images of flames transmittable through the screens respectively.

55 Claims, 38 Drawing Sheets

U.S. PATENT DOCUMENTS

| | | | | |
|---|---|---|---|---|
| 6,601,579 | B1 | 8/2003 | Fier et al. | |
| 6,691,440 | B1 | 2/2004 | Petz et al. | |
| 2002/0023376 | A1* | 2/2002 | Hess | 40/428 |
| 2002/0168182 | A1 | 11/2002 | Martin et al. | |
| 2002/0170215 | A1 | 11/2002 | Mix et al. | |
| 2002/0175215 | A1 | 11/2002 | Webster et al. | |
| 2003/0072565 | A1 | 4/2003 | Ravnbo-West et al. | |
| 2003/0126775 | A1 | 7/2003 | Corry et al. | |
| 2004/0060213 | A1* | 4/2004 | Schroeter et al. | 40/428 |
| 2005/0063685 | A1 | 3/2005 | Bristow | |
| 2005/0086841 | A1 | 4/2005 | Schroeter et al. | |
| 2005/0097792 | A1 | 5/2005 | Naden | |

FOREIGN PATENT DOCUMENTS

| | | |
|---|---|---|
| EP | 1 020 685 | 7/2000 |
| GB | 272836 | 6/1927 |
| GB | 322688 | 12/1929 |
| GB | 957591 | 5/1964 |
| GB | 968568 | 9/1964 |
| GB | 975009 | 11/1964 |
| GB | 978364 | 12/1964 |
| GB | 978365 | 12/1964 |
| GB | 1 088 577 | 1/1966 |
| GB | 1 024 047 | 3/1966 |
| GB | 1 097 812 | 1/1968 |
| GB | 1 186 655 | 4/1970 |
| GB | 1 443 772 | 7/1976 |
| GB | 2 118 096 | 10/1983 |
| GB | 2 151 772 | 7/1985 |
| GB | 2 210 969 | 6/1989 |
| GB | 2 222 000 | 2/1990 |
| GB | 2 242 737 | 10/1991 |
| GB | 2 261 723 | 5/1993 |
| GB | 2 267 563 | 12/1993 |
| GB | 2 276 444 | 9/1994 |
| GB | 2 288 052 | 10/1995 |
| GB | 2 290 374 | 12/1995 |
| GB | 2 298 073 | 8/1996 |
| GB | 2 302 172 | 1/1997 |
| GB | 2 302 730 | 1/1997 |
| GB | 2 321 700 | 8/1998 |
| GB | 2 372 807 | 9/2002 |
| GB | 2 379 009 | 2/2003 |
| GB | 2 387 901 | 10/2003 |
| GB | 2 409 323 | 6/2005 |
| WO | WO 01/57447 | 8/2001 |
| WO | WO 2004/027321 | 4/2004 |
| WO | WO 2004/109189 | 12/2004 |
| WO | WO 2005/028962 | 3/2005 |

* cited by examiner

FLAME SIMULATING ASSEMBLY

FIELD OF THE INVENTION

The present invention relates to a flame simulating assembly for providing one or more images of flames, and more particularly, a flame simulating assembly for transmitting one or more images of flames through two screens.

BACKGROUND OF THE INVENTION

Various types of flame simulating assemblies are known. Often, a flame simulating assembly is designed to be included in an electric fireplace, to simulate a fire in a real fireplace in which wood or coal is burned. For example, U.S. Pat. No. 4,965,707 (Butterfield) discloses a simulated flame system for an electric fireplace in which a light source is combined with billowing ribbons to simulate flames. The effect resulting generally resembles flames from a coal fuel source more than flames from a wood fuel source. The flames for burning wooden logs tend to be more active and extend higher above the fuel source.

On occasion, a two-sided flame simulating assembly is needed. The need typically arises where a two-sided flame simulating assembly is to be included in an interior wall, so that a flame simulating assembly can simultaneously be enjoyed by those in the rooms on both sides of the interior wall.

Typically, a two-sided flame simulating assembly is created by simply positioning two conventional flame simulating assemblies back-to-back, i.e., a back wall of a first conventional flame simulating assembly is positioned adjacent to a back wall of a second conventional flame simulating assembly. Alternatively, a two-sided flame simulating assembly is often created by attaching two conventional flame simulating assemblies together, back-to-back. Typical two-sided flame simulating assemblies, created by combining conventional flame simulating assemblies, have a number of disadvantages. First, combining two conventional flame simulating assemblies to form a two-sided flame simulating assembly is only feasible where the interior wall in which the conventional flame simulating assemblies are to be positioned is sufficiently thick to receive them. Second, using two conventional flame simulating assemblies back-to-back is relatively expensive, as all of the materials and controls for each of the conventional units are duplicated.

In addition, because two conventional units positioned back-to-back are relatively broad, an interior wall in which the two conventional back-to-back units are received often has barely enough thickness for the purpose. The result is that screens in the conventional back-to-back flame simulating assemblies through which simulated flames are viewable tend to be relatively closely positioned to an observer. This is undesirable because, in general, where there is more distance between the observer and the screen, the simulated flames tend to be perceived by the observer as being more realistic.

Also, where two conventional flame simulating assemblies are combined into a typical two-sided flame simulating assembly, the effects resulting are essentially the same simulated flames produced by each of the conventional flame simulating assemblies operating separately. Achieving any additional or somewhat improved effects is not feasible where two conventional flame simulating assemblies are combined.

There exists a need for a flame simulating assembly adapted to provide images of flames transmitted through two screens to overcome at least some of the deficiencies of the prior art.

SUMMARY OF THE INVENTION

In a broad aspect of the present invention, there is provided a flame simulating assembly for providing one or more images of flames. The flame simulating assembly has one or more light sources, a first screen, and a second screen. The first screen is positioned in a first path of light from the light source. The first screen is adapted to receive light from the light source to form the image of flames transmittable through the first screen. The second screen is positioned in a second path of light form the light source. The second screen is also adapted to receive light from the light source to form the image of flames transmittable through the second screen.

In another aspect, the invention additionally includes a flame effect element for configuring light from the light source to produce one or more images of flames. The flame effect element is positioned in paths of light between the light source and the first screen and also between the light source and the second screen.

In another aspect, the invention provides a flame simulating assembly additionally including a first flicker element for creating a fluctuating light to produce a first image of flames transmitted through the first screen. The first flicker element is positioned in the first path of light between the light source and the first screen.

In yet another aspect, the invention provides a flame simulating assembly additionally including a second flicker element for creating a fluctuating light to produce a second image of flames transmitted through the second screen, the second flicker element being positioned in the second path of light between the light source and the second screen.

In yet another of its aspects, the invention provides a flame simulating assembly additionally including two one simulated fuel beds positioned adjacent to the screens so that the images of flames transmitted through the screens are positioned proximal to the simulated fuel beds respectively.

In another aspect, the invention provides a flame simulating assembly for providing at least one image of flames. The flame simulating assembly has a first simulated fuel bed, a second simulated fuel bed, one or more light sources, a first screen, and a second screen. The first screen includes a first front surface and is positioned behind the first simulated fuel bed in a first path of light from the light source, for transmitting the image of flames through the first front surface proximal to the first simulated fuel bed. The second screen includes a second front surface and is positioned behind the second simulated fuel bed in a second path of light from the light source, for transmitting the image of flames through the second front surface proximal to the second simulated fuel bed.

In yet another of its aspects, the invention provides a flame simulating assembly for providing one or more images of flames. The flame simulating assembly has a light source, a first screen, a second screen, and a flame effect element positioned in a path of light between the light source and the first and second screens respectively. The flame effect element is adapted to configure light from the light source to form images of flames transmittable through the first and second screens respectively.

BRIEF DESCRIPTION OF THE DRAWINGS

The invention can be better understood by reference to the attached drawings, in which.

DETAILED DESCRIPTION OF THE PREFERRED EMBODIMENT(S)

Figure 3:
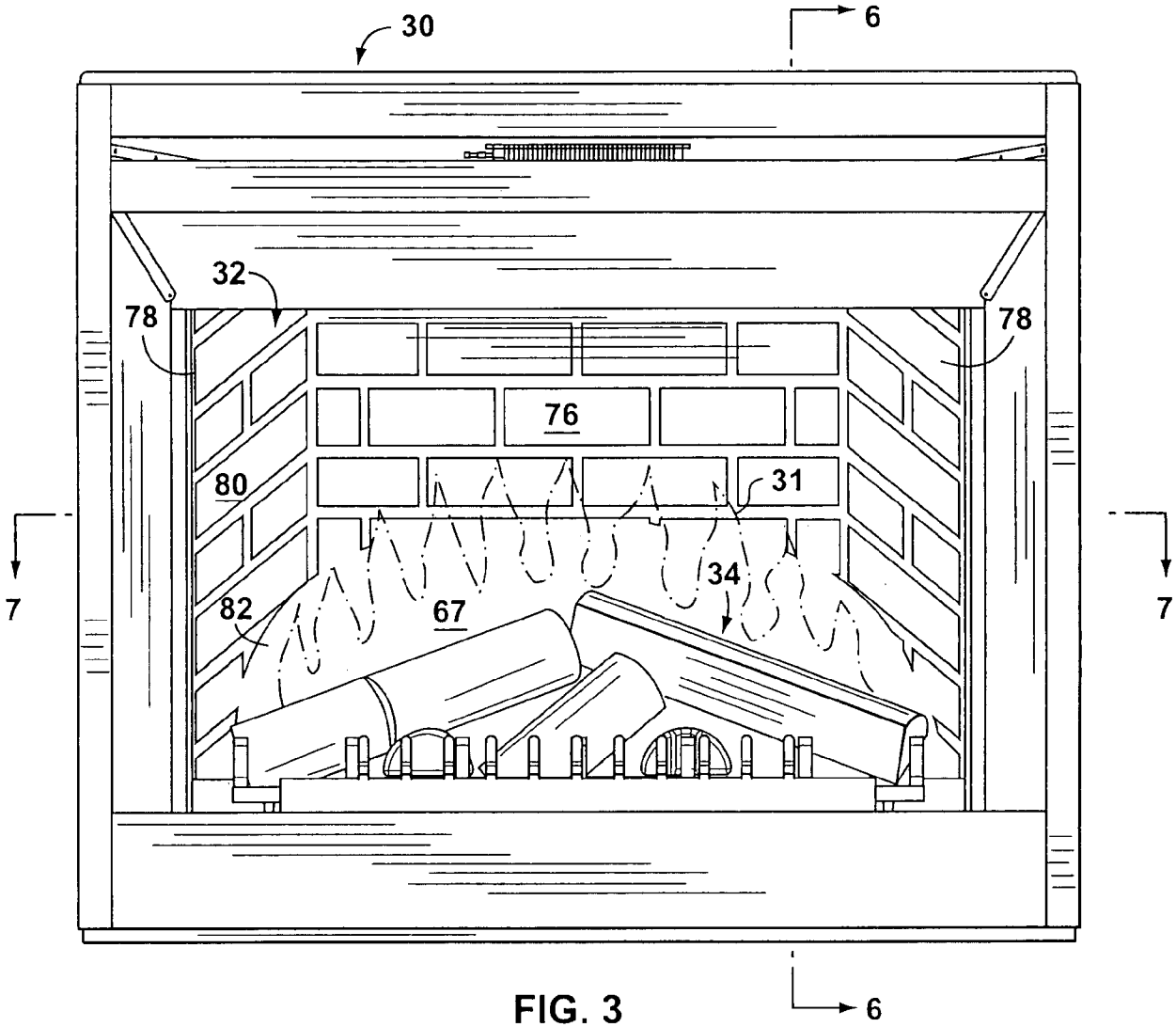
FIG. 3 is an elevation view of the first side of the flame simulating assembly of FIG. 1.
Figure 4:
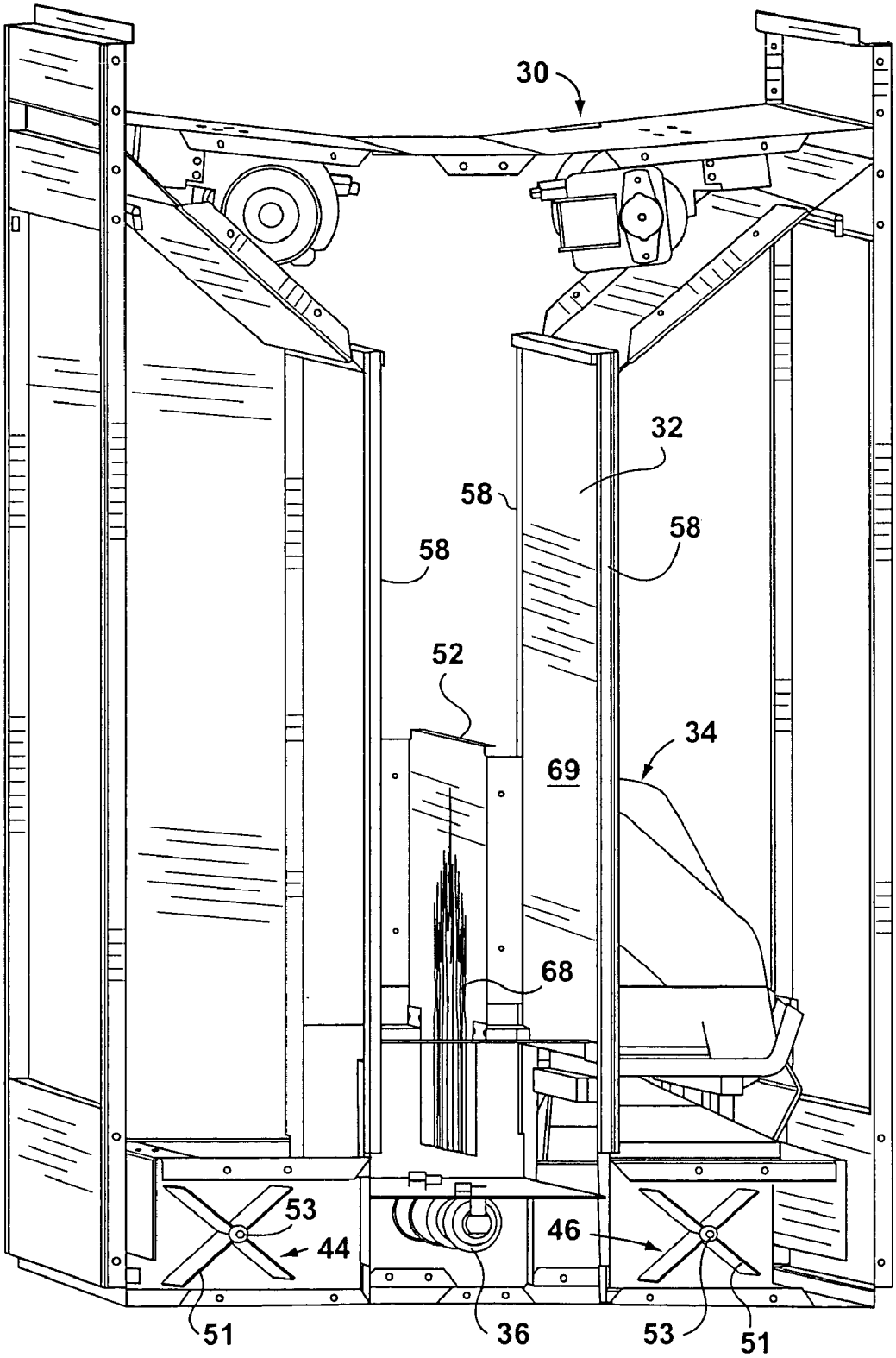
FIG. 4 is an isometric side view of the flame simulating assembly of FIG. 1 with certain elements removed for illustrative purposes, drawn at a larger scale.
Figure 5:
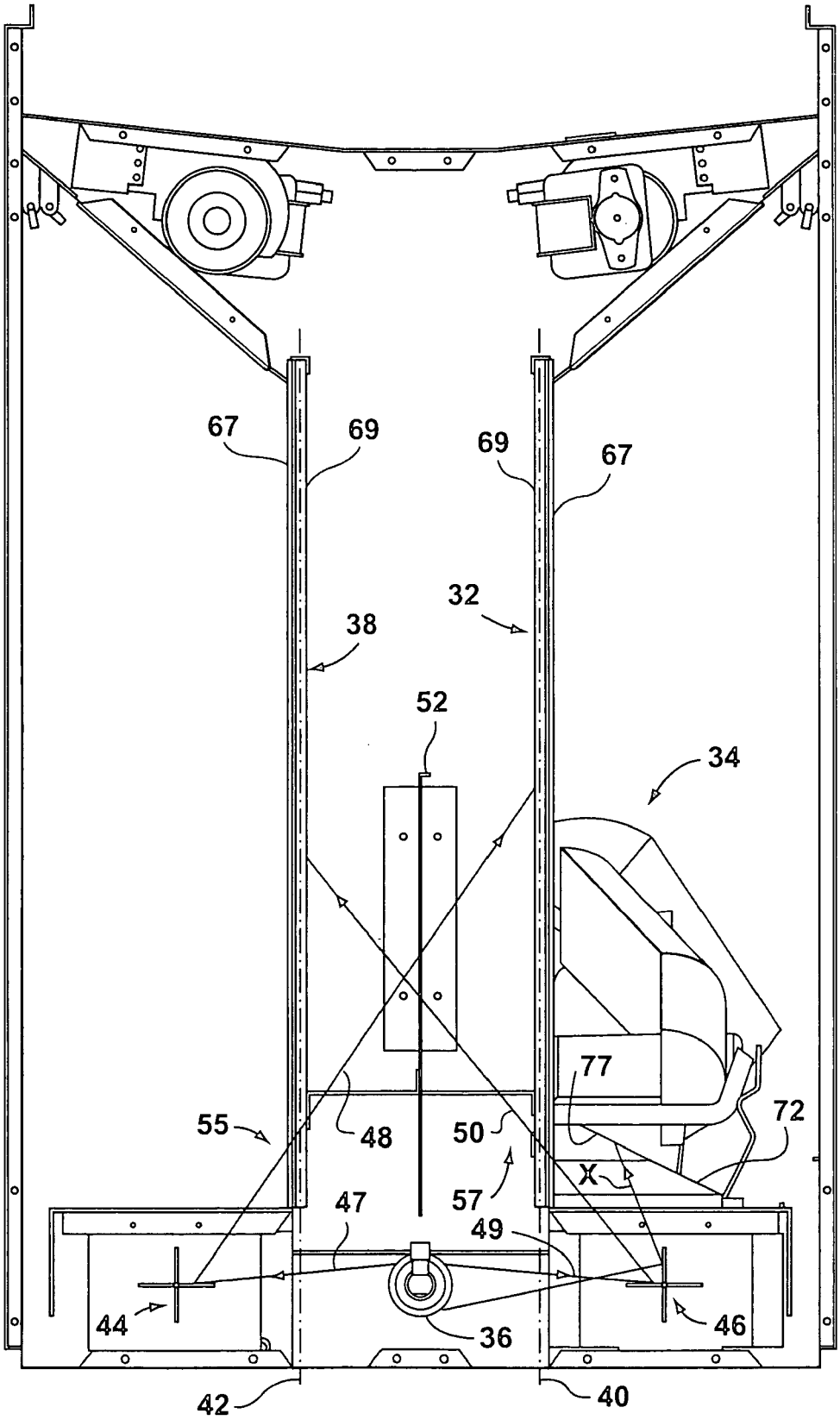
FIG. 5 is a side view of the flame simulating assembly of FIG. 1.

Reference is first made to FIGS. 1–7 to describe a preferred embodiment of a flame simulating assembly indicated generally by the numeral 30 in accordance with the invention. The flame simulating assembly 30 is for providing one or more images of flames 31 and includes one or more light sources 36, a first screen 32, and a second screen 38 (FIG. 5). In the preferred embodiment, the first screen 32 is positioned in a first path of light 55 (represented by arrows 47, 48, shown in FIG. 5) from the light source 36, and the second screen 38 is positioned in a second path of light 57 (represented by arrows 49, 50, shown in FIG. 5) from the light source 36, as will be described. The first screen 32 is adapted to receive light from the light source 36 to form the image of flames 31, which is transmitted through the first screen 32. In addition, the second screen 38 is adapted to receive light from the light source 36 to form the image of flames 31, which is transmitted through the second screen 38, as will be described.

Preferably, the first screen 32 and the second screen 38 at least partially define planes 40, 42 respectively (FIG. 5). As can be seen in FIG. 5, the light source 36 is positioned substantially between the planes 40, 42. Preferably, the light source 36 is also positioned below the first screen 32 and the second screen 38.

Figure 6:
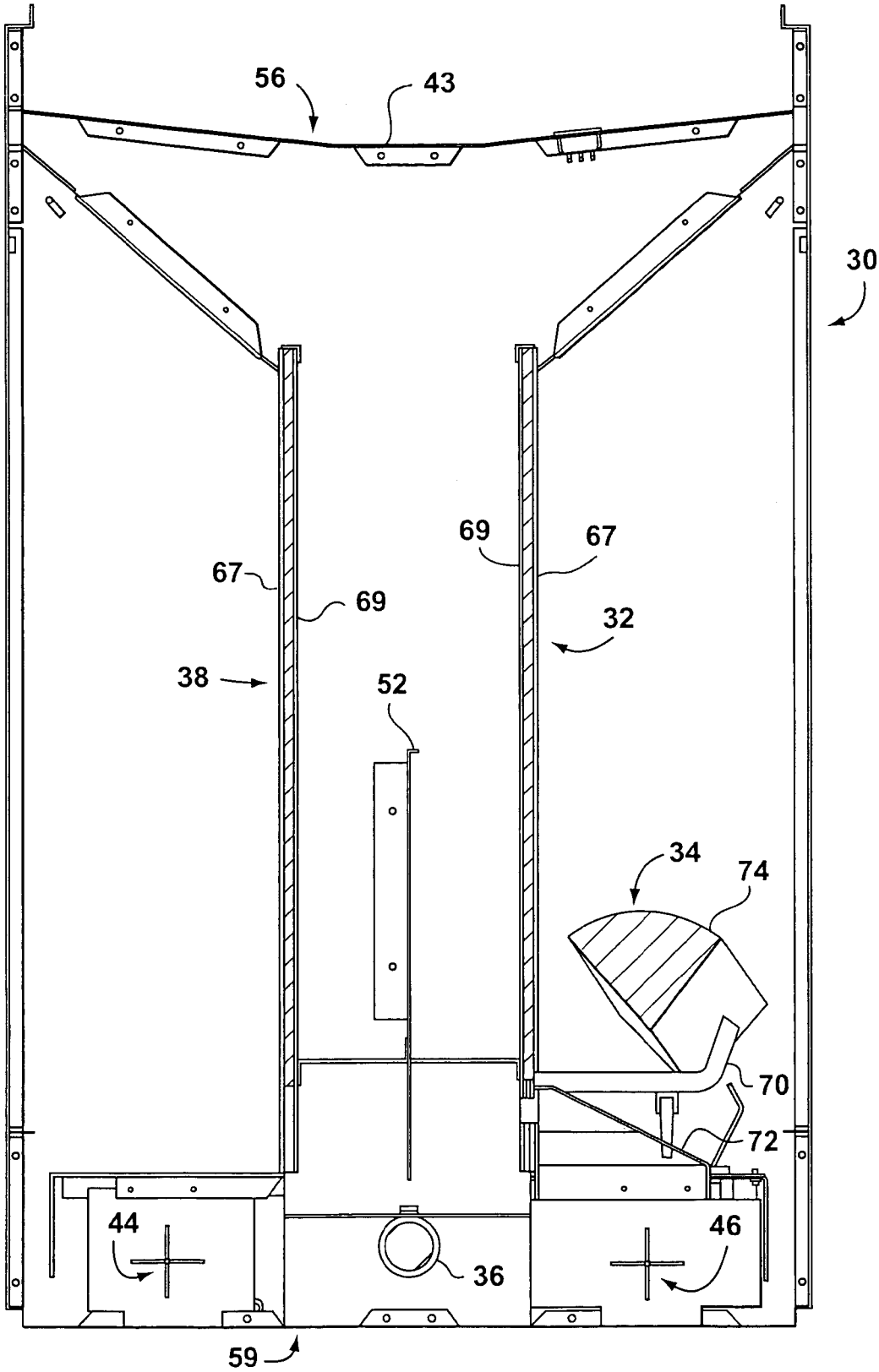
FIG. 6 is a cross section of the flame simulating assembly of FIG. 3 with certain elements removed for illustrative purposes, taken along line 6—6 in FIG. 3.

In the preferred embodiment, and as shown in FIGS. 4–6, the flame simulating assembly 30 additionally includes first and second flicker elements 44, 46 respectively for creating a fluctuating light. The first flicker element 44 is positioned in the first path of light 55 between the light source 36 and the first screen 32 (FIG. 5). Similarly, the second flicker element 46 is positioned in a second path of light 57 between the light source 36 and the second screen 38. The fluctuating light from the light source 36 is transmitted through the first screen 32 and the second screen 38 respectively to produce one or more images of flames 31 appearing through the first screen 32 and the second screen 38 simultaneously.

Preferably, the flame simulating assembly 30 additionally includes a flame effect element 52 positioned between the first screen 32 and the second screen 38, for configuring light from the light source 36 to simulate flames, i.e., to form one or more images of flames 31.

Figure 1:
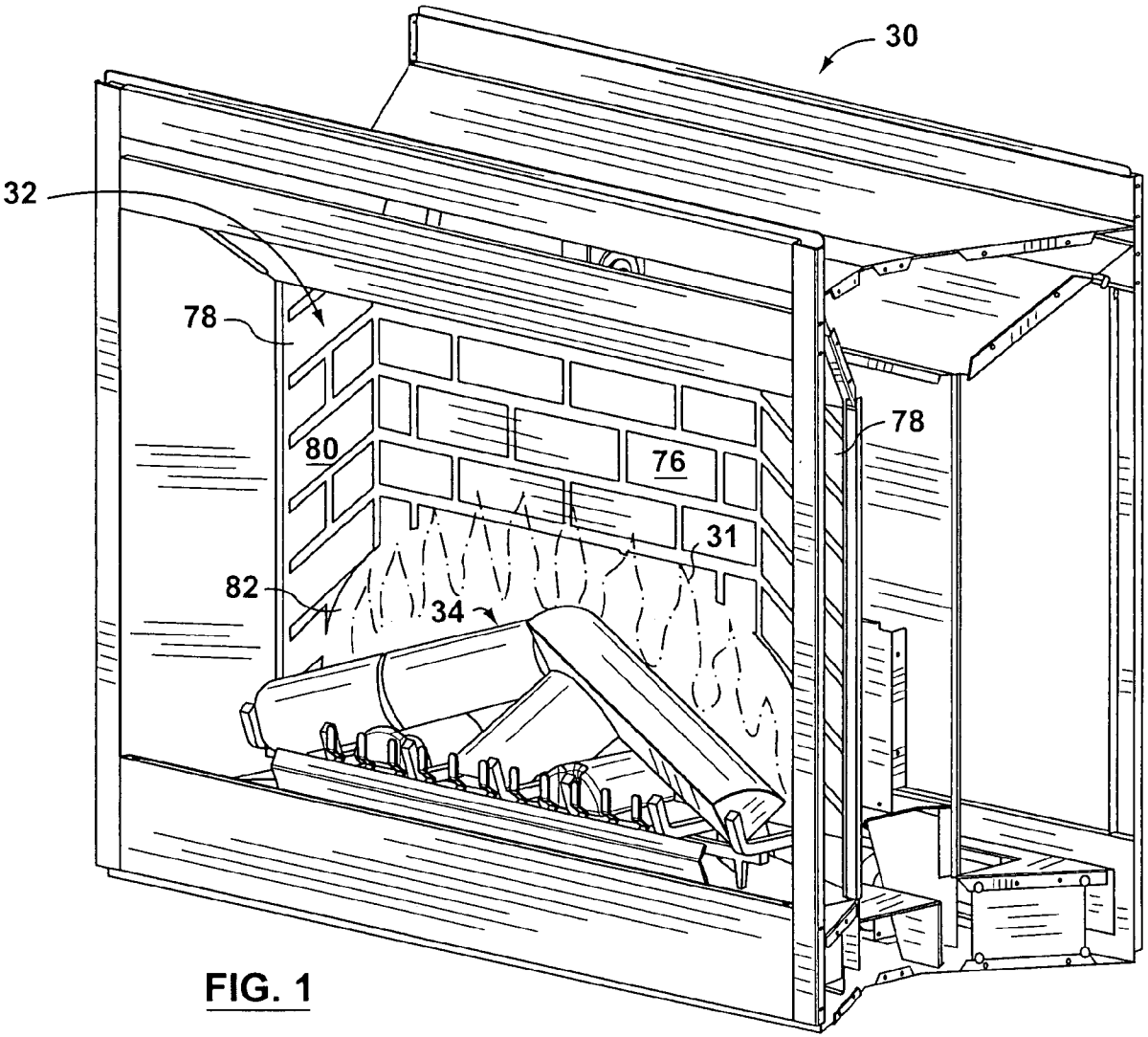
FIG. 1 is an isometric view of a first side of a preferred embodiment of the flame simulating assembly showing a first screen and a first simulated fuel bed.

It is also preferred that the flame simulating assembly 30 additionally includes a first simulated fuel bed 34 positioned adjacent to the first screen 32. The first simulated fuel bed 34 is located relative to the first screen 32 so that the image of flames 31 which is transmitted through the first screen 32 is positioned proximal to the first simulated fuel bed 34 (FIGS. 1, 3 and 5). In the preferred embodiment, the flame simulating assembly 30 additionally includes a second simulated fuel bed 54 positioned adjacent to the second screen 38. The second simulated fuel bed 54 is also located relative to the second screen 38 so that the image of flames 31 which is transmitted through the second screen 38 is positioned proximal to the second simulated fuel bed 54 (FIGS. 12–16, 17, 20, 21).

Figure 20:
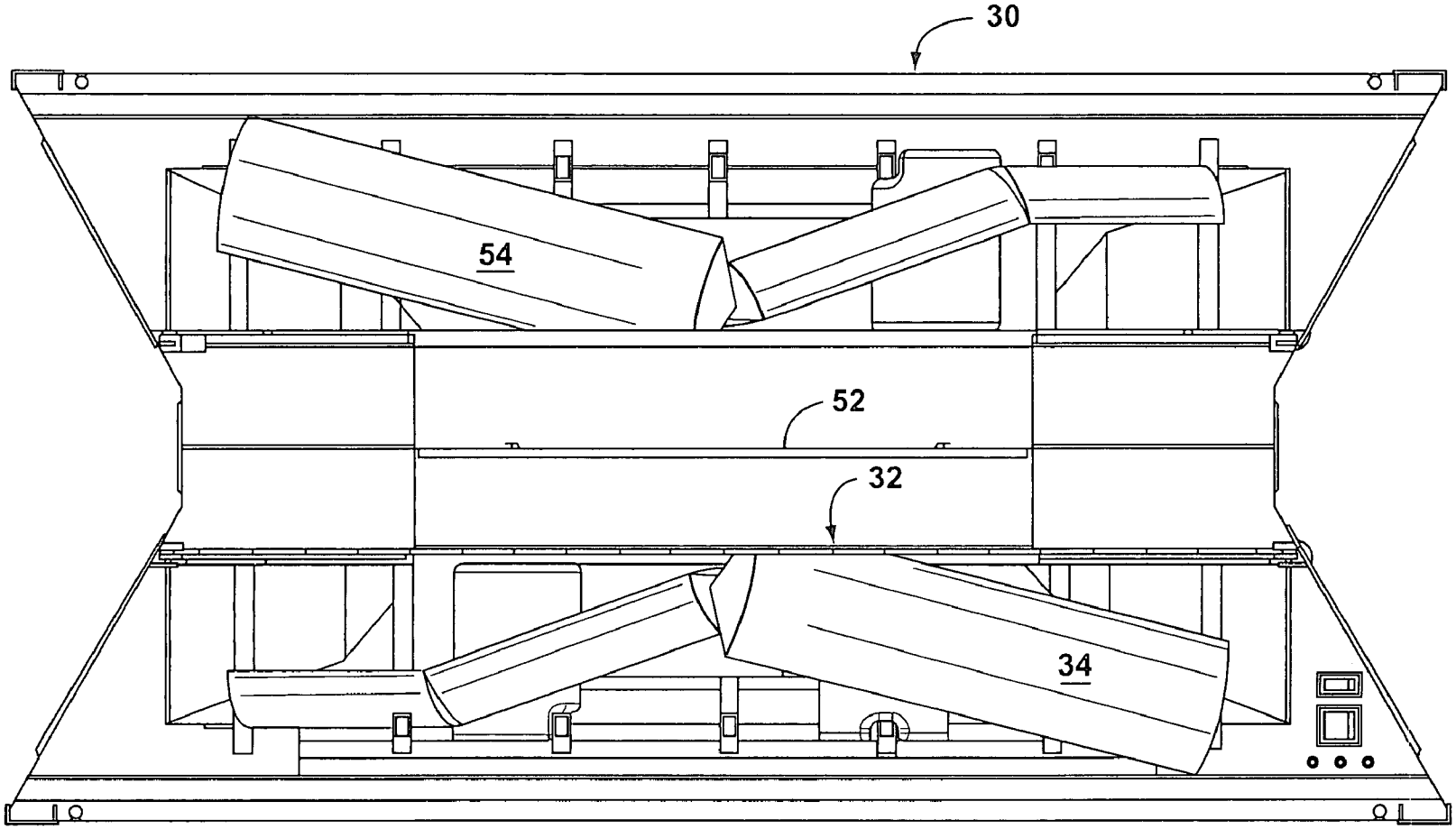
FIG. 20 is a cross section of another alternative embodiment of the flame simulating assembly viewed from the top and showing two simulated fuel beds mounted in the flame simulating assembly, drawn at a smaller scale.
Figure 21:
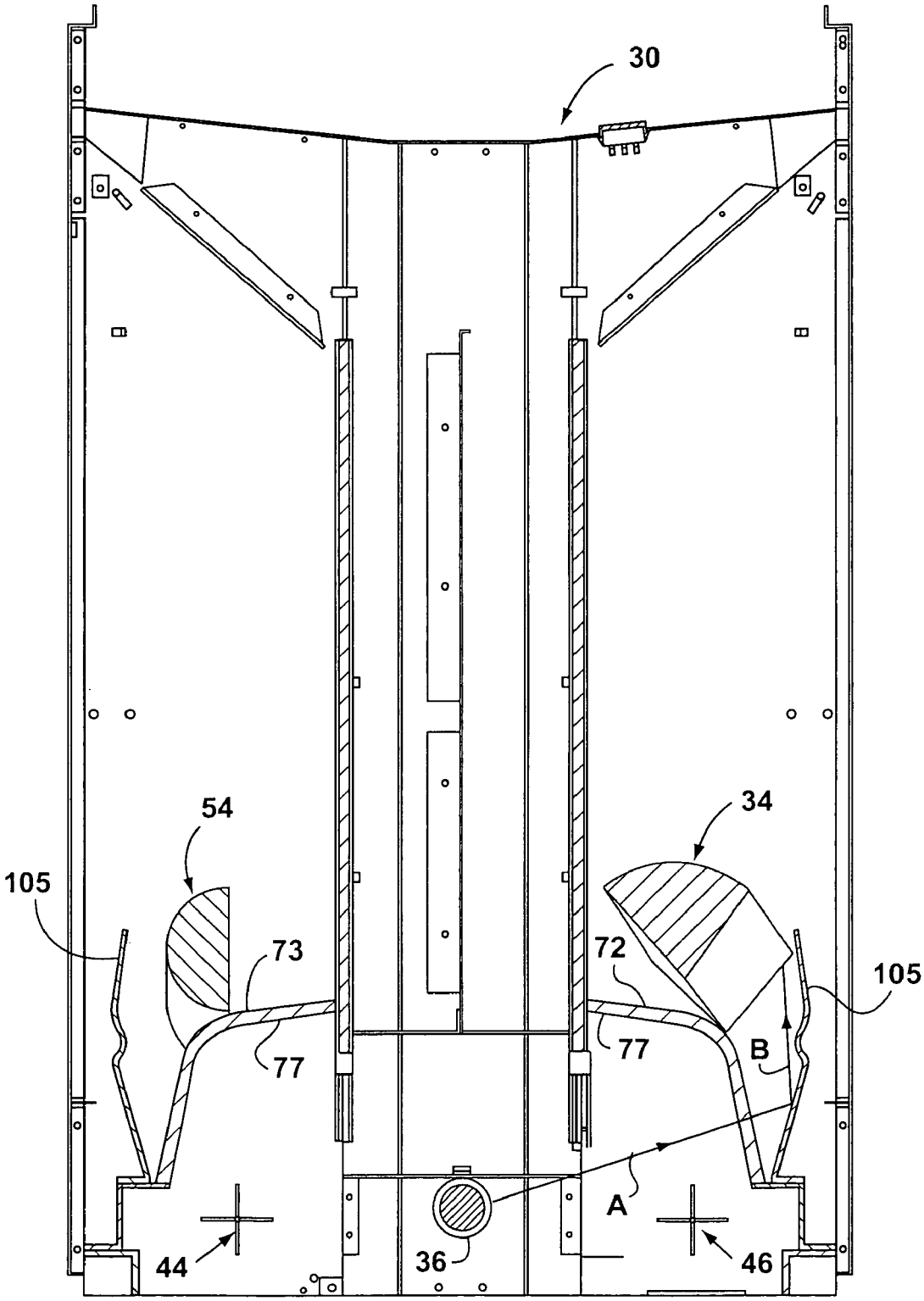
FIG. 21 is a cross section viewed from the side of another alternative embodiment of the flame simulating assembly.

It will be understood that certain elements of the flame simulating assembly 30 are omitted from certain of the drawings, solely for the purposes of clarity, although such omitted elements are included in the flame simulating assembly 30. For example, the second screen 38 is omitted from FIGS. 2, 4 and 7 in order to show details of the construction of the flame simulating assembly 30, as will be described. It will also be appreciated that a second simulated fuel bed 54 (FIG. 12) is omitted from FIGS. 2 and 4–7 in order to show details of the construction of the flame simulating assembly 30 which would otherwise not be shown. The second screen 38 is shown in FIGS. 5, 6, and 21 (among others), and the second simulated fuel bed 54 is shown in FIGS. 20 and 21 (among others).

Figure 15:
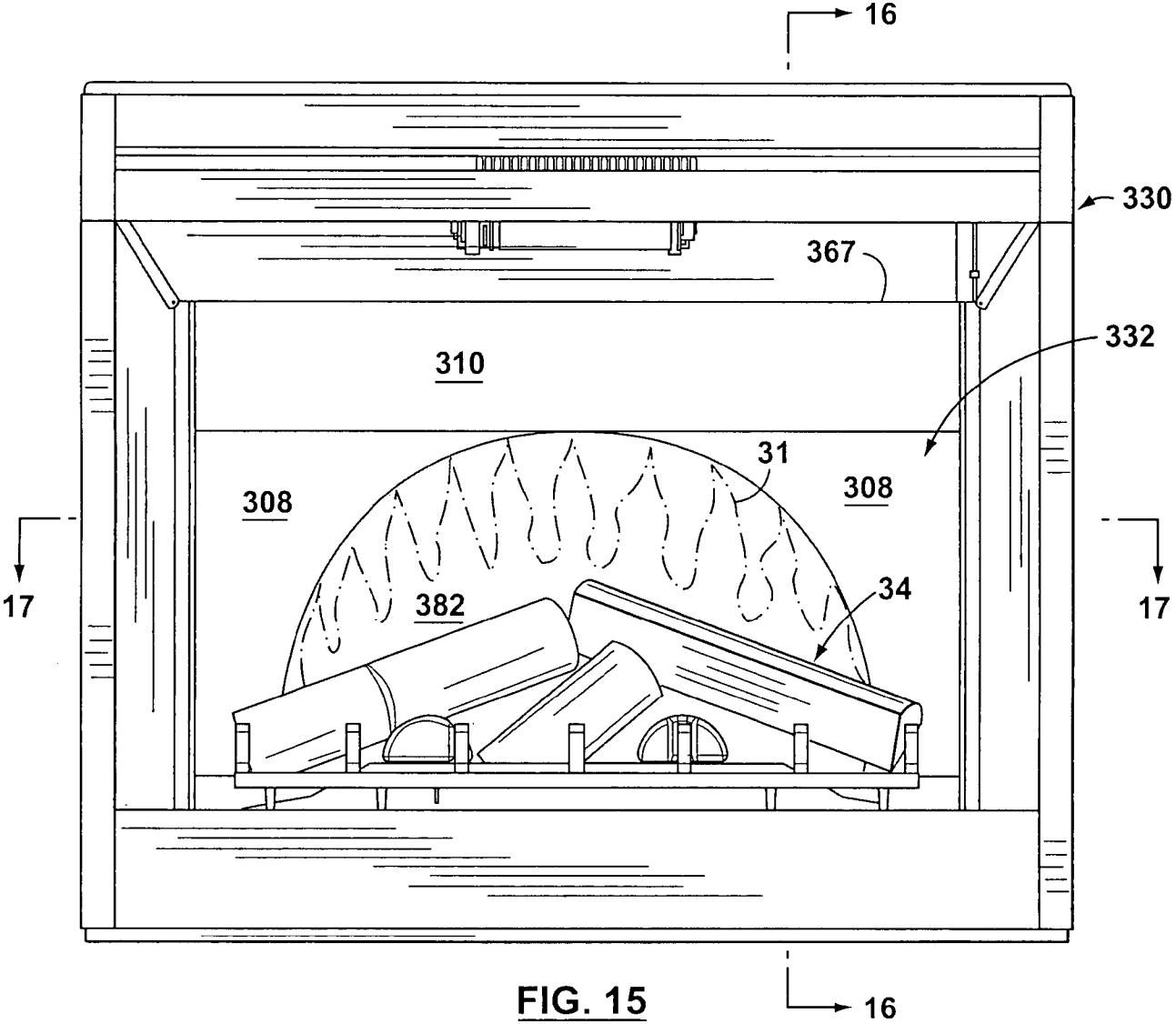
FIG. 15 is a front view of another embodiment of the flame simulating assembly of the invention, drawn at a smaller scale.

For clarity, an image of flames 31 is illustrated in FIGS. 1, 3, and 15 in ghost outline. It will be understood that, in the preferred embodiment, the image of flames is constantly changing (in shape and in intensity of light, and color) while the flame simulating assembly 30 is operating, due to the flickering and fluctuating of the light from the light source forming the image of flames. The flickering and fluctuating of the image of flames (resulting from the flicker elements) resembles the fluctuations of the flames in a real fire, for example, a fire in which the fuel is wood or coal.

Figure 7:
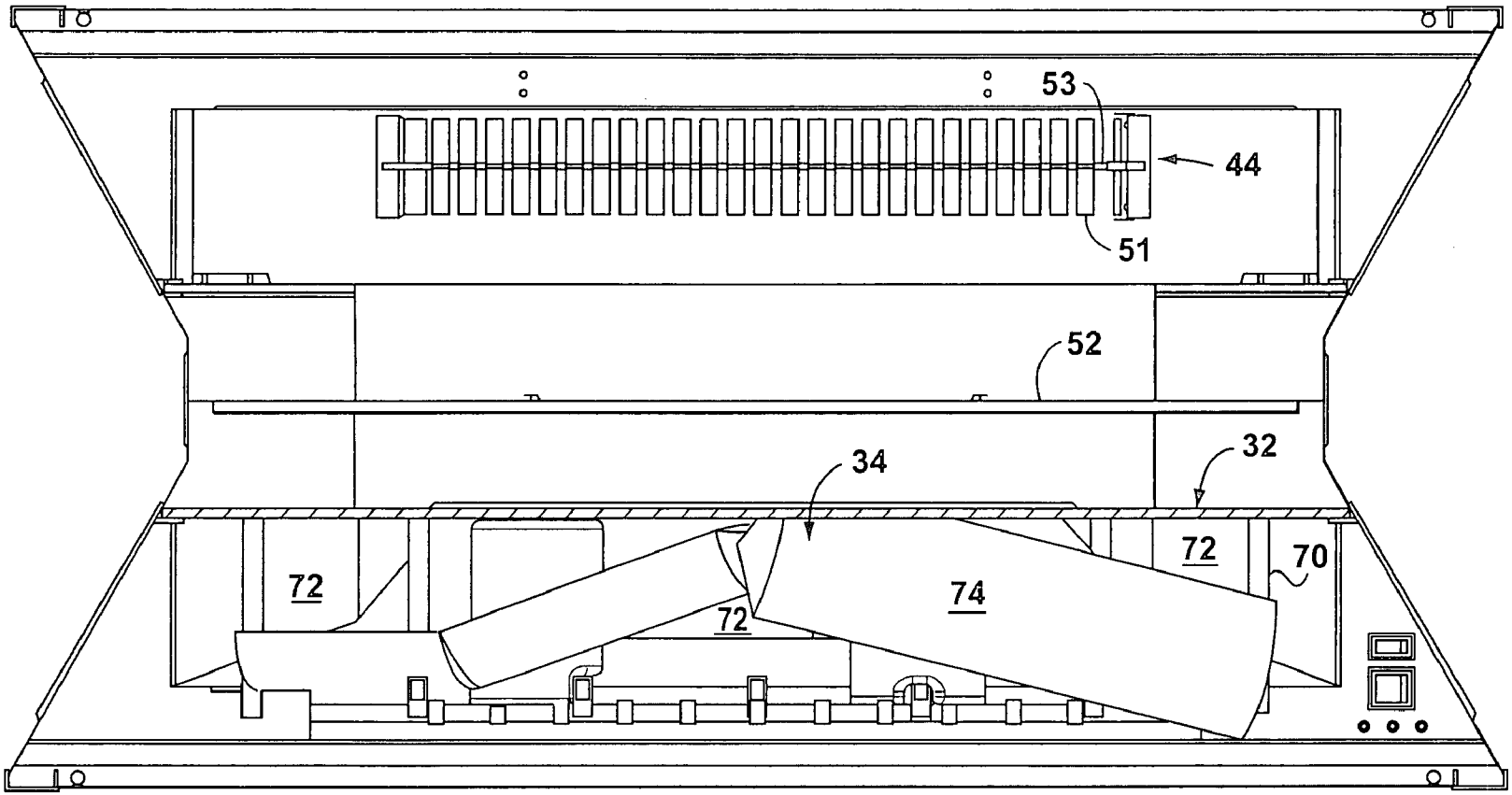
FIG. 7 is a cross section of the flame simulating assembly of FIG. 3 with certain elements removed for illustrative purposes, taken along line 7—7 in FIG. 3.

Although other types of flicker elements could be used, preferably, the flicker elements 44, 46 are of the type (i.e., the "rotisserie" type) described in U.S. Pat. No. 5,642,580, in which a plurality of reflective strips 51 are radially arranged around a central axis 53 (FIG. 7.) U.S. Pat. No. 5,642,580 is hereby incorporated herein by reference. The preferred embodiment of the flicker element 44 can best be seen in FIG. 7. (For purposes of illustration, the plurality of strips 51 is represented in FIG. 4 by single examples of the strips, it being understood that the flicker elements 44, 46 include several reflective strips 51, as shown (in the case of flicker element 44) in FIG. 7.) As is known in the art, the flicker elements 44, 46 are rotated by electric motors (not shown). In the preferred embodiment, the flame simulating assembly 30 includes separate controls (not shown) for each flicker element 44, 46 respectively. This permits the flicker elements 44, 46 to rotate at different speeds respectively, thereby resulting in images of flames 31 which flicker at different speeds (simulating a more rapidly burning fire, where the flicker element is rotating more rapidly and a more slowly burning fire, where the flicker element is rotating more slowly) appearing through the first and second screens 32, 38 respectively.

Figure 2:
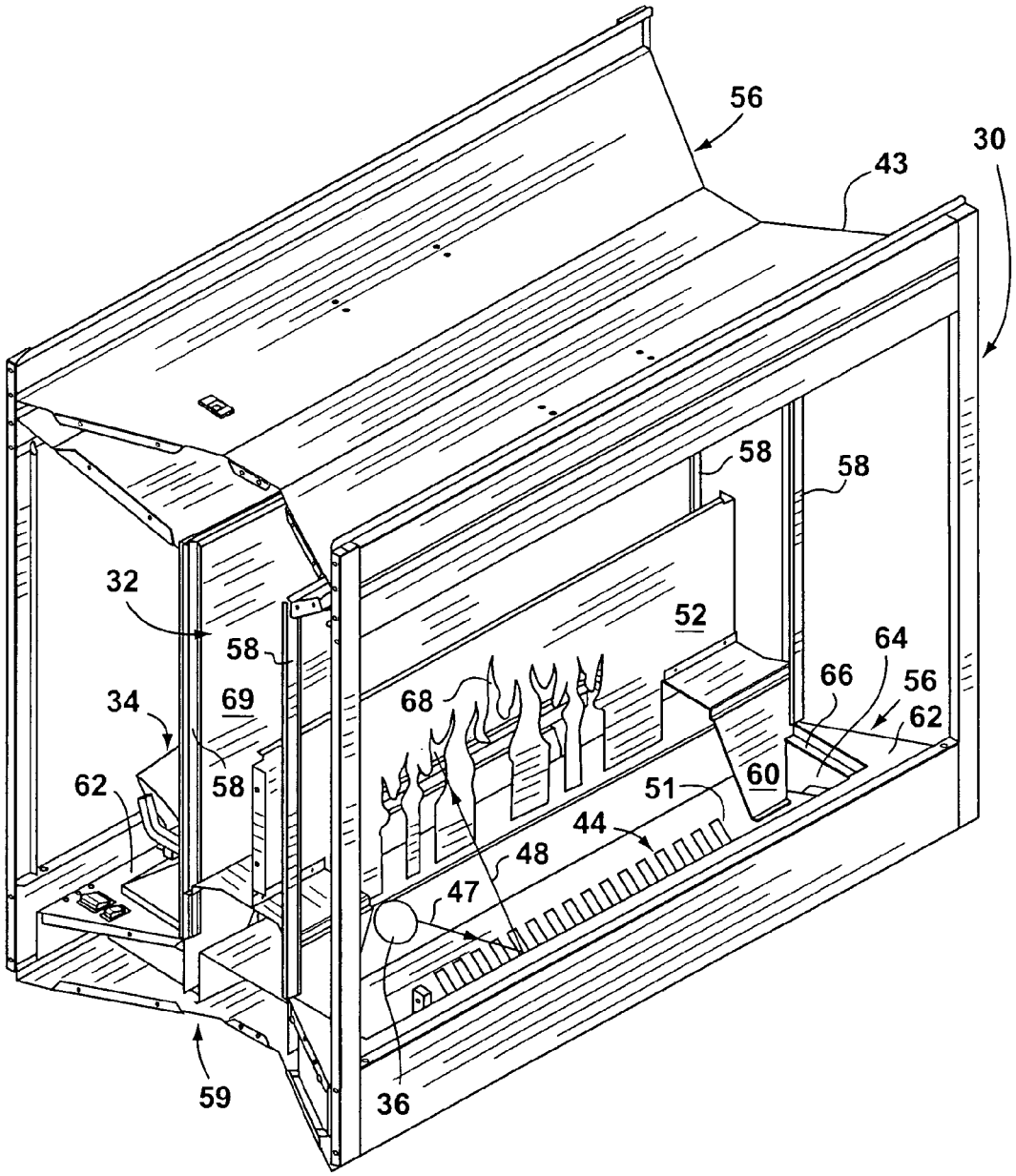
FIG. 2 is an isometric view of a second side of the flame simulating assembly of FIG. 1, with certain elements removed for illustrative purposes.

As can be seen in FIG. 2, in the preferred embodiment, the flame simulating assembly 30 includes a housing 56 constructed primarily of sheet metal panels, suitably bent or otherwise formed and fastened together by rivets or other suitable fasteners, as is known in the art. (The housing 56 can also include any other suitable materials, in any suitable combinations.) Preferably, the housing 56 includes screen frames 58 for receiving and supporting each of the first screen 32 and the second screen 38 in position. Also, the housing 56 includes flame effect element supports 60 positioned at the ends of the flame effect element 52, for maintaining the flame effect element 52 in a substantially vertical position, as can best be seen in FIG. 2. Top panels 43 and a bottom panel 59 also provide structural strength to the housing 56 (FIG. 6). A deck portion 62 includes an aperture 64 with a ledge 66 around part of the perimeter thereof, the ledge 66 being adapted for supporting the simulated fuel beds 34, 54 above the apertures 64.

Preferably, the screens are made of glass. Alternatively, a suitable polycarbonate (such as plexiglas) or a suitable acrylic material can be used, or any other suitable materials. Preferably, the front surfaces of the screens are partially reflective, but this is not necessary. The screens could be suitably tinted or treated in any suitable manner to achieve any desired effects.

In the preferred embodiment, the flame effect element 52 includes apertures 68 adapted to configure light passing through the apertures 68 into one or more images of flames 31. The flame effect element 52 preferably comprises sheet metal in which the apertures 68 have been formed by cutting or stamping. The apertures 68 are shaped to form flame images, as can be seen in FIGS. 2 and 4.

In use, as can be seen in FIG. 2, light from the light source 36 is reflected from the first flicker element 44 through the apertures 68 in the flame effect element 52 to the first screen 32. The first path of light 55 from the light source 36 to the flicker element 44 and through the apertures 68 to the first screen 32 is represented in FIG. 2 by arrows 47, 48. The image of flames 31 that results (not shown in FIG. 2) is transmitted through the first screen 32. Still referring to FIG. 2, it will be appreciated that the second screen 38 and the second simulated fuel bed 54 are not included in this drawing in order to show the first path of light 55. As can be seen in FIG. 5, the second path of light 57 generally corresponds to the first path of light 55, as light from the light source 36 simultaneously is reflected from the second flicker element 46 through the aperture 68 in the flame effect element 52 to the second screen 38. The image of flames 31 that results is transmitted through the second screen 38 simultaneously with the transmission of the image of flames 31 through the first screen 32.

Each of the screens 32, 38 has a front surface 67 positioned adjacent to the simulated fuel beds 34, 54 respectively, and a back surface 69, through which light from the light source 36 is transmitted into the screen 32, 38. As will be described, the front surface 67 may or may not be partially reflective, and the back surface 69 preferably diffuses light but also transmits light. The images of flames 31 are transmitted through the front surfaces 67 of the first screen 32 and the second screen 38.

As can be seen in FIG. 2, the aperture 64 permits light from the light source 36 to follow the first path of light 55. However, it will be understood that in normal operating conditions, the aperture 64 (shown in FIG. 2) is below the second simulated fuel bed 54, and not observable by a viewer (not shown). Also, an aperture similar to the aperture 64 is positioned beneath the first simulated fuel bed 34. Light from the light source 36 therefore also illuminates the undersides of the simulated fuel beds 34, 54 through the apertures 64, as will be described.

Figure 17:
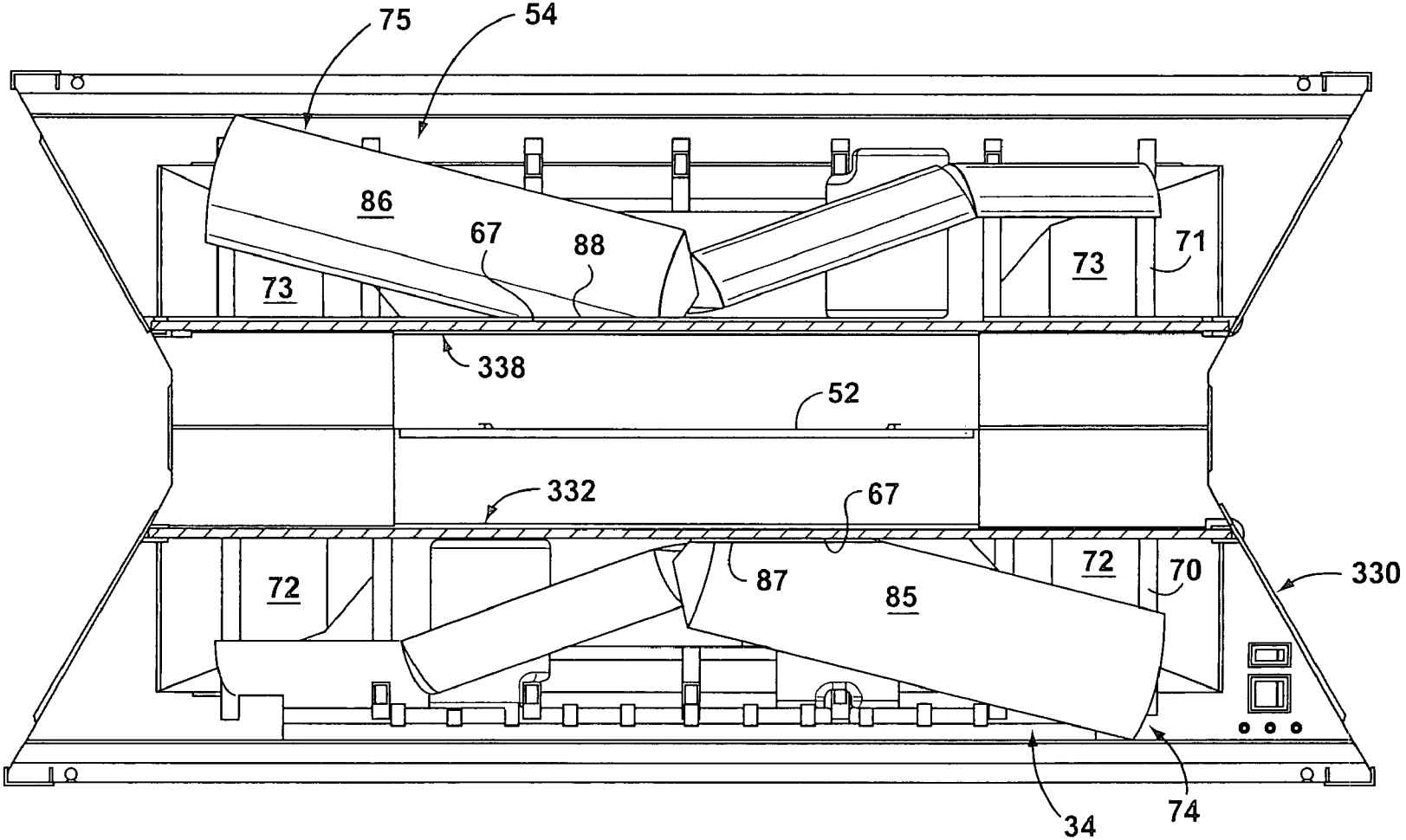
FIG. 17 is a cross section of the flame simulating assembly of FIG. 15, taken along line 17—17 of FIG. 15.

The first simulated fuel bed 34, as shown in FIGS. 6 and 7, preferably comprises a simulated grate 70 which is positioned above a simulated ember bed 72 and supports simulated fuel elements 74. However, various arrangements can be used to achieve the desired effect. For example, in the absence of the grate 70, the simulated ember bed 72 could support the simulated fuel elements 74 directly, as shown in FIG. 21. In FIG. 6, simulated fuel element 74 is shown as being directly supported by the simulated grate 70 and the simulated ember bed 72 is positioned below the simulated grate 70. (It will be understood that the second simulated fuel bed 54 is not shown in FIGS. 5–7 for clarity of illustration.) As shown in FIG. 17, the second simulated fuel bed 54 also includes a simulated grate 71, a simulated ember bed 73, and simulated fuel elements 75, corresponding to similar elements in the first simulated fuel bed 34. Preferably, the simulated fuel elements 74, 75 are formed and colored to simulate wood logs, however, the simulated fuel elements 74, 75 can be formed and colored to simulate any desired fuel, as is known in the art. In the preferred embodiment, the simulated fuel elements 74, 75 are made of styrofoam and formed and colored (i.e., painted) to simulate fuel which is burning and partially burned, as described in U.S. Pat. No. 5,642,580.

Preferably, the simulated ember beds 72, 73 are vacuum-formed plastic and painted and formed to simulated ember beds, as described in U.S. Pat. No. 5,642,580. The simulated ember beds 72, 73 preferably include translucent parts colored orange or any suitable color through which light from the light source 36 can pass, to simulate burning embers in a real bed of embers. The light from the light source 36 passes through the aperture 64 to the underside of the simulated ember beds 72, 73, as shown in FIG. 5. For example, in FIG. 5, a path of light from the light source 36, reflected from the flicker element 46 to an underside 77 of the simulated ember bed 72, is schematically represented by the arrow "X".

Ember decals, disclosed in U.S. Pat. No. 6,162,047, could be included in the simulated fuel beds 34, 54 to enhance the flame simulation effect. U.S. Pat. No. 6,162,047 is hereby incorporated herein by reference.

In the preferred embodiment, and as shown in FIGS. 1 and 3, the screens 32, 38 each include a pattern 76 depicting a structure. Preferably, the structure depicted is a firebrick wall, such as that which may be seen in a real fireplace (i.e., a fireplace in which wood or coal is burned), thereby making the simulation of flames in the flame simulating assembly 30 more realistic. U.S. patent application Ser. No. 09/968,796, filed on Oct. 3, 2001, discloses screens including such patterns. U.S. patent application Ser. No. 09/968,796 is hereby incorporated herein by reference. Where the screens 32, 38 include the pattern 76, side wall panels 78 with a pattern 80 thereon each are preferably included in the flame simulating assembly 30. The patterns 80 are formed, colored and positioned on the side wall panels 78 to mate with the patterns 76 on the screens 32, 38, to provide a more realistic simulation.

The screens 32, 38 can be glass or plastic or any material suitable for transmitting one or more images of flames 31 therethrough. However, the screens 32, 38 are preferably glass, and the front surfaces 67 of either or both of screens 32, 38 can be partially silvered so that they are partially reflective, as disclosed in U.S. Pat. No. 5,642,580. In addition, the back surfaces 69 of the screens 32, 38 can be adapted for diffusing light from the light source 36 and transmitting such light through to the front surface 67, where the image of flames 31 thereby created is observable by the viewer (not shown). Preferably, a reflective region 82 of the front surface 67 which is adjacent to the simulated fuel bed 34, 54 is lightly silvered, so that the simulated fuel bed 34, 54 is partially reflected in the reflective region 82, giving the illusion of depth.

In addition, in the preferred embodiment, the simulated fuel elements 74, 75 are formed so as to further provide the illusion of depth. For example, as shown in FIG. 17, a first simulated log 85 (in first simulated fuel elements 74) and a second simulated log 86 (in second simulated fuel elements 75) have respective flat portions 87, 88 adapted to cooperate with the front surfaces 67 so that the simulated fuel elements 74, 75 can be positioned in the preferred locations relative to the front surfaces 67. Preferably, the first and second simulated fuel beds 34, 54 (including simulated fuel elements 74, 75) are positioned relative to the reflective regions 82 in the front surfaces 67 so that a reflected image of the simulated fuel beds 34, 54 is created, and the images of flames 31 appear to emanate from the simulated fuel beds 34, 54 and the reflected images of the simulated fuel beds 34, 54, and also from therebetween.

As can be seen in FIGS. 1 and 3, where the screen 32, 38 includes the pattern 76, the pattern 76 preferably extends only partly into the reflective region 82. It has been found that the pattern 76 preferably should extend only to a limited extent into the reflective region 82 because the pattern 76 otherwise tends to distract the viewer from the image of flames 31, so that the simulation of flames is then somewhat less effective overall.

The back surface 69 can be treated in any suitable manner, such as scoring, or covering the back surface 69 with a thin coating of transparent ink, to achieve the desired effect, i.e., diffusing light from the light source 36 to a limited extent, while also transmitting light from the light source 36 to the front surface 67. (In the preferred embodiment, a diffusing member 84 is provided, as described below). It is preferable that the back surface 69 partially diffuses light from the light source 36 because the back surface 69 serves the purpose of impeding, to the greatest extent feasible, the viewer's ability to see through the screens 32, 38 to the flame effect element 52, the flicker elements 44, 46 or the light source 36.

Figure 8:
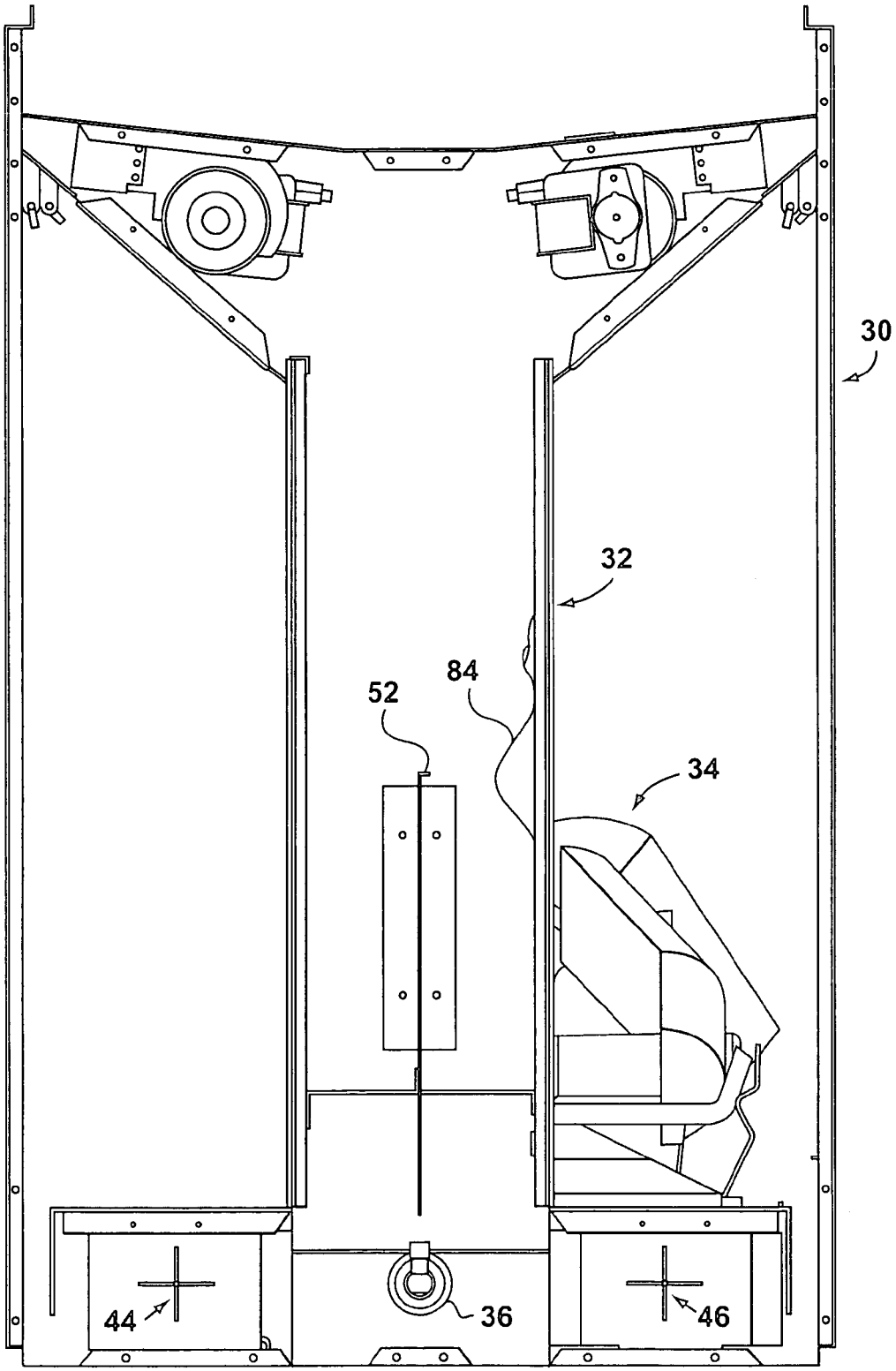
FIG. 8 is a side view of another embodiment of the flame simulating assembly, with certain elements removed for illustrative purposes.
Figure 9:
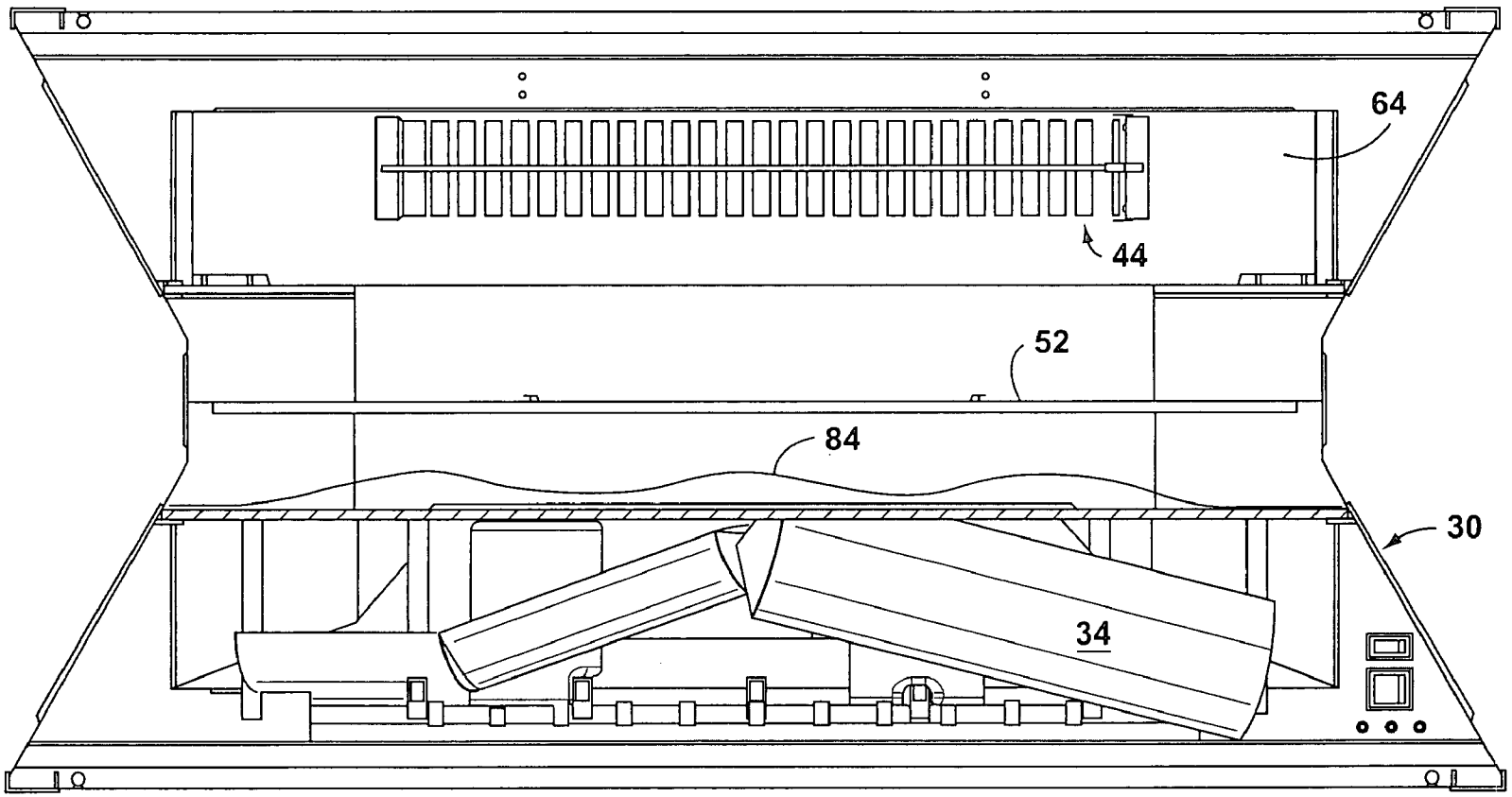
FIG. 9 is a cross section viewed from the top of the flame simulating assembly of FIG. 8, with certain elements removed for illustrative purposes.

Preferably, the back surface 69 is non-planar, so that the image of flames 31 transmitted through the back surface 69 appears to the viewer to be three-dimensional (FIGS. 8, 9), as described in U.S. Pat. No. 6,363,636 and U.S. patent application Ser. No. 10/101,013, filed on Mar. 20, 2002. Each of U.S. Pat. No. 6,363,636 and U.S. patent application Ser. No. 10/101,013 is hereby incorporated herein by reference. In the preferred embodiment, the diffusing member 84 is created out of translucent frosted plastic, which is non-planar. The diffusing member 84 can be used with either or both of screens 32, 38 to provide a three-dimensional image of flames 31 transmitted through the screens 32, 38. For example, as shown in FIGS. 8 and 9, the diffusing member 84 is positioned behind the first screen 32. It will be understood that the second screen 38 and the second simulated fuel bed 54 are not shown in FIGS. 8 and 9 in order to simplify the drawings.

Figure 19:
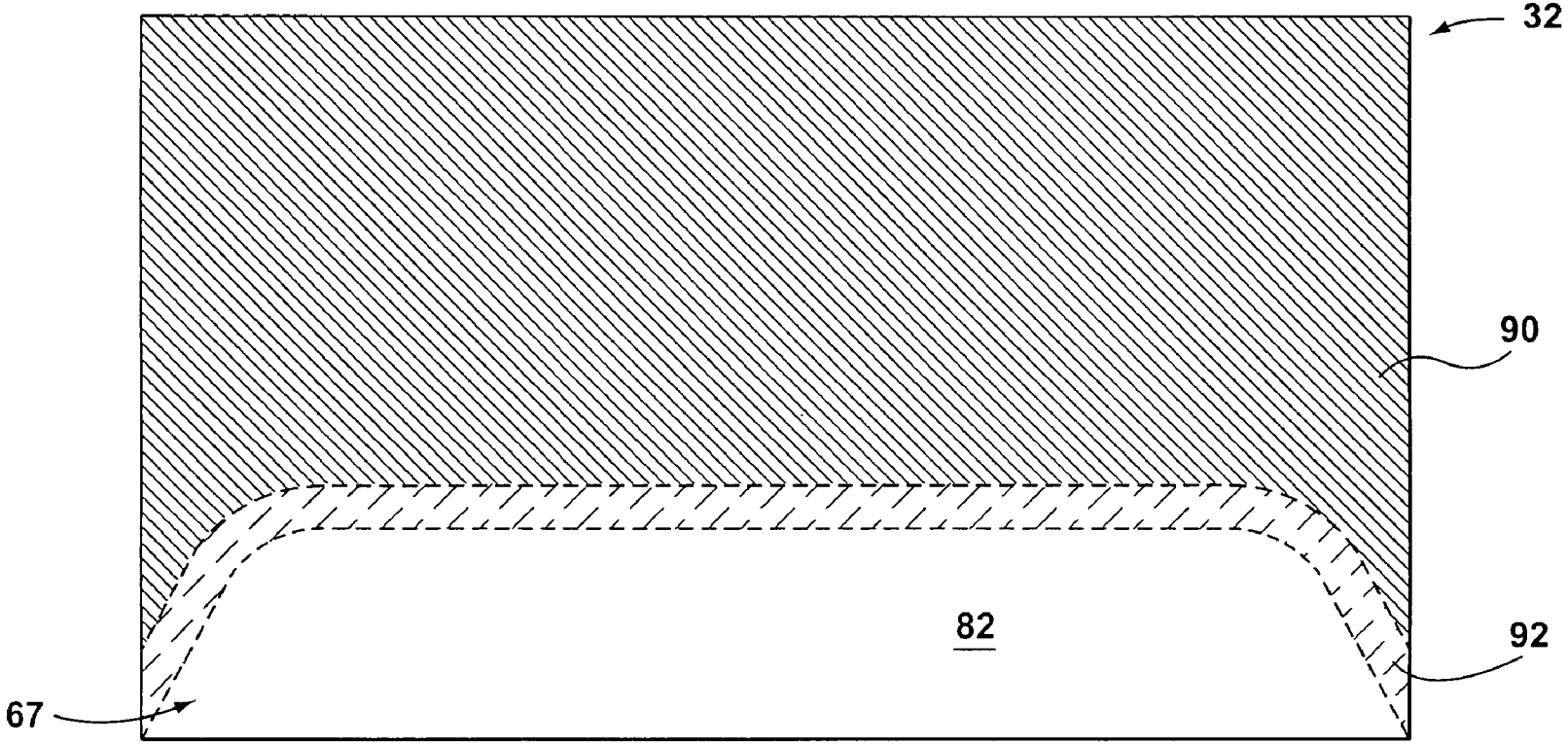
FIG. 19 is a front view of an alternative embodiment of a screen.

It will also be appreciated that, in the alternative embodiments, the screens 32, 38 may have front surfaces 67 which are not reflective and may or may not have back surfaces 69 which diffuse the light from the light source 36 as it passes through the back surfaces 69.

Where a reflective region 82 is included on a front surface 67, a non-reflective matte region 90 is preferably also included on the front surface 67 (FIG. 19), positioned so that objects in the room which the front surface 67 faces may not be reflected in the screen 32, 38. Using a matte region on a partially reflective surface is described in U.S. Pat. No. 6,269,567. U.S. Pat. No. 6,269,567 is hereby incorporated herein by reference. In practice, due to the typical positioning of the viewer's eyes relative to the screen 32, 38, the non-reflective matte region 90 is positioned distal from the simulated fuel bed 34, 54, i.e., distal from the reflective region 82 of the front surface 67. Preferably, a transition region 92 (FIG. 19) is positioned between the non-reflective matte region 90 and the reflective region 82. Because of the transition region 92, the transition between the reflective region 82 and the non-reflective region 90 is gradual, thereby providing a more realistic overall flame simulation effect.

As noted, the second simulated fuel bed 54 has not been shown in FIGS. 2 and 4–9 for clarity of illustration, but it will be understood that the second simulated fuel bed 54 is included in the flame simulating assembly 30 generally illustrated in those views. The preferred embodiment of the flame simulating assembly 30 is shown in FIGS. 20 and 21, including two simulated fuel beds 34, 54 in position.

The flame simulating assembly 30 also can include front reflectors 105 (FIG. 21) for reflecting light from the light source 36 onto the simulated fuel bed. Such front reflectors are described in U.S. Pat. Nos. 6,564,485 and 6,615,519. Each of U.S. Pat. Nos. 6,564,485 and 6,615,519 is hereby incorporated herein by reference. The front reflectors 105 provide a more realistic simulation of hot burning embers in the simulated fuel beds 34, 54. Preferably, and as described in U.S. Pat. No. 5,642,580, the simulated ember beds 72, 73 support the simulated fuel elements 74, 75 directly. Light from the light source 36, schematically represented by arrow "A", is directed to the underside 77 of the simulated ember beds 72, 73, and is transmitted through translucent parts (not shown) of the simulated ember beds 72, 73. Also, light from the light source 36, after passing through the translucent parts (or transparent parts, or apertures, as the case may be), is reflected by the front reflectors 105 onto the simulate fuel beds 34, 54, as schematically represented by arrow "B". Front reflectors in flame simulating assemblies are described in U.S. Pat. Nos. 6,564,485 and 6,615, 519.

Additional embodiments of the invention are shown in FIGS. 10–18 and 22–28. In FIGS. 10–18 and 22–28, elements are numbered so as to correspond to like elements shown in FIGS. 1–9 and 19–21.

Figure 10:
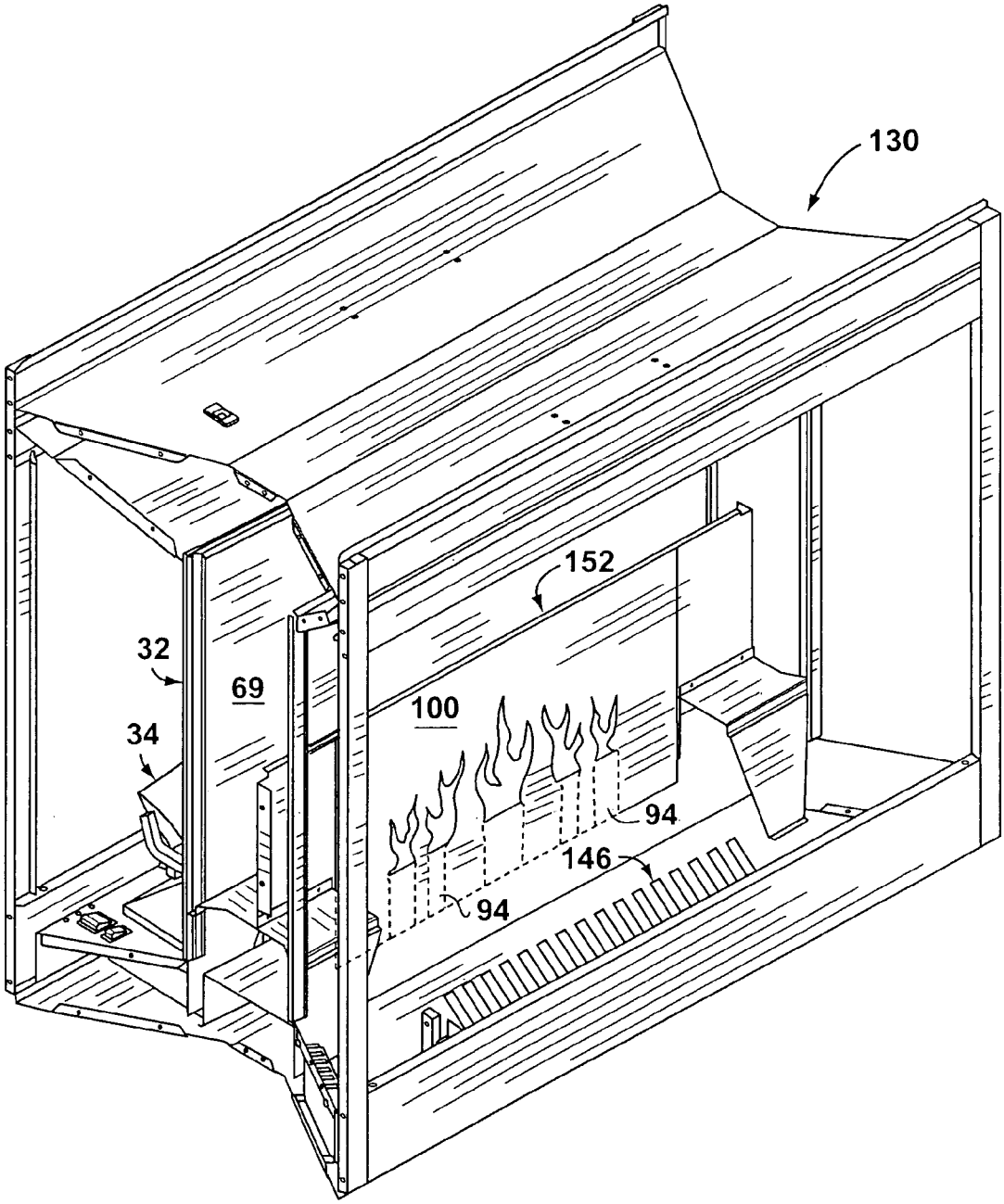
FIG. 10 is an isometric view of another embodiment of the flame simulating assembly including a flame effect element with reflective portions thereon, with certain elements removed for illustrative purposes, drawn at a smaller scale.
Figure 11:
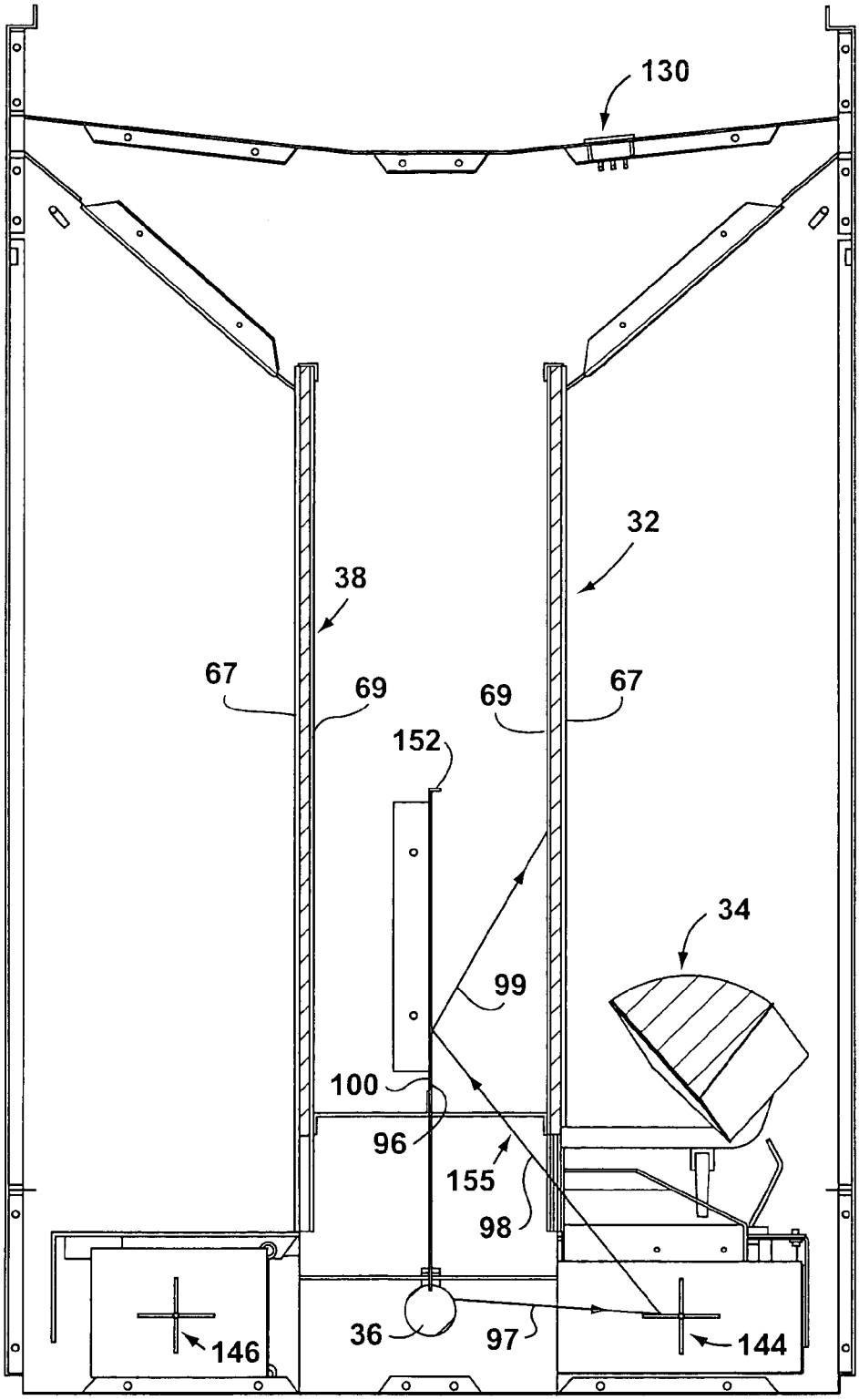
FIG. 11 is a cross section viewed from the side of the flame simulating assembly of FIG. 10 with certain elements removed for illustrative purposes, drawn at a larger scale.

An alternative embodiment is shown in FIGS. 10–11, in which a flame simulating assembly 130 includes a flame effect element 152 with reflective portions 94 for configuring light from the light source 36 so that one or more images of flames 31 is created (FIG. 10). As can be seen in FIG. 11, in the flame simulating assembly 130, a first flicker element 144 is positioned in a first path of light 155 between the light source 36 and the first screen 32, and below the first simulated fuel bed 34. Light from the light source 36 is caused to flicker, or fluctuate, by the first flicker element 144, and reflected from the first flicker element 144 to a first side 96 of the flame effect element 152. Reflective portions 94 are positioned on the first side 96. The fluctuating light is further reflected by the reflective portions 94 on the first side 96 to the back surface 69 of the first screen 32, to provide one or more image of flames 31 transmitted through the first screen 32. A first path of light 155 is schematically represented by arrows 97, 98, and 99 in FIG. 11.

It will be understood that the flame simulating assembly 130 preferably includes both simulated fuel beds 34, 54, and that the second simulated fuel bed 54 is not shown in FIGS. 10 and 11 for clarity in the drawings. FIG. 10 shows a second side 100 of the flame effect element 152, with reflective portions 94 thereon, and showing a second flicker element 146. Also, it will be understood that a second path of light (not shown) generally corresponding to the first path of light 155 simultaneously results in one or more images of flames transmitted through the second screen 38.

Figure 12:
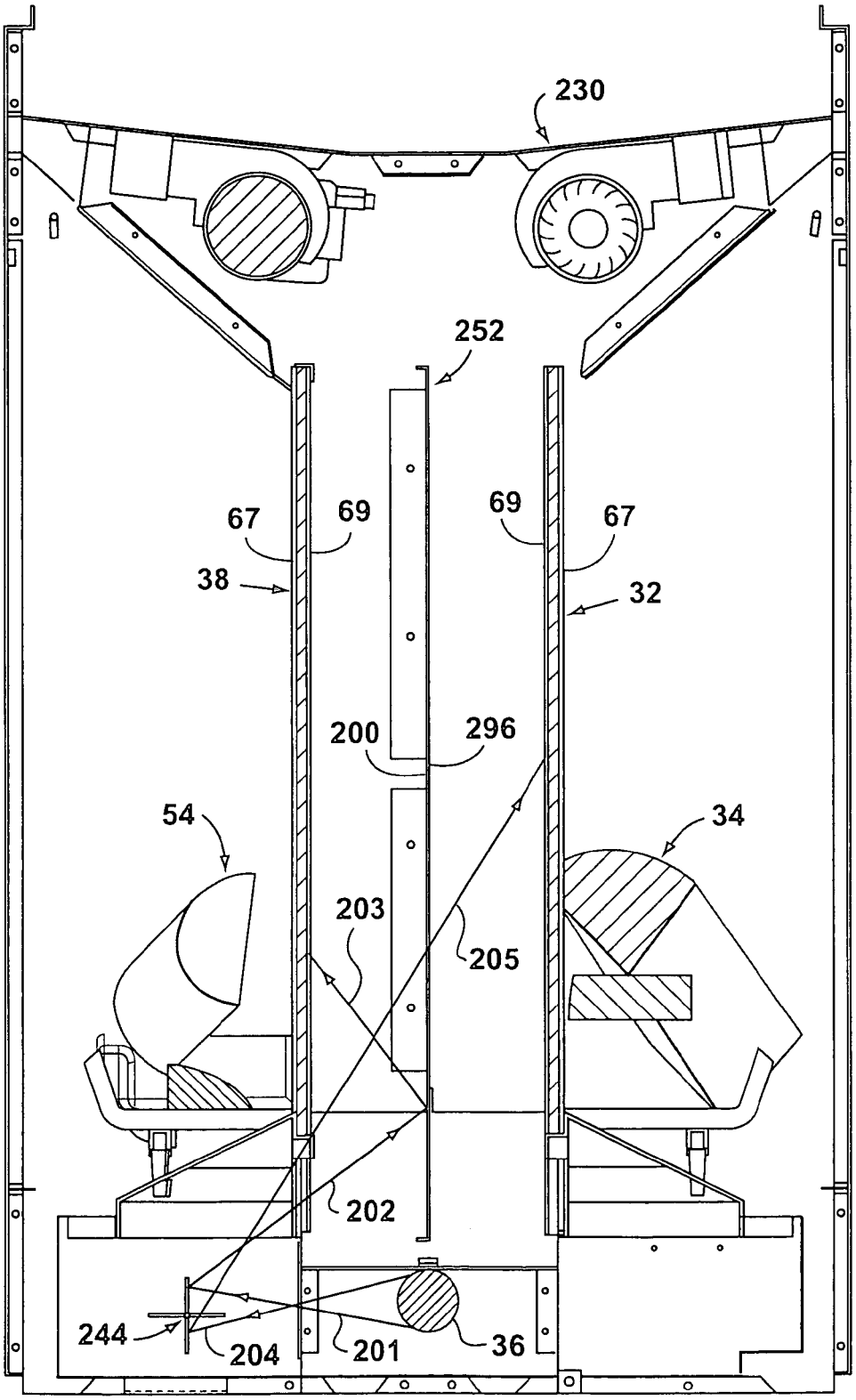
FIG. 12 is a cross section viewed from the side of another embodiment of the flame simulating assembly including a flame effect element with a cutout portion and a reflective portion and a single flicker element.
Figure 13:
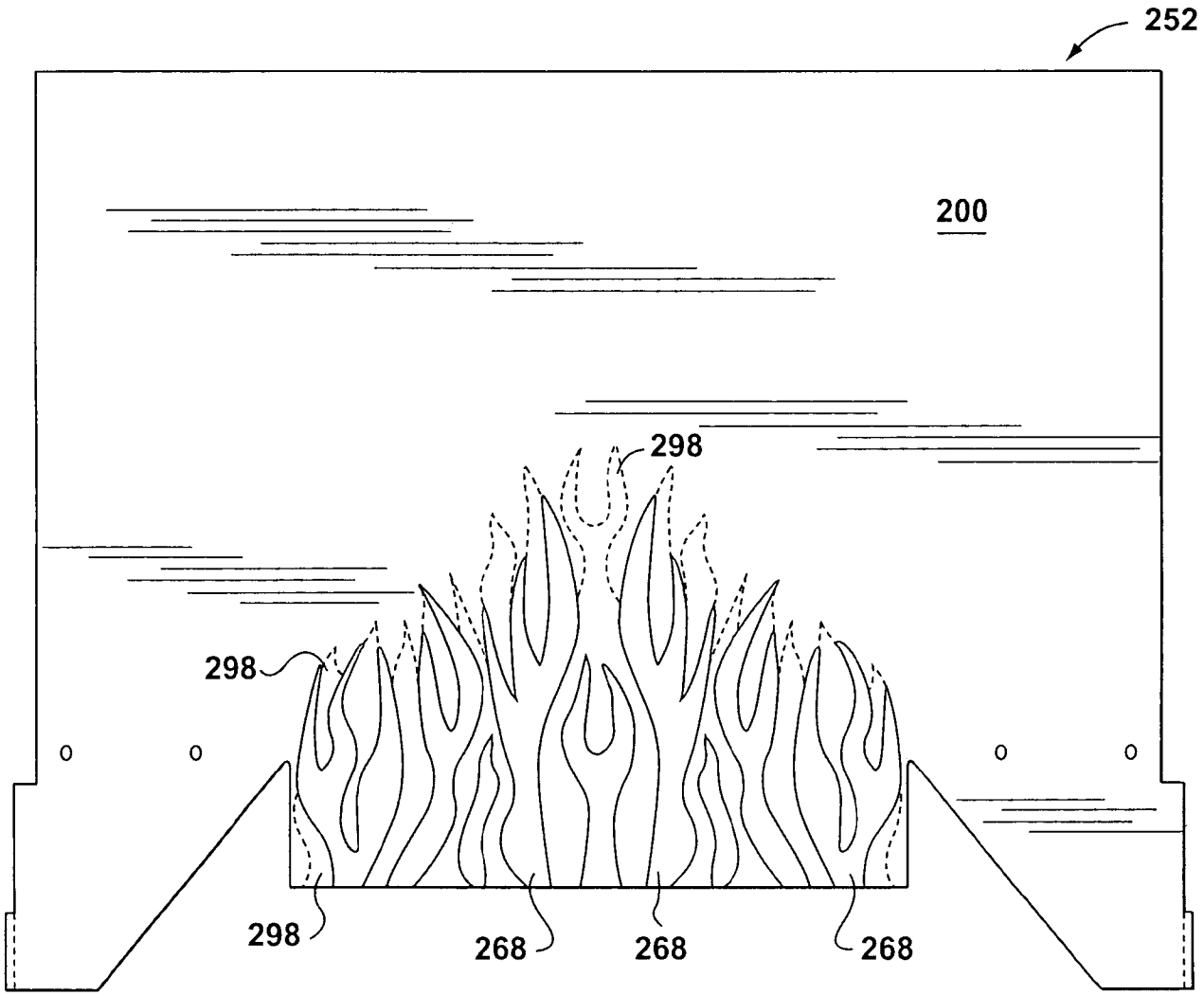
FIG. 13 is an elevation view of a first side of the flame effect element included in the flame simulating assembly of FIG. 12, drawn at a larger scale.
Figure 14:
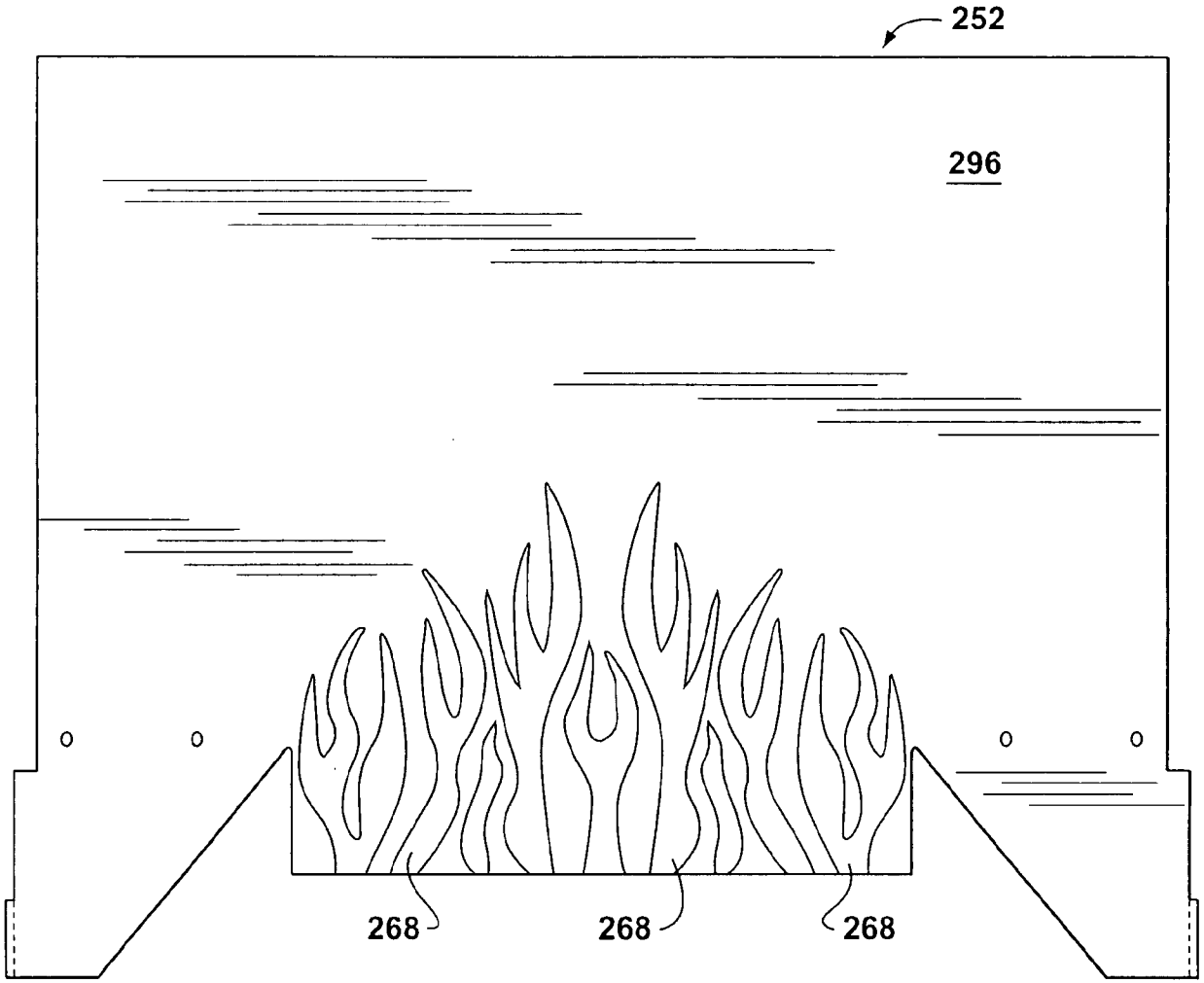
FIG. 14 is an elevation view of a second side of the flame effect element of FIG. 13.

Another alternative embodiment is shown in FIGS. 12–14, in which a flame simulating assembly 230 can be seen which includes a flicker element 244 and a flame effect element 252. Although various types of flicker elements could be used, the flicker element 244 is preferably a rotisserie type of flicker element. The flame effect element 252 includes apertures 268 (FIGS. 13, 14) for configuring light from the light source 36 to provide one or more images of flames 31, but the flame effect element 252 additionally includes one or more reflective portions 298 (FIG. 13) on a second side 200 of the flame effect element 252 which also configure light from the light source 36 to provide one or more images of flames 31. Preferably, and as shown in FIG. 14, a first side 296 of the flame effect element 252 does not include reflective portions, as such reflective portions would be unnecessary.

As can be seen in FIG. 12, the flicker element 244, which is adapted to create a flickering or fluctuating light, is positioned in a first path of light 255 between the light source 36 and the first screen 32. Light from the light source 36 is reflected by the flicker element 244, and the fluctuating light thus reflected (schematically represented by arrow 205) is transmitted through the apertures 268 and through the first screen 32 to produce one or more images of flames 31. The first path of light 255 is schematically represented by arrows 204 and 255.

FIG. 12 also shows that the flicker element 244 is positioned in a second path of light 257 between the light source 36 and the second screen 38. Light from the light source 36 is reflected by the flicker element 244, and the fluctuating light thus reflected (schematically represented by arrow 202) is reflected by the reflective portions 298 on the first side 200 of the flame effect element 252. The fluctuating light thus reflected from the reflective portions 298 (schematically represented by arrow 203) is transmitted through the second screen 38 to produce one or more images of flames 31. The second path of light 257 is schematically represented by arrows 201, 202 and 203. Advantageously, in this embodiment, the flame simulating assembly 230 includes only one flicker element. Instead of two motors to rotate two flicker elements, the flame simulating assembly 230 includes only one motor for that purpose.

Figure 16:
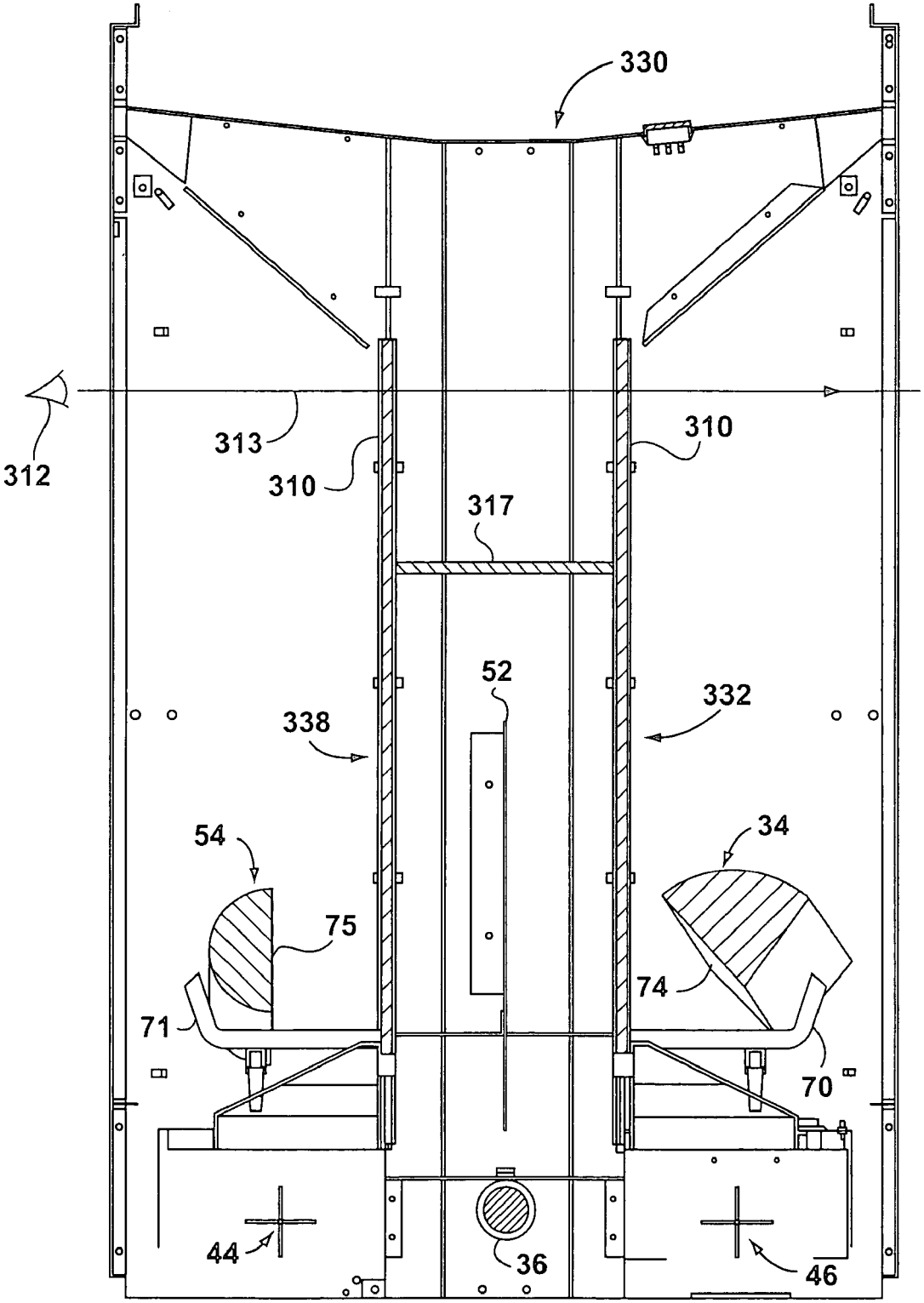
FIG. 16 is a cross section of the flame simulating assembly of FIG. 15 taken along line 16—16 in FIG. 15, drawn at a larger scale.
Figure 18:
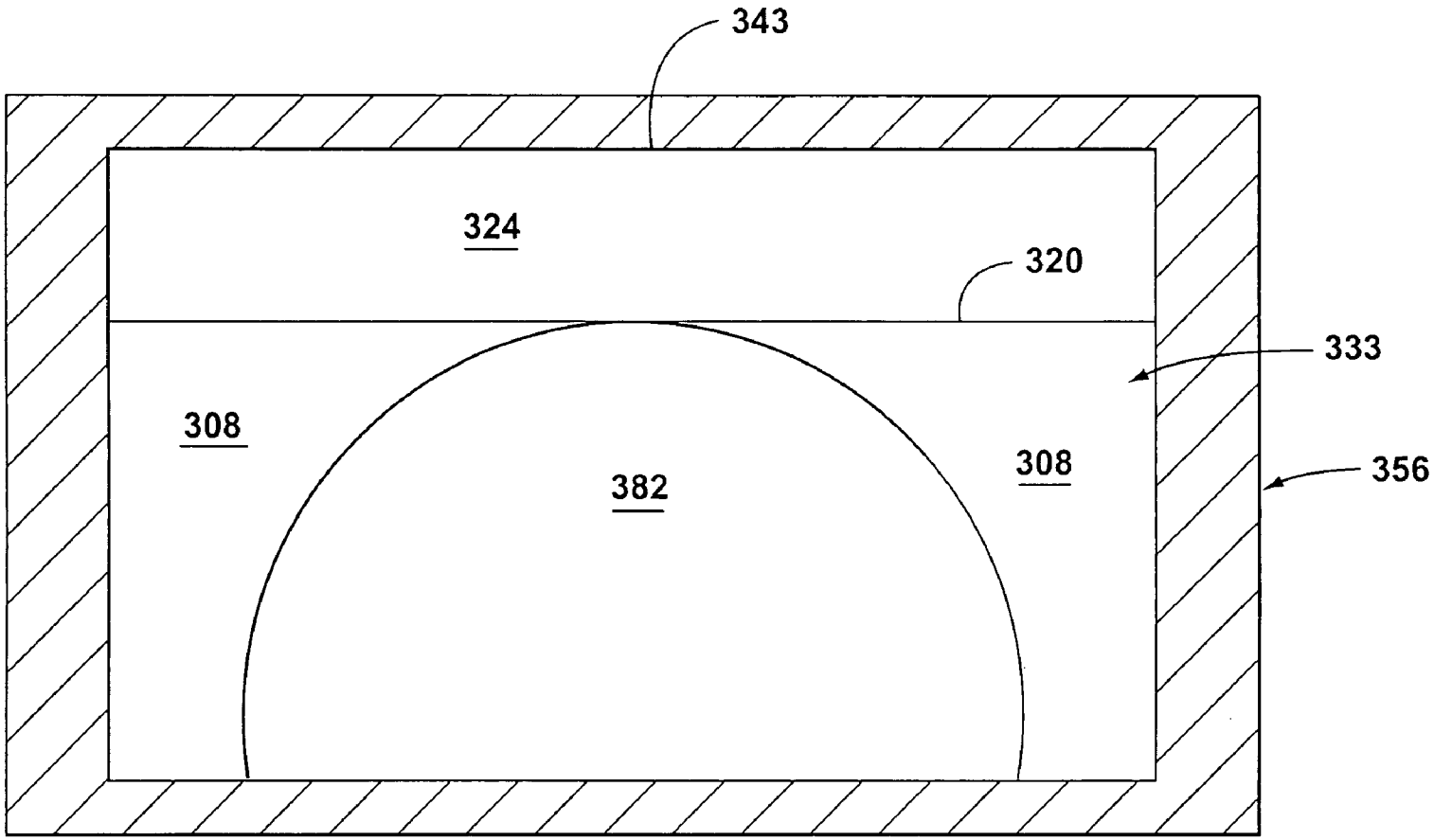
FIG. 18 is a front view of a screen included in the flame simulating assembly of FIG. 15, drawn at a larger scale.

Another alternative embodiment, a flame simulating assembly 330, is shown in FIGS. 15–18. As shown in FIGS. 15 and 16, the flame simulating assembly 330 includes screens 332, 338, and each of the screens 332, 338 preferably has a front surface 367 with a reflective portion 382, a non-reflective portion 308, and a top region 310 adapted to permit substantially unobstructed observation therethrough. A front view of the screen 338 is shown in FIG. 18.

The flame simulating assembly 330 is intended to simulate a real two-sided fireplace (not shown). As can be seen in FIG. 16, a viewer 312 viewing the second screen 338, is able to see through the flame simulating assembly 330, i.e., above the images of flames 31 transmitted through the second screen 338, into the next room (not shown), i.e., the room from which the first screen 332 is observable. Arrow 313 in FIG. 16 schematically represents the line of sight of the viewer 312 through the top regions 310 in each of the screens 332 and 338. As shown in FIG. 16, the viewer 312 can see through the top region 310 of the second screen 338 and also through the top region 310 of the first screen 332. The viewer 312 also can observe one or more images of flames 31 transmitted through the second screen 338 simultaneously. Similarly, another viewer (not shown) facing the first screen 332 can see through the top regions 310 into the room in which the viewer 312 is located.

Preferably, a shield 317 is positioned between the screens 332, 338 at a height just below the top regions 310, as can be seen in FIG. 16. The shield 317 is intended to prevent possible distractions between screens 332 and 338 from entering the viewer's field of vision, by obstructing or blocking such distractions. Such distractions could be, for example, random flashes of light from the light source 36 reflected generally upwardly by a flicker element. Alternatively, the viewer may be distracted by the back surface 69 of the screen opposite to that viewed by the viewer, or images of flames transmitted through such screen. (For example, if the viewer is viewing the first screen 332, then in the absence of the shield 317, the viewer may be able to observe—through the top region 310—the back surface 60 of the second screen 338, or images of flames transmitted through the second screen 338.) These distractions would detract from the overall effect of the flame simulation. The shield 317 is preferably made of dark (preferably black) material, for example, a black (or dark) cloth placed on a frame (not shown) supported by the screen frames. Alternatively, the shield 317 could be a piece of sheet metal or other suitable material painted flat black.

It will be appreciated that various arrangements could be used which may provide satisfactory results, depending on the effects sought to be simulated, and cost considerations. For example, the screens 332, 338 could include regions on the front surfaces 67 positioned adjacent to the simulated fuel beds 34, 54 which are not necessarily reflective, or only partially reflective. Similarly, the screens 332, 338 could have only the reflective regions 382 and the top portions 310, i.e., the screens 332, 338 could be constructed without the non-reflective regions 308. Also, although the top portions 310 of the screens 332, 338 are preferably substantially transparent, they could be translucent. Alternatively, the top regions 310 could have other features intended to impede (at least partially) the viewer's ability to see elements behind the front surfaces 67 while permitting substantially unobstructed observation therethrough.

An alternative embodiment 333 of the first and second screens is shown in FIG. 18. As can be seen in FIG. 18, the screen 333 is positioned within the flame simulating assembly housing 356. The housing 356 (including screen frames (not shown in FIG. 18)) maintains the screens 333 in a substantially upright position. (It will be understood that both the first and second screens of the alternative embodiment shown in FIG. 18 are indicated by the reference numeral 333.) Each of the first and the second screens 333, however, includes a top edge 320 distal from the first simulated fuel bed 34 and the second simulated fuel bed 54 respectively. As can be seen in FIG. 18, the top edges 320 of the screen 333 are spaced apart from top panels 343 of the housing 356 to define an upper opening 324 which is thereby formed through the flame simulating assembly 330. Substantially unobstructed observation is thus permitted through the upper opening 324 above the screens 333, from each side of the flame simulating assembly 330 to the other. Because this is similar to the substantially unobstructed observation which may be enjoyed by a viewer of a real two-sided fireplace over a wood or coal fire, the upper opening 324 tends to enhance the overall simulation effect. A shield (not shown) similar to the shield 317, or similar means, is preferably included in the flame simulating assembly 330, positioned to enhance the overall simulation effect.

Figure 22:
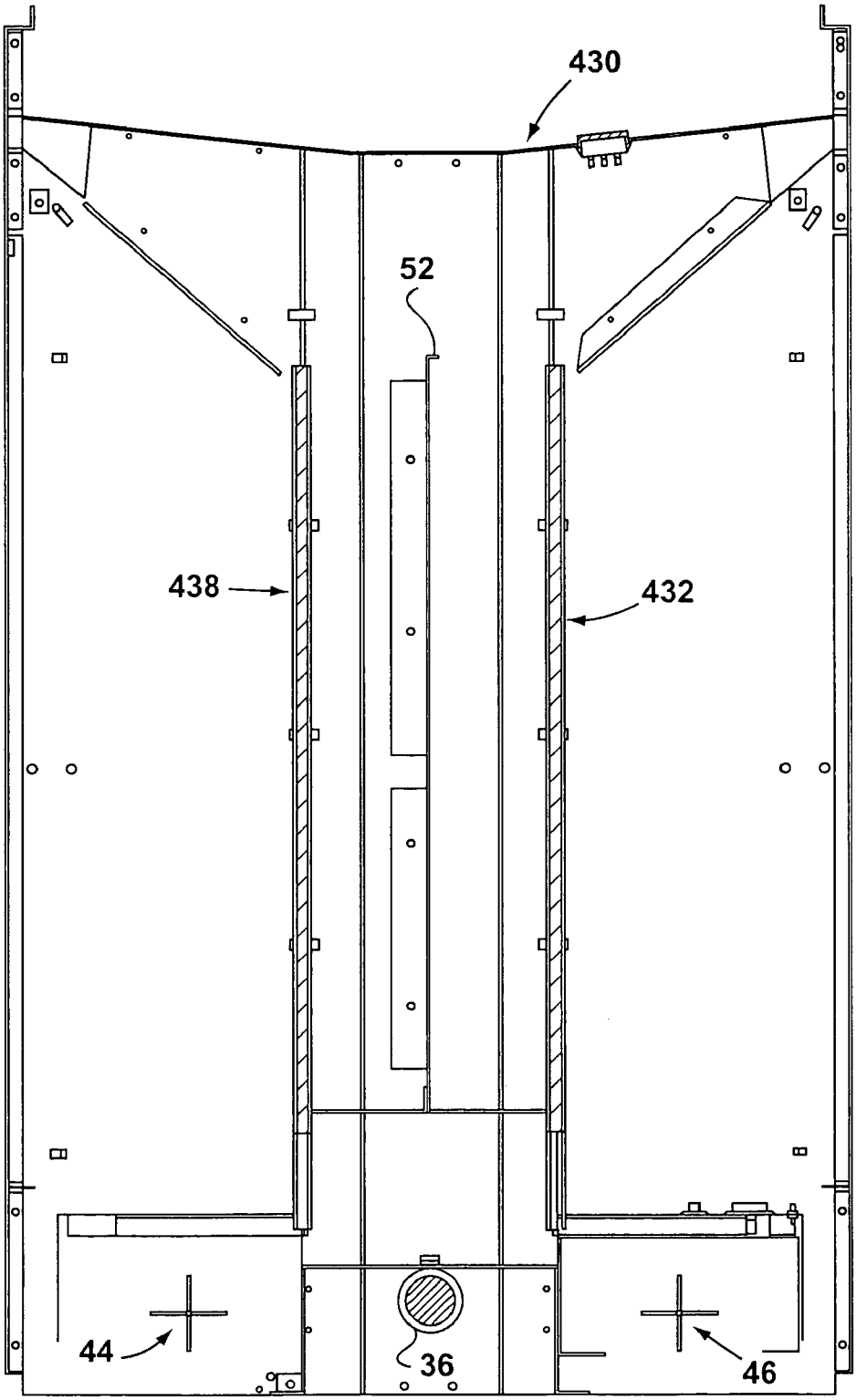
FIG. 22 is a cross section viewed from the side of another embodiment of the flame simulating assembly.

Another embodiment, being a flame simulating assembly 430, is shown in FIG. 22. This embodiment does not include simulated fuel beds. The images of flames 31 are transmitted through the screens 432, 438. The images of flames 31 result from light from the light source 36 which has been caused to fluctuate by the flicker elements 44, 46 and then configured into an image of flames 31 by the flame effect element 52. The screens 432, 438 transmit one or more images of flames 31, and the screens 432, 438 are formed and colored so as to provide images which simulate flames. It will be appreciated that a user (not shown) could, if desired, provide one or more simulated fuel beds to be positioned in front of the screens 432, 438, to enhance the simulation effect. For example, real wooden logs (not shown) could be used as simulated fuel beds and positioned in front of the screens 432, 438, thereby enhancing the simulation effect.

Figure 23:
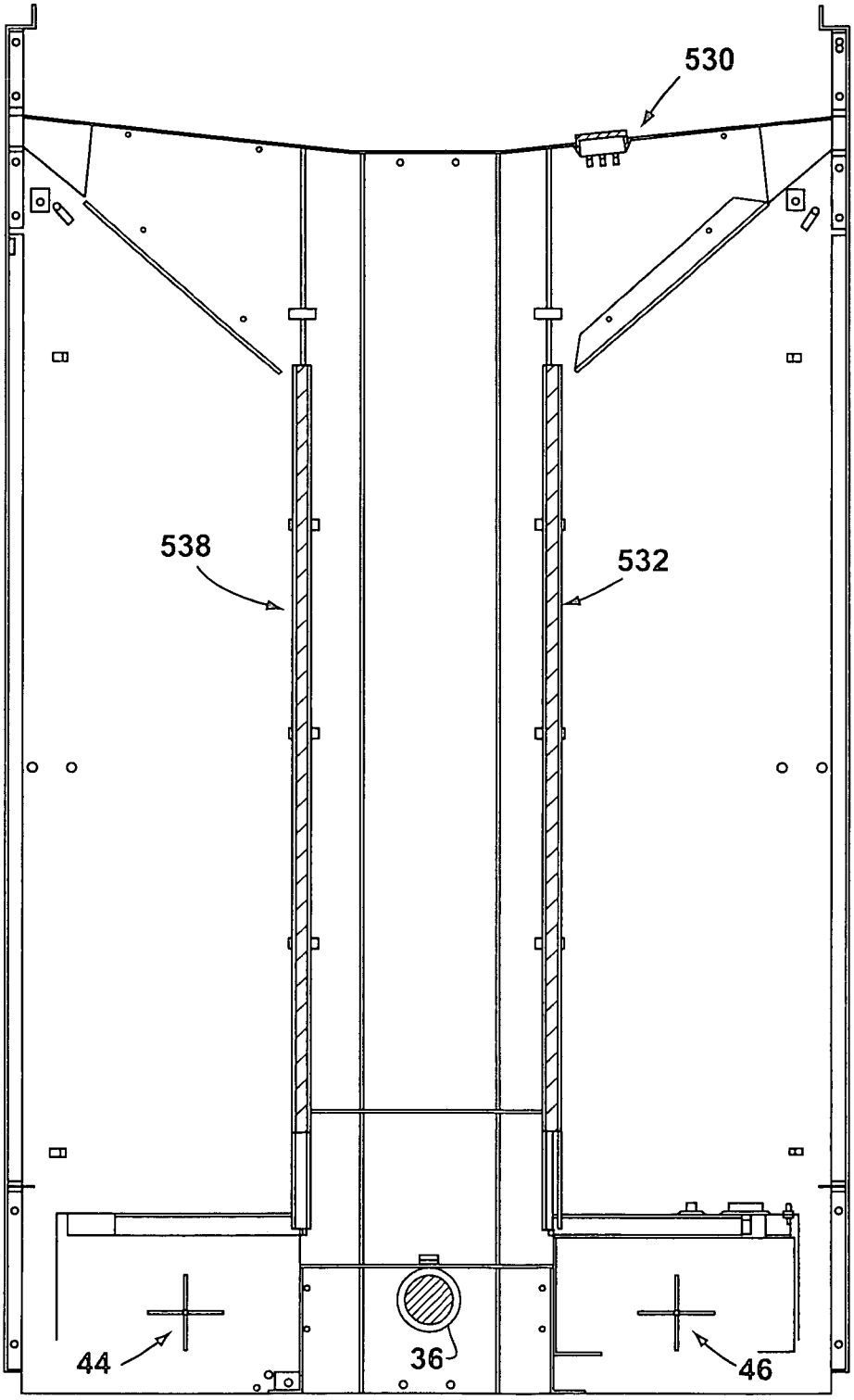
FIG. 23 is a cross section viewed from the side of another embodiment of the flame simulating assembly.

Yet another embodiment, being a flame simulating assembly 530, is shown in FIG. 23. In this embodiment, the flame simulating assembly 530 includes screens 532, 538, a light source 36, and flicker elements 544, 546. Preferably, the flame simulating assembly 530 does not include a flame effect element. The images of flames 31 result from light from the light source 36 which has been caused to fluctuate by the flicker elements 44, 46, and which is reflected by the flicker elements 44, 46 to the first and second screens 532, 538.

Figure 24:
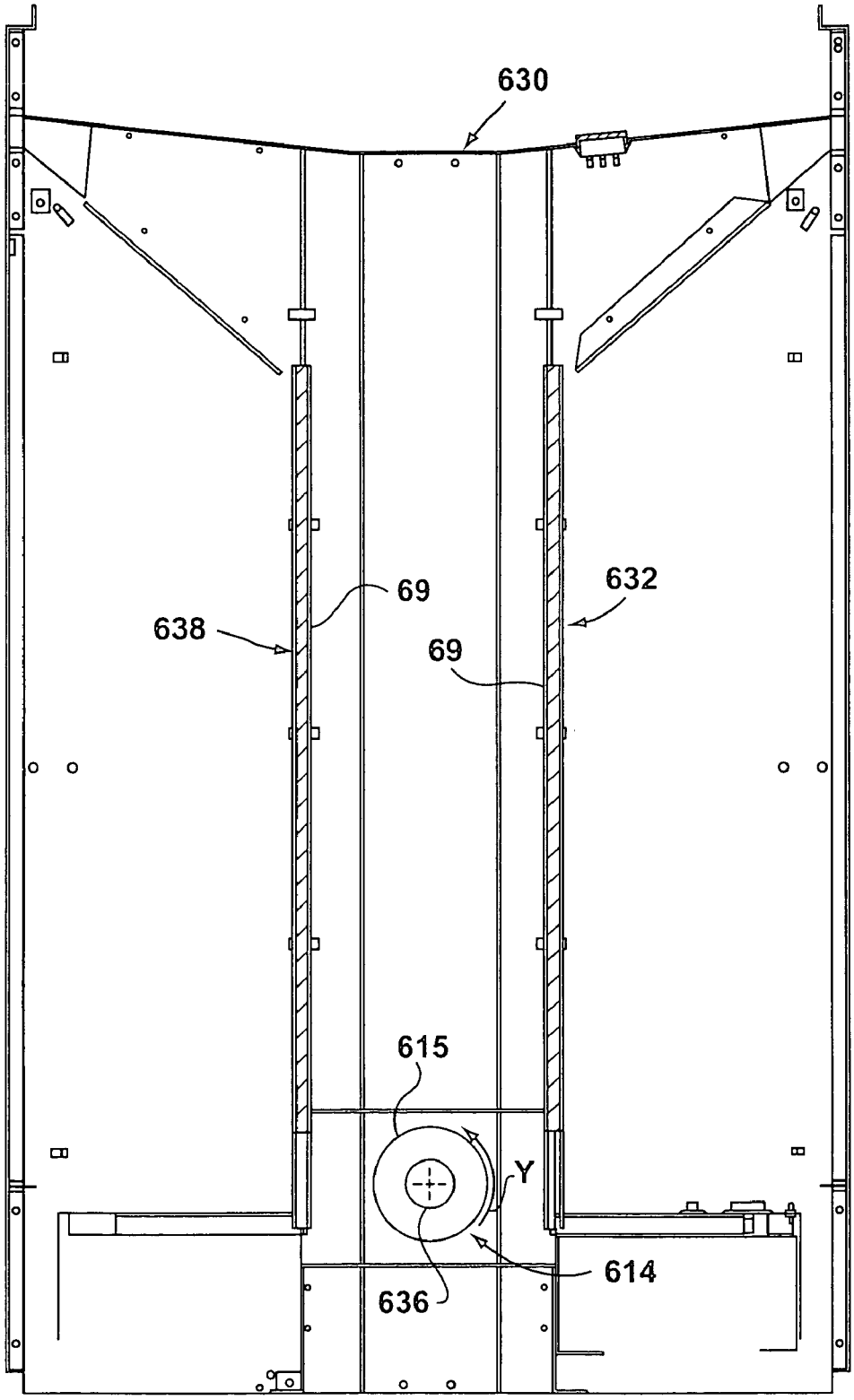
FIG. 24 is a cross section viewed from the side of another embodiment of the flame simulating assembly.
Figure 25:
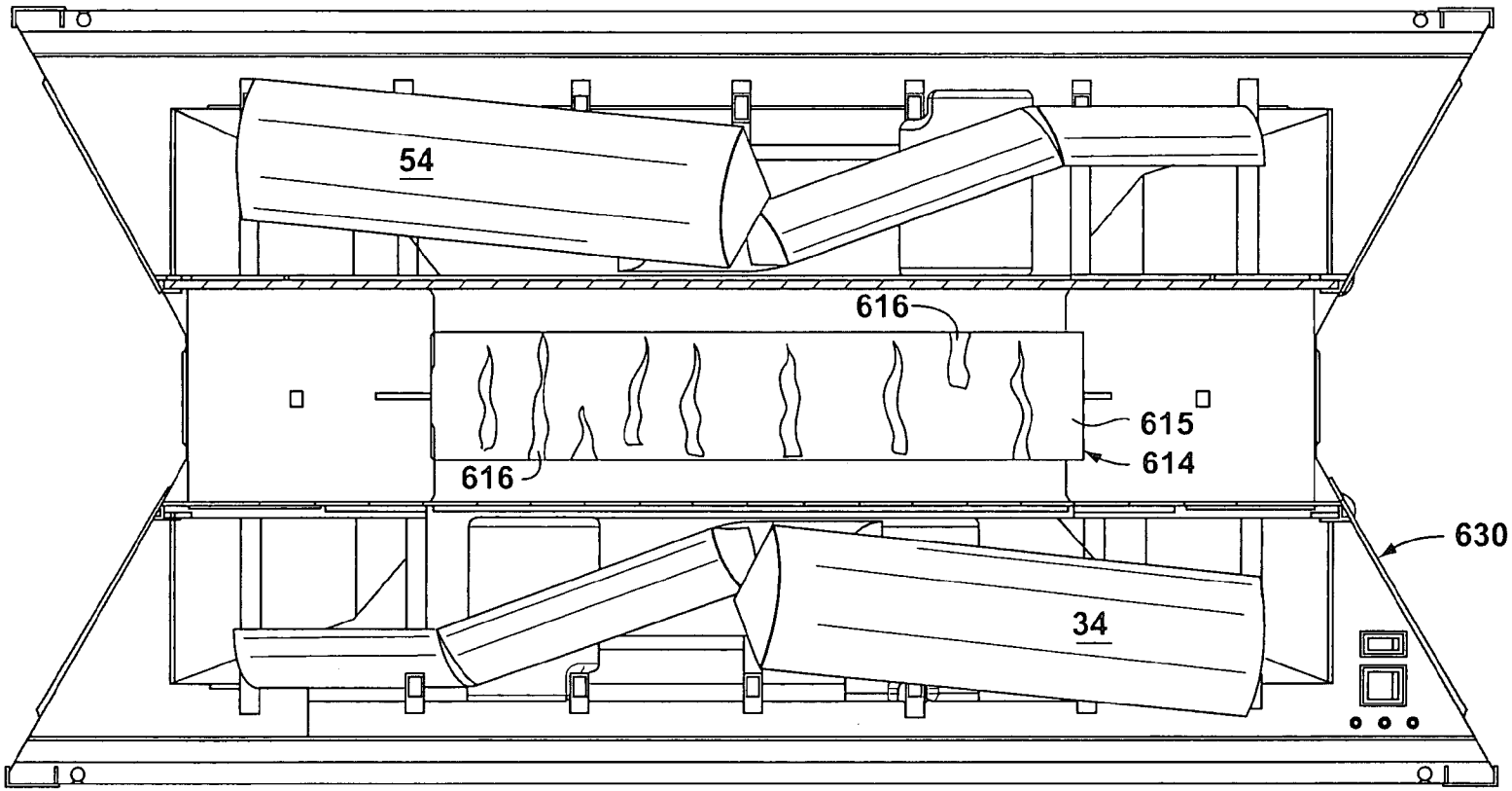
FIG. 25 is a cross section viewed from the top of the flame simulating assembly of FIG. 24.

In another embodiment, a flame simulating assembly 630 shown in FIGS. 24 and 25, a light source 636 is positioned inside a flicker element 614. In the flame simulating assembly 630, the flicker element 614 is a "drum" type of flicker element. In this type of flicker element, a cylindrical body 615 includes a plurality of flame-shaped apertures 616. Preferably, the body 615 is adapted to rotate about the light source 636, which is positioned inside the body 615. It is preferred that the light source 636 is stationary, and the body 615 is rotated by an electric motor (not shown). Light from the light source 636 is configured by the apertures 616 to provide an image of flames which is transmitted to the back surfaces 69 of the screens 632, 638. Because the body 615 preferably rotates about the light source 636, the images of flames 31 which are generated by the flicker element 614 and the light source 636 fluctuate, to simulate flames.

The flicker element 615 preferably rotates in the direction shown by arrow "Y" in FIG. 24. It can be seen in FIG. 24 that the images of flames 31 produced in the flame simulating assembly 630 which are transmitted through the first screen 632 appear to travel generally upwardly. However, it will be appreciated that the image of flames 31 transmitted through the second screen 638 appear to travel generally downward, which tends to detract from the overall realistic effect usually sought. In some circumstances, however, a realistic flame effect may not be intended, and the flame simulating assembly 630 may be used in such applications.

In FIG. 23, the flame simulating assembly 630 is shown without simulated fuel beds, as the flame simulating assembly 630 may be so constructed. Preferably, however, the flame simulating assembly 630 includes simulated fuel beds 34, 54, as shown in FIG. 25.

Figure 27A:
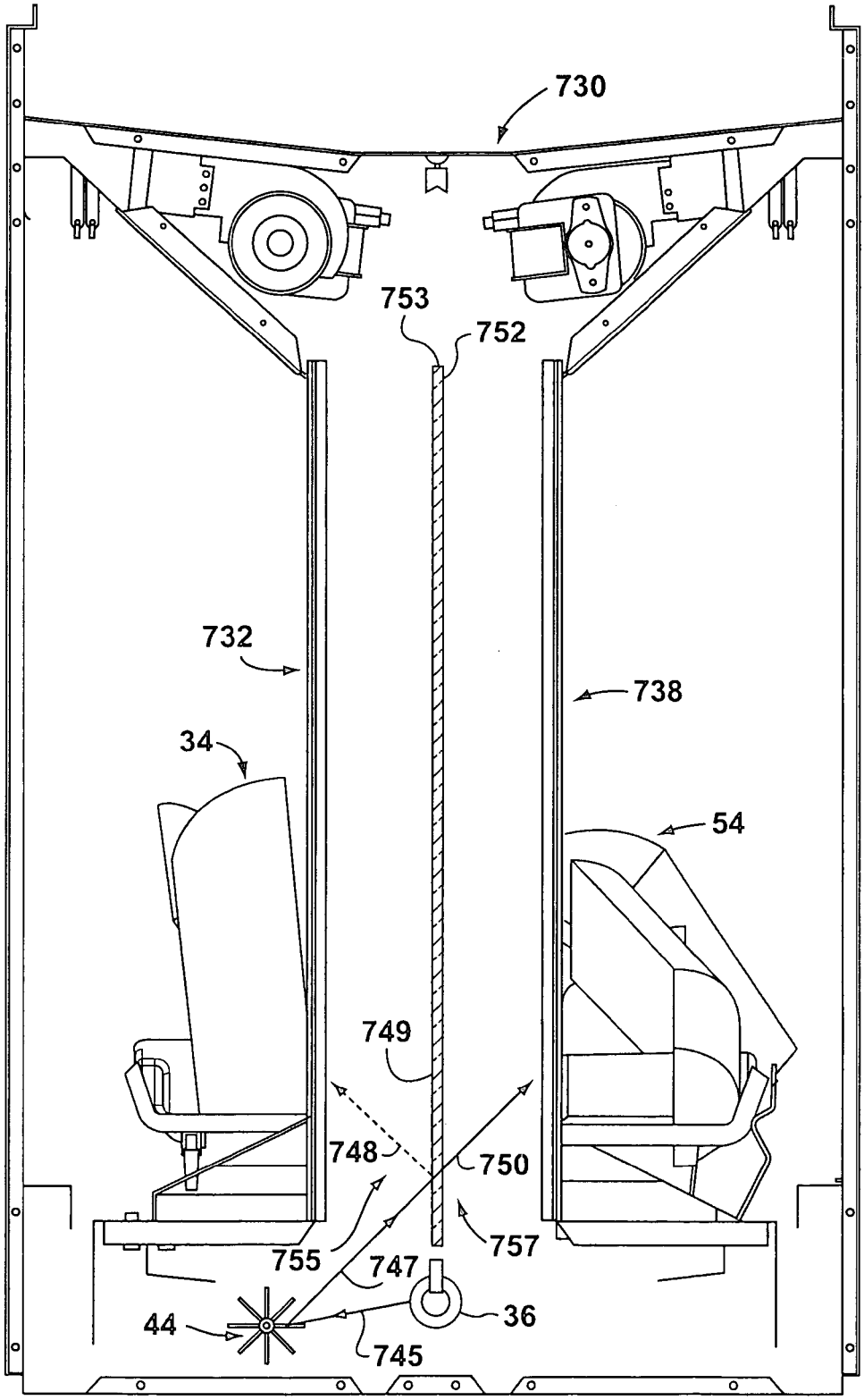
FIG. 27A is a cross section viewed from the side of another alternative embodiment of the flame simulating assembly, drawn at a smaller scale.

In another alternative embodiment 730 of a flame simulating assembly of the invention, a flame effect element 752 is included. The flame effect element 752 includes a body portion 753 which is at least partially translucent. For example, the body portion 753 could comprise glass or plastic, or any suitable materials. The body portion 753 could be suitably tinted or tinted in any suitable manner to achieve any desired effects. As can be seen in FIG. 27A, the body portion 753 includes a first surface 749 facing a first screen 732 and a second surface 751 facing a second screen 738. Preferably, the first surface 749 is at least partially reflective.

Figure 26:
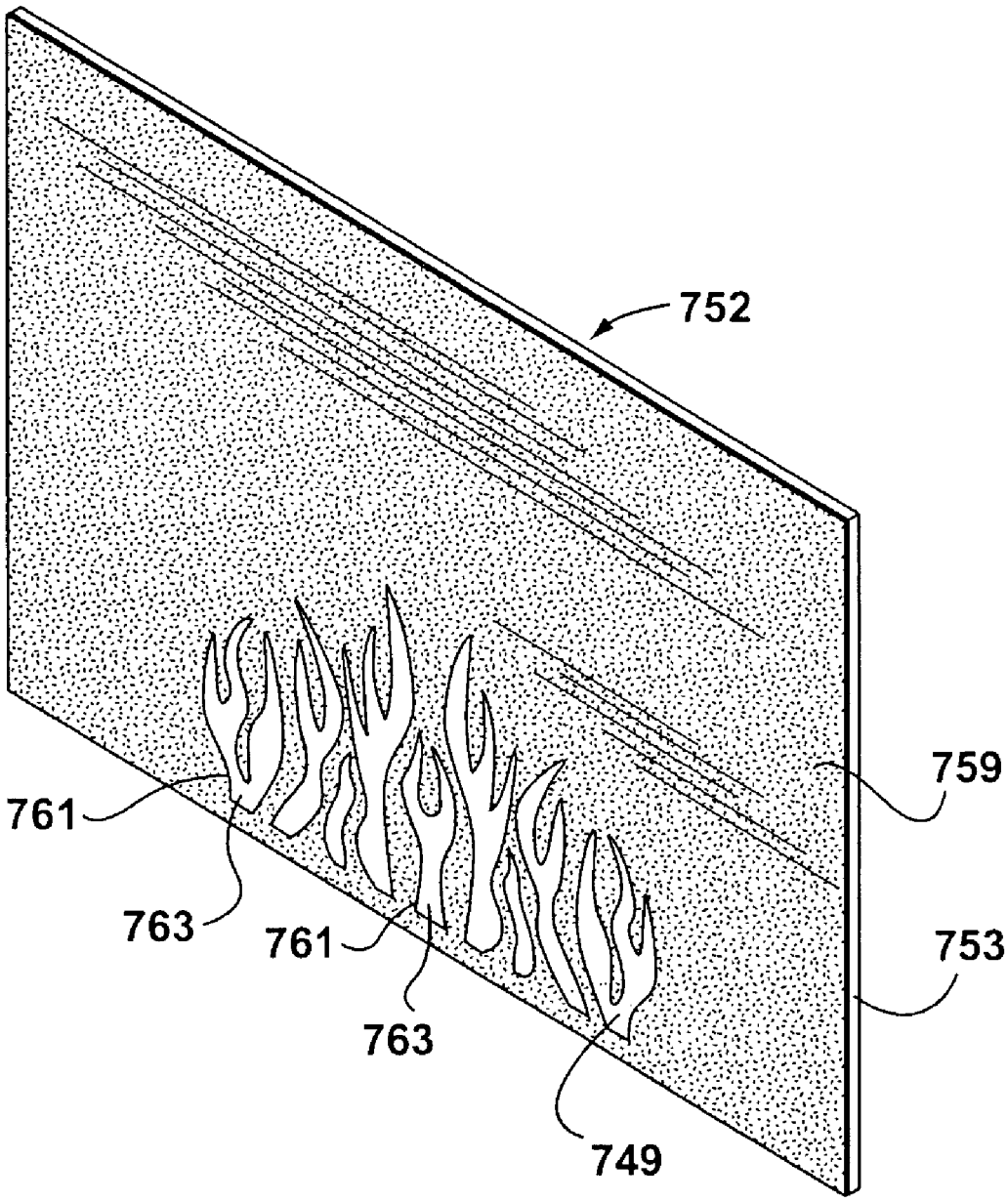
FIG. 26 is an isometric view of another alternative embodiment of the flame effect element, drawn at a larger scale.

It is preferred that the flame effect element 752 additionally includes a substantially non-reflective, or mask, portion 759 (FIG. 26). Preferably, and as shown in FIG. 26, the first surface 749 of the body portion 753 is substantially covered by the mask portion 759, which is preferably disposed on the first surface 749, but does not cover the entire first surface 749. The mask portion 759 includes one or more apertures 761 for configuring light from the light source 36 to form one or more image of flames 31. As can be seen in FIG. 26, one or more apertures 761 defines one or more exposed parts 763 of the first surface 749. Because each aperture 761 is substantially flame-shaped, each exposed part 763 is also flame-shaped.

As can be seen in FIG. 27A, the flicker element 44 is positioned in a path of light between the light source 36 and the flame effect element 752. Light from the light source 36 is reflected by the flicker element 44, such light being caused to flicker, or fluctuate, by the flicker element 44. The fluctuating light thus reflected (schematically represented by arrow 747) is partially reflected from the exposed parts 763, and partially transmitted through the exposed parts 763. Light from the light source 36 which is reflected by the exposed parts 763 and also light from the light source 36 which is transmitted through the exposed parts 763 is configured by the by the apertures 761 to form one or more images of flames 31. Accordingly, light reflected by the exposed parts 763 (schematically represented by arrow 748) forms one or more images of flames 31 which are transmitted through the first screen 732. Also, light transmitted through the exposed parts 763 (schematically represented by arrow 750) also forms one or more images of flames 31, which are transmitted through the second screen 738. A first path of light 755 between the light source 36 and the first screen 732 is represented by arrows 745, 747, and 748 (FIG. 27A). A second path of light 757 from the light source 36 to the second screen 738 is represented by arrows 745, 747, and 750.

In the preferred embodiment, the mask portion 759 is a layer of substantially non-reflective black paint. Preferably, the mask portion 759 is formed by painting flat black paint on the reflective side 749 of the body portion 753, with the exposed parts 763 of the first surface 749 being protected from the paint by a stencil (not shown) forming flame-shaped parts.

Figure 27B:
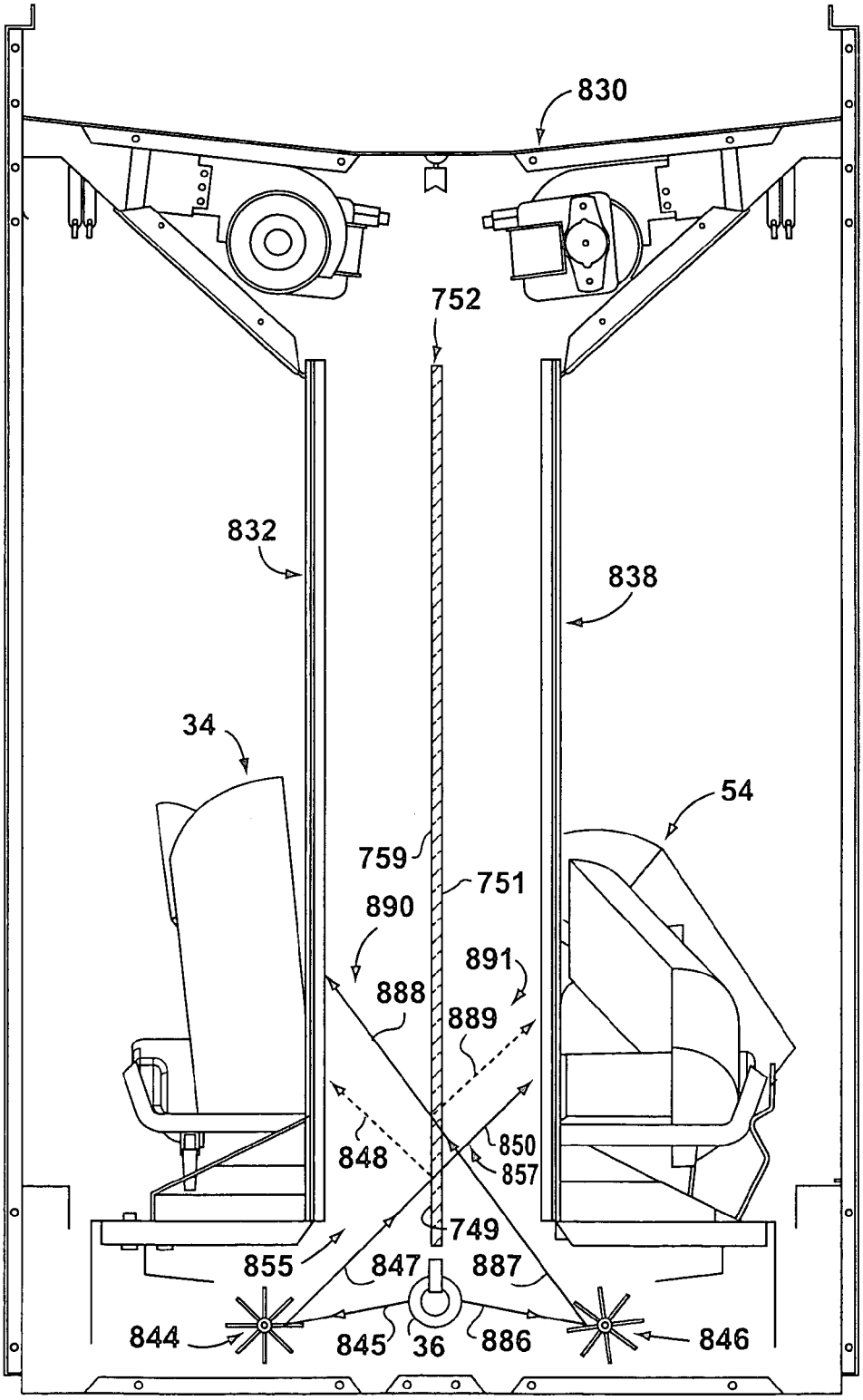
FIG. 27B is a cross section viewed from the side of another alternative embodiment of the flame simulating assembly.

In another alternative embodiment shown in FIG. 27B, a flame simulating assembly 830 includes a first flicker element 844 and a second flicker element 846. The flame simulating assembly 830 also includes the flame effect element 752. As can be seen in FIG. 27B, the first flicker element 844 is positioned in a primary path of light (schematically represented by arrows 845, 847) between the light source 36 and the flame effect element 752. Light from the light source 36 is reflected by the first flicker element 844, and the fluctuating light thus reflected (schematically represented by arrow 847) is partially reflected from the exposed parts 763, and partially transmitted through the exposed parts 763. Light from the light source 36 which is thus reflected by the exposed parts 763 and light from the light source 36 which is thus transmitted through the exposed parts 763 is configured by the apertures 761 to form one or more images of flames 31. Accordingly, light reflected by the exposed parts 763 (schematically represented by arrow 848) forms one or more images of flames 31 which are transmitted through the first screen 832. Also, light transmitted through the exposed parts 763 (schematically represented by arrow 850) forms one or more images of flames 31 which are transmitted through the second screen 838. A first path of light 855 between the light source 36 and the first screen 832 is schematically represented by arrows 845, 847, and 848. A second path of light 857 between the light source 36 and the second screen 838 is represented by arrows 845, 847, and 850.

In addition, the second flicker element 846 is positioned in a secondary path of light (schematically represented by arrows 886, 887) between the light source 36 and the flame effect element 752. Light from the light source 36 is reflected by the second flicker element 846, and the fluctuating light thus reflected (schematically represented by arrow 887) is directed to the second surface 751 of the flame effect element 752. The fluctuating light (schematically represented by arrow 887) is partially transmitted through the exposed parts 763 and partially reflected by the exposed parts 763.

Light from the light source 36 which is thus transmitted through the exposed parts 763 and light from the light source 36 which is thus reflected from the exposed parts 763 is, to an extent, configured by the apertures 761 to form one or more images of flames 31. Accordingly, light transmitted through the exposed parts 763 (schematically represented by arrow 888) is transmitted through the first screen 832, to produce images of flames 31. Light reflected by the exposed parts 763 (schematically represented by arrow 889) is also transmitted through the second screen 838, to produce images of flames 31. A third path of light 891 between the light source 36 and the first screen 832 is schematically represented by arrows 886, 887, and 888. A fourth path of light 892 between the light source 36 and the second screen 838 is schematically represented by arrows 886, 887, and 889.

However, it will be appreciated that light from the light source 36 which is transmitted along the secondary path of light to the second surface 751 is unlikely to provide relatively well-defined images of flames 31 for transmission through the second screen 838. This is because the second surface 751 is a "back" side of a partially reflective "mirror" formed on the front side 749 of the body portion 753. Therefore, the images of flames 31 resulting from light from the light source 36 being transmitted to the second surface 751 of the body portion 753 for transmission through the second screen 838 are only partially formed by the apertures 761. Light from the light source 36 which is transmitted to the second surface 751 of the body portion 753 tends to be more generally reflected. However, the images of flames 31 resulting from light from the light source 36 being transmitted to the second surface 751 and hence through the apertures 761, for transmission through the first screen 832, are formed thereby into one or more relatively well-defined images of flames 31.

Figure 27C:
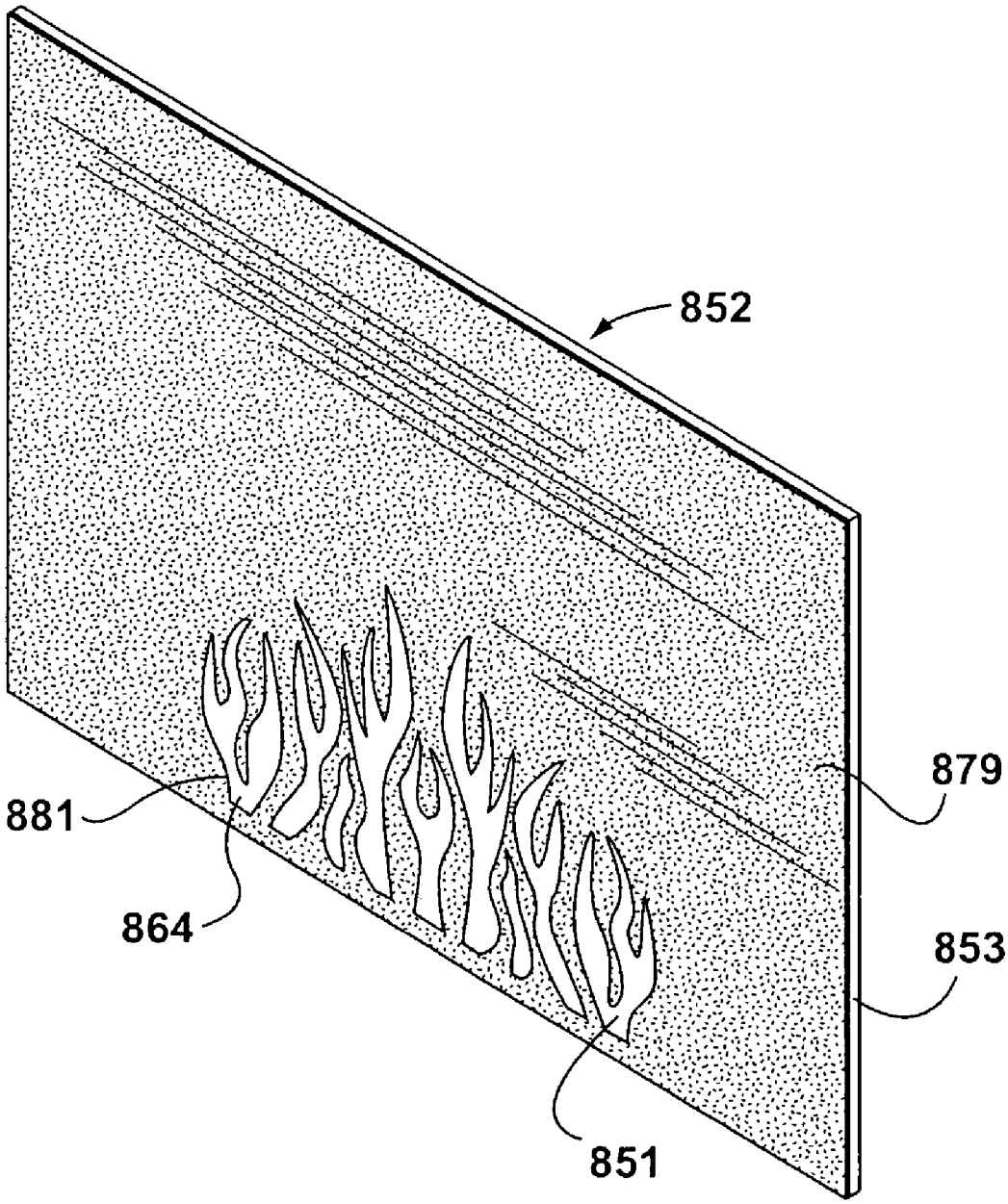
FIG. 27C is an isometric view of another alternative embodiment of the flame effect element showing a second side thereof, drawn at a larger scale.
Figure 27D:
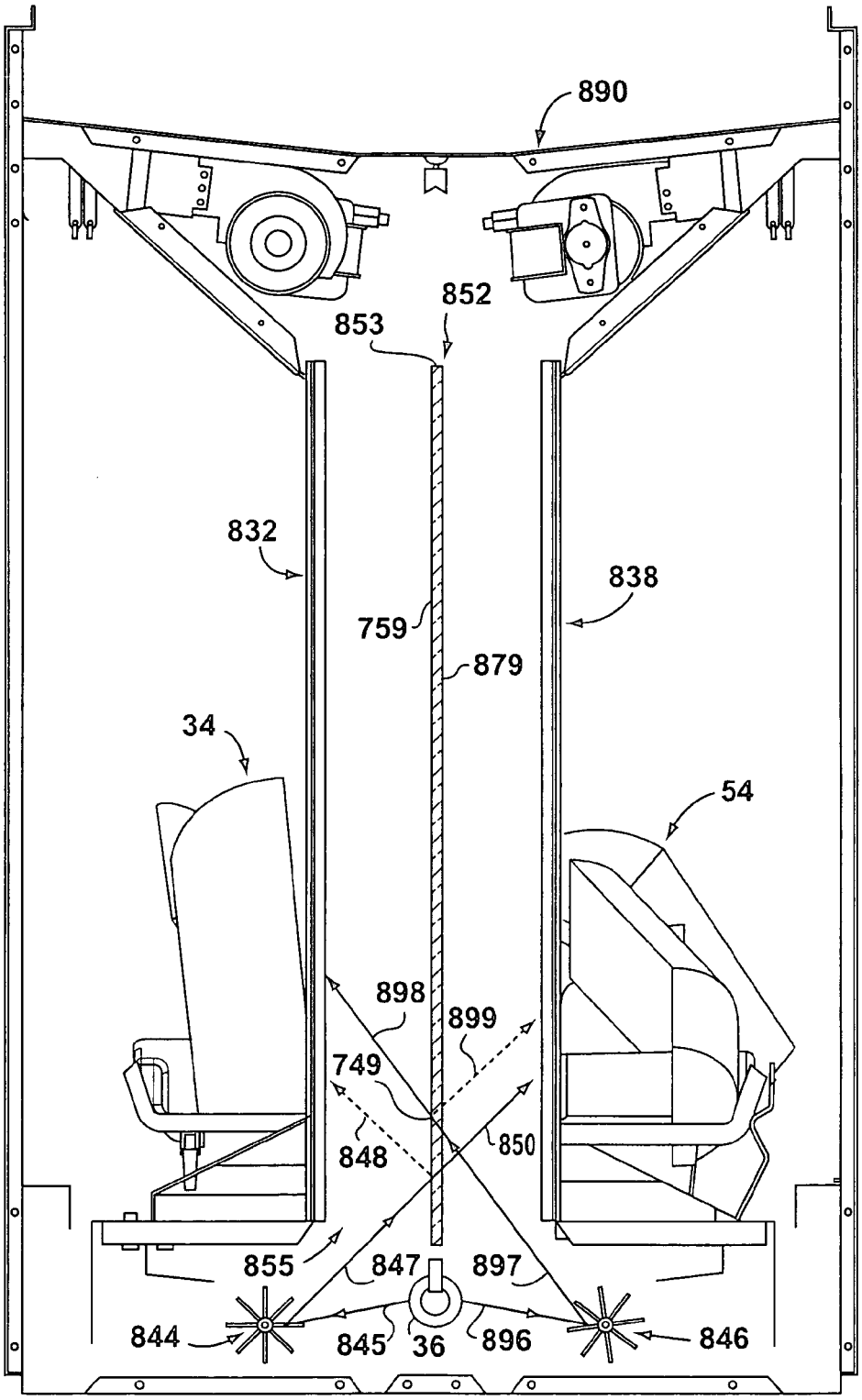
FIG. 27D is a cross section viewed from the side of another alternative embodiment of the flame simulating assembly, drawn at a smaller scale.

In order to provide better-defined images of flames 31 transmitted through the second screen 838, another embodiment 852 of the flame effect element is provided, as shown in FIG. 27C. The flame effect element 852 includes a second mask portion 879 including apertures 881. The second mask portion 879 is positioned on a second surface 851 of a body portion 853 of the flame effect element 852. The body portion 853 also includes the first surface 749 (FIG. 27D) disposed opposite to the second surface 851 (FIG. 27D). Preferably, the first surface 749 is at least partially reflective, as in the flame effect element 752. The first surface 749 is preferably lightly "silvered", so that light is transmittable through the first surface 749 and also reflected from the first surface 749.

As in the flame effect element 752, the first mask portion 759 is positioned on the first surface 749, which faces the first screen 832 (FIG. 27D). Preferably, the second mask portion 879 is a layer of flat black paint, similar to the first mask portion 759. When the second mask portion 879 is created (preferably by spraying suitable paint on the second surface 851), the apertures 881 are preferably formed using a stencil identical to that used in forming the apertures 861. The apertures 881 define exposed parts 864 of the second surface 851. The apertures 881 are aligned with apertures 861 in the first mask portion 859.

Figure 28A:
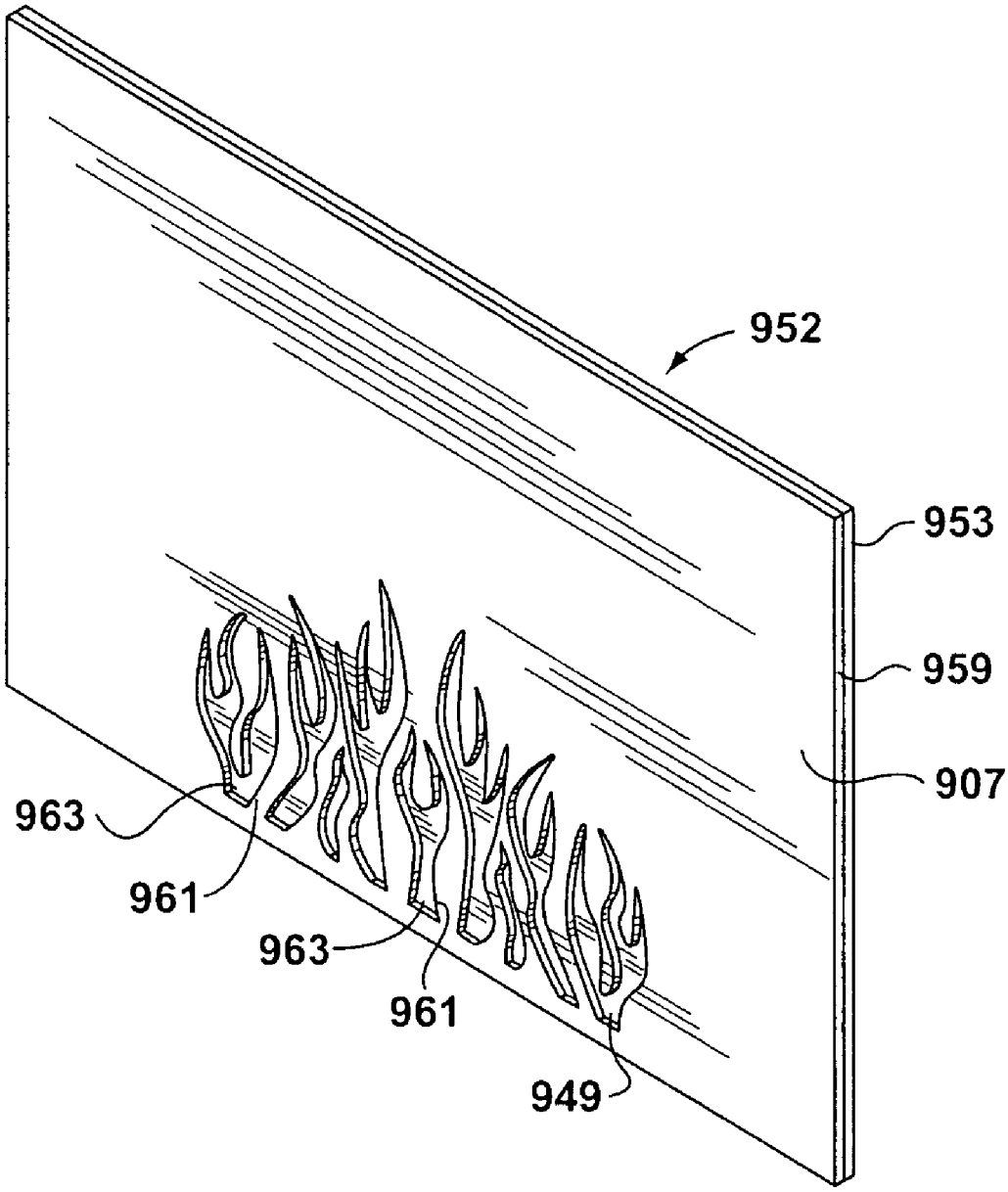
FIG. 28A is an isometric view of another alternative embodiment of the flame effect element, drawn at a larger scale.
Figure 28B:
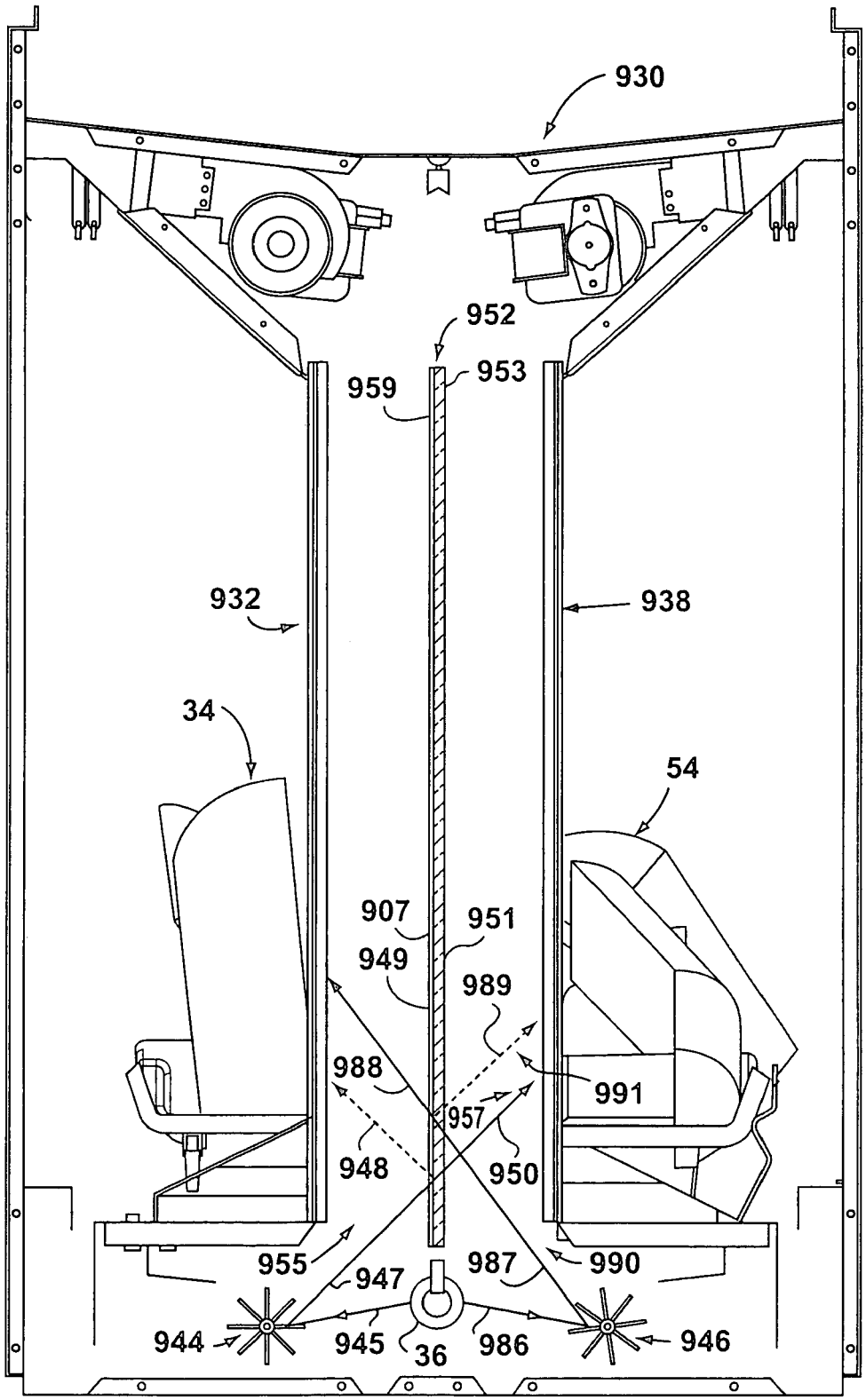
FIG. 28B is a cross section viewed from the side of another alternative embodiment of the flame simulating assembly, drawn at a smaller scale.

As can be seen in FIG. 27D, another alternative embodiment of a flame simulating assembly 890 of the invention includes the flame effect element 852, but is otherwise the same as the flame simulating assembly 830 shown in FIG. 28B. The first flicker element 844 is positioned in a primary path of light (represented by arrows 845, 847) between the light source 36 and the flame effect element 852. Light from the light source 36 is reflected by the first flicker element 844, and the fluctuating light thus reflected (schematically represented by arrow 847) is partially reflected from one or more exposed parts 763 of the first surface 749, exposed by the apertures 761 (FIG. 27A), and partially transmitted through the exposed parts 763. Light from the light source 36 which is thus reflected from the exposed parts 763 and light from the light source 36 which is thus transmitted through the exposed parts 763 is configured by the apertures 761 to form one or more images of flames 31.

Accordingly, light reflected by the exposed parts 763 (schematically represented by arrow 848) forms one or more images of flames 31 which are transmitted through the first screen 832. Also, light transmitted through the exposed parts 763 (schematically represented by arrow 850) forms one or more images of flames 31 which are transmitted through the second screen 838 (FIG. 27D).

In addition, the second flicker element 846 is positioned in a secondary path of light (schematically represented by arrows 896, 897) between the light source 36 and the flame effect element 852. Light from the light source 36 is reflected by the second flicker element 846, and the fluctuating light thus reflected (schematically represented by arrow 897) is directed to the exposed parts 864 of the second side 851 of the flame effect element 852. The fluctuating light (schematically represented by arrow 897) is transmitted through the exposed parts 864 and partially transmitted through the exposed parts 763, and also is partially reflected by the exposed parts 763.

Light from the light source 36 which is thus transmitted through the exposed parts 763, and light from the light source 36 which is thus reflected from the exposed parts 763 is configured by the apertures 861 to form one or more images of flames 31. Accordingly, light transmitted through the exposed parts 763 (schematically represented by arrow 898) is formed into images of flames which are transmitted through the first screen 832. Also, light reflected by the exposed parts 763 (schematically represented by arrow 899) is formed into images of flames which are transmitted through the second screen 838.

It will be appreciated by those skilled in the art that the images of flames 31 transmitted through the second screen 838 in the flame simulating assembly 890 and resulting from the secondary path of light are shaped by the apertures 881. Accordingly, the images of flames 31 resulting are better defined than those resulting from light transmitted along the secondary path of light from the light source 36 in flame simulating assembly 830.

The flicker elements 844, 846 are preferably moved by operatively connected respective electric motors (not shown). Also, such electric motors are preferably separately controlled, to provide various flame images, of varying intensity and flickering at varying speeds. Because images of flames 31 are transmitted through both the first and the second screens 832, 838 which result from fluctuating light created by the first flicker element 844 and the second flicker element 846, the potential exists for creation of some relatively unusual effects in the images of flames 31 provided by the flame simulating assembly 830.

In yet another alternative embodiment 930 of the flame simulating assembly of the invention, a flame effect element 952 has a body portion 953 and an alternative non-reflective, or mask, portion 959 (FIG. 28A) positioned on a first surface 949. Preferably, the flame effect element 952 is positioned between a first screen 932 and a second screen 938 (FIG. 28B). The body portion 953 is at least partially translucent, and includes the first surface 949 which preferably is at least partially reflective. The first surface 949 faces the first screen 932 and a second surface 951 faces the second screen 938. The mask portion 959 preferably comprises a piece of sheet metal (or other suitable material) including one or more apertures 961 cut, stamped out of the piece, or formed in any other suitable manner. The sheet metal element 959 has an outside surface 907 which preferably is colored black, with a substantially non-reflective finish. The apertures 961 define one or more exposed parts 963 of the first surface 949. Because each aperture 961 is substantially flame-shaped, each exposed part 963 is also substantially flame-shaped. The apertures 961 are shaped specifically to configure the light to produce images of flames 31, as will be described.

As can be seen in FIG. 28B, the first flicker element 944 is positioned in a primary path of light (schematically represented by arrows 945, 947) between the light source 36 and the flame effect element 952. Light from the light source 36 is reflected by the first flicker element 944, and the fluctuating light thus reflected (schematically represented by arrow 947) is partially reflected from the exposed parts 963, and partially transmitted through the exposed parts 963.

Light reflected by the exposed parts 963 (schematically represented by arrow 948) is transmitted through the first screen 932 to produce one or more images of flames 31. Light transmitted through the exposed parts 963 (schematically represented by arrow 950) is transmitted through the second screen 938 to produce one or more images of flames 31. Light from the light source 36 which is thus reflected by the exposed parts 963 and light from the light source 36 which is thus transmitted through the exposed parts 963 is configured by the apertures 961 to form one or more images of flames 31 transmitted through the screens 932, 938. A first path of light 955 between the light source 36 and the first screen 932 is schematically represented by arrows 945, 947, and 948. A second path of light 957 between the light source 36 to the second screen 938 is represented by arrows 945, 947, and 950.

In addition, the second flicker element 946 is positioned in a secondary path of light (schematically represented by arrows 986, 987) between the light source 36 and the flame effect element 952. Light from the light source 36 is reflected by the second flicker element 946, and the fluctuating light thus reflected (schematically represented by arrow 987) partially transmitted through the exposed parts 963, and partially reflected by the exposed parts 963.

Light from the light source 36 which is thus transmitted through the exposed parts 963 and light from the light source 36 which is thus reflected from the exposed parts 963 is configured by the apertures 961 to form one or more images of flames 31. Accordingly, light transmitted through the exposed parts 963 (schematically represented by arrow 988) is transmitted through the first screen 932, to produce images of flames 31. Light reflected by the exposed parts 963 (schematically represented by arrow 989) is also transmitted through the second screen 938, to produce images of flames 31. A third path of light 992 between the light source 36 and the first screen 932 is schematically represented by arrows 986, 987, and 988. A fourth path of light 993 between the light source 36 and the second screen 938, is schematically represented by arrows 986, 987, and 989.

It will be appreciated that light from the light source 36 which is transmitted along the secondary path of light to the second surface 951 (of the body portion 953) in the flame simulating assembly 930 is unlikely to provide relatively well-defined images of flames 31 for transmission through the second screen 838. (This is also as described above in connection with the flame simulating assembly 830.) This is because the second surface 951 is a "back" side of a partially reflective "mirror" formed on the front side 949 of the body portion 953, as described. Therefore, the images of flames resulting from light from the light source 36 being transmitted to the second surface 951 of the body portion 953 for transmission through the second screen 938 are only partially formed by the apertures 961. Light from the light source 36 which is transmitted along the secondary path to the second surface 951 of the body portion 953 tends to be more generally reflected.

The flicker elements 944, 946 are preferably moved by operatively connected respective electric motors (not shown). Also, such electric motors are preferably separately controlled, to provide various flame images, of varying intensity and flickering at varying speeds. Because images of flames 31 are transmitted through both the first and the second screens 932, 938 which result from fluctuating light created by the first flicker element 944 and the second flicker element 946, the potential exists for creation of some relatively unusual effects in the images of flames provided by the flame simulating assembly 930.

Figure 28C:
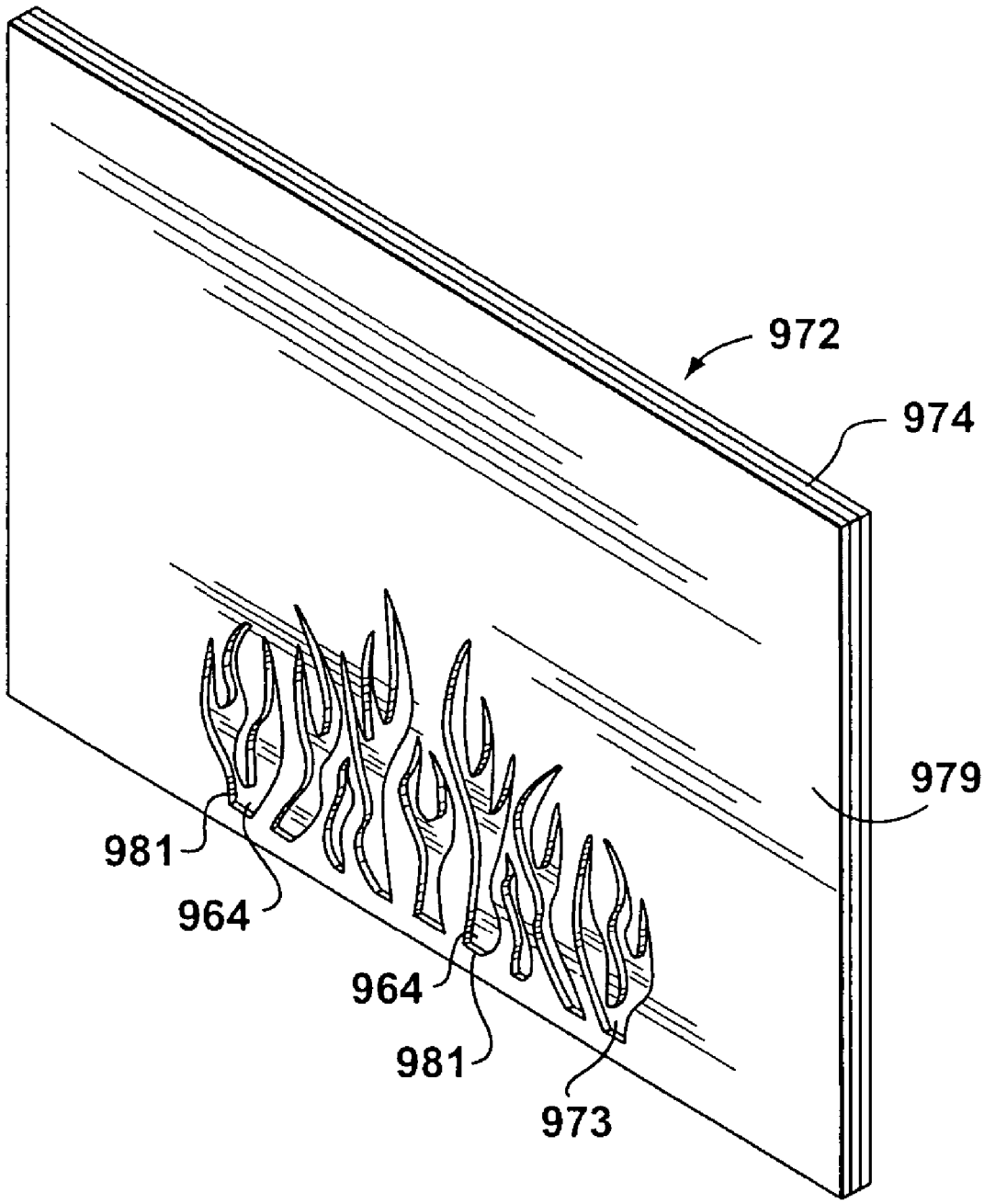
FIG. 28C is an isometric view of another alternative embodiment of the flame effect element showing a second side thereof, drawn at a larger scale.

In order to provide better-defined images of flames transmitted through the second screen 938, another embodiment 972 of the flame effect element is provided, as shown in FIG. 28C. The flame effect element 972 includes a second mask portion 979 including apertures 981. The second mask portion 979 is positioned on a second surface 973 of a body portion 974 of the flame effect element 972. The body portion 974 also includes the first surface 949 (FIG. 28D) disposed opposite to the second surface 973. Preferably, the first surface 949 is at least partially reflective, as in the flame effect element 952. The first surface 949 is preferably lightly silvered, so that light is transmittable through the first surface 949 and also reflected from the first surface 949.

Figure 28D:
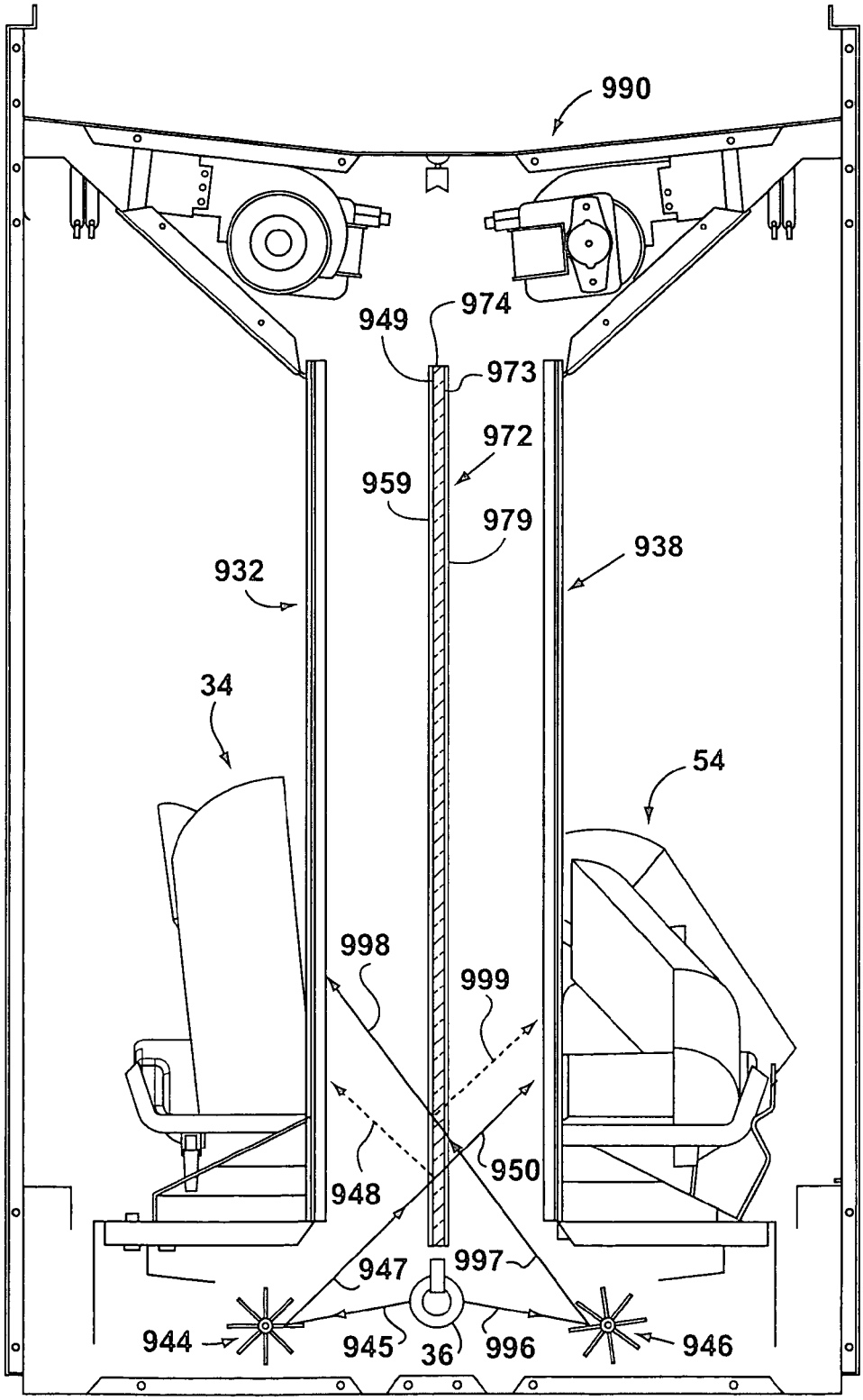
FIG. 28D is a cross section viewed from the side of another alternative embodiment of the flame simulating assembly, drawn at a smaller scale.

As in the flame effect element 952, the first mask portion 959 is positioned on the first surface 949, which faces the first screen 932 (FIG. 28D). Preferably, the second mask portion 979 is a sheet metal element, similar to the first mask portion 959. The second mask portion 979 includes apertures 981 which (when the first mask portion 959 and the second mask portion 979 are in position on opposite sides of the body portion 974) are aligned with the apertures 961 (FIG. 28A) in the first mask portion 959. The apertures 981 define exposed parts 964 of the second surface 973. The apertures 981 are flame-shaped.

As can be seen in FIG. 28D, another alternative embodiment of a flame simulating assembly 990 of the invention includes the flame effect element 972, but is otherwise the same as the flame simulating assembly 930 shown in FIG. 27B. The first flicker element 944 is positioned in a primary path of light (represented by arrows 945, 947) between the light source 36 and the flame effect element 972. Light from the light source 36 is reflected by the first flicker element 944, and the fluctuating light thus reflected (schematically represented by arrow 947) is partially reflected from one or more exposed parts 963 of the first surface 949, exposed by the apertures 961 (FIG. 28A), and partially transmitted through the exposed parts 963. Light from the light source 36 which is thus reflected from the exposed parts 963 and light from the light source 36 which is thus transmitted through the exposed parts 963 is configured by the apertures 961 to form one or more images of flames 31.

Accordingly, light reflected by the exposed parts 963 (schematically represented by arrow 948) forms one or more images of flames which are transmitted through the first screen 932. Also, light transmitted through the exposed parts 963 (schematically represented by arrow 950) forms one or more images of flames which are transmitted through the second screen 938.

In addition, the second flicker element 946 is positioned in a secondary path of light (schematically represented by arrows 996, 997) between the light source 36 and the flame effect element 972. Light from the light source 36 is reflected by the second flicker element 946, and the fluctuating light thus reflected (schematically represented by arrow 997) is directed to the exposed parts 964 of the second side 973 of the flame effect element 972. The fluctuating light (schematically represented by arrow 997) is transmitted through the exposed parts 964 and partially transmitted through the exposed parts 963, and also is partially reflected by the exposed parts 963.

Light from the light source 36 which is thus transmitted through the exposed parts 963, and light from the light source 36 which is thus reflected from the exposed parts 963 is configured by the apertures 961 to form one or more images of flames 31. Accordingly, light transmitted through the exposed parts 963 (schematically represented by arrow 998) is formed into images of flames which are transmitted through the first screen 932. Also, light reflected by the exposed parts 963 (schematically represented by arrow 999) is formed into images of flames which are transmitted through the second screen 938.

It will be appreciated by those skilled in the art that the images of flames 31 transmitted through the second screen 938 in the flame simulating assembly 990 and resulting from the secondary path of light are configured by the apertures 981. Accordingly, the images of flames resulting are better defined than those resulting from light transmitted along the secondary path of light from the light source 36 in flame simulating assembly 930 (FIG. 27B).

Figure 29A:
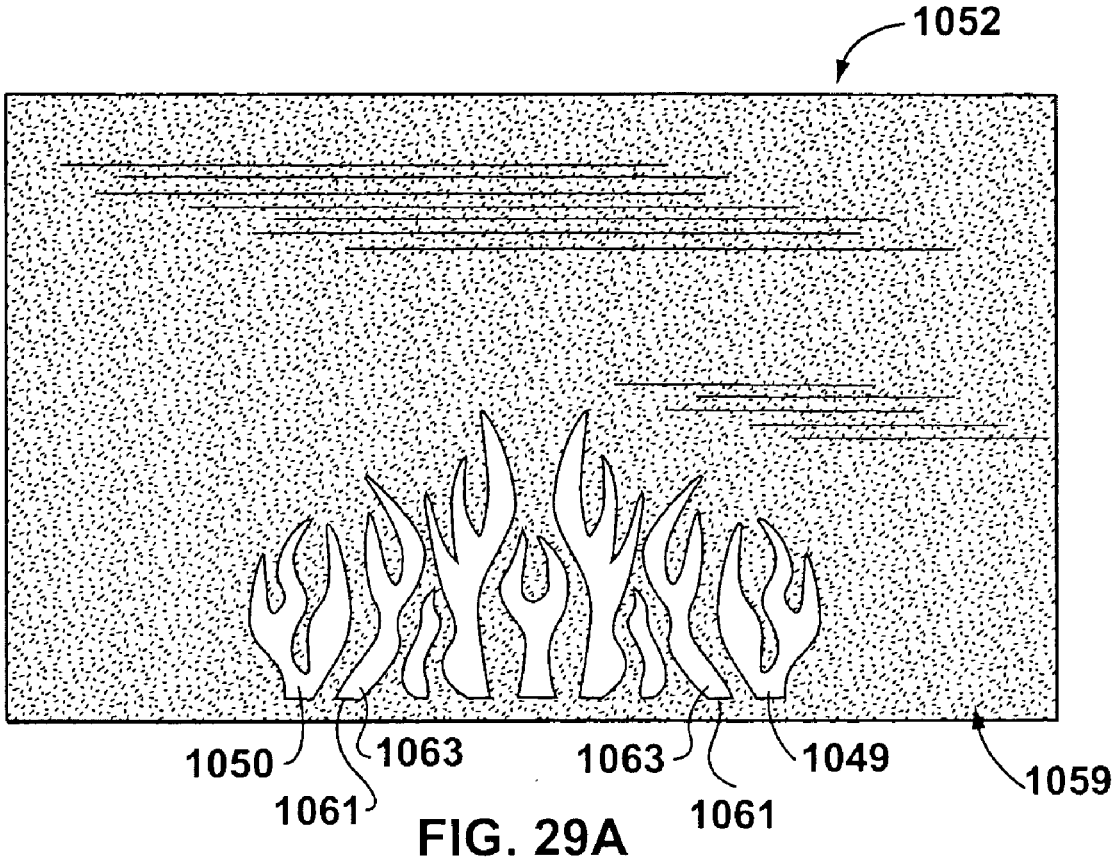
FIG. 29A is an elevation view of a first side of another alternative embodiment of the flame effect element, drawn at a larger scale.
Figure 29B:
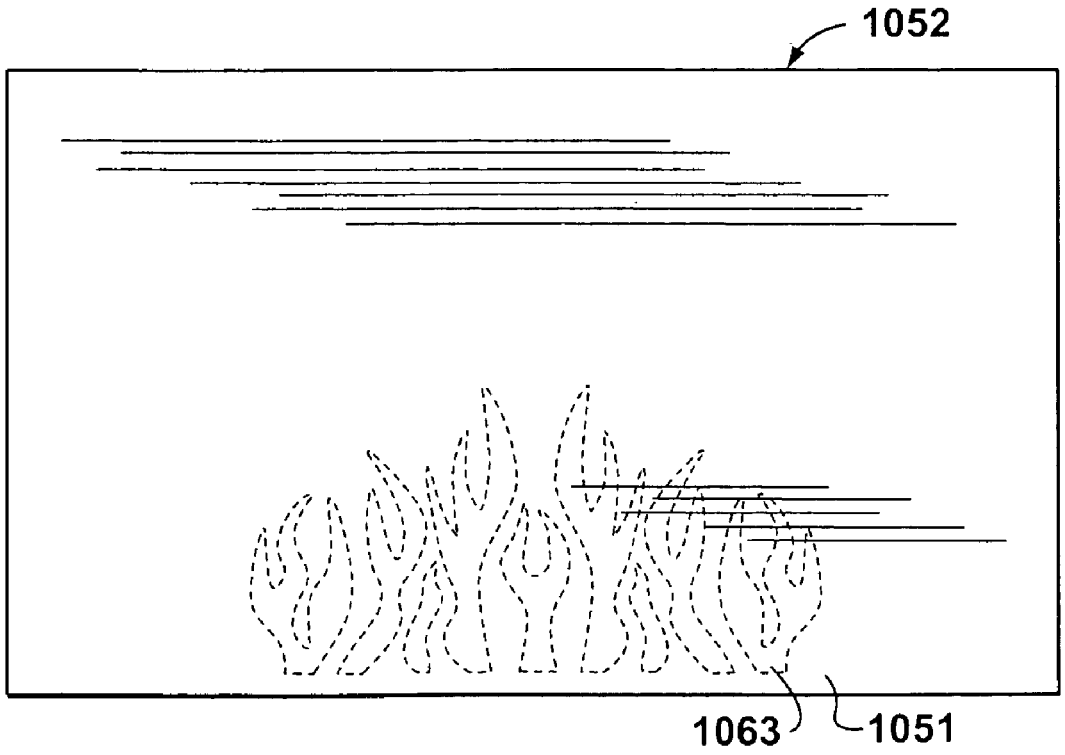
FIG. 29B is an elevation view of a second side of another alternative embodiment of the flame effect element.
Figure 30A:
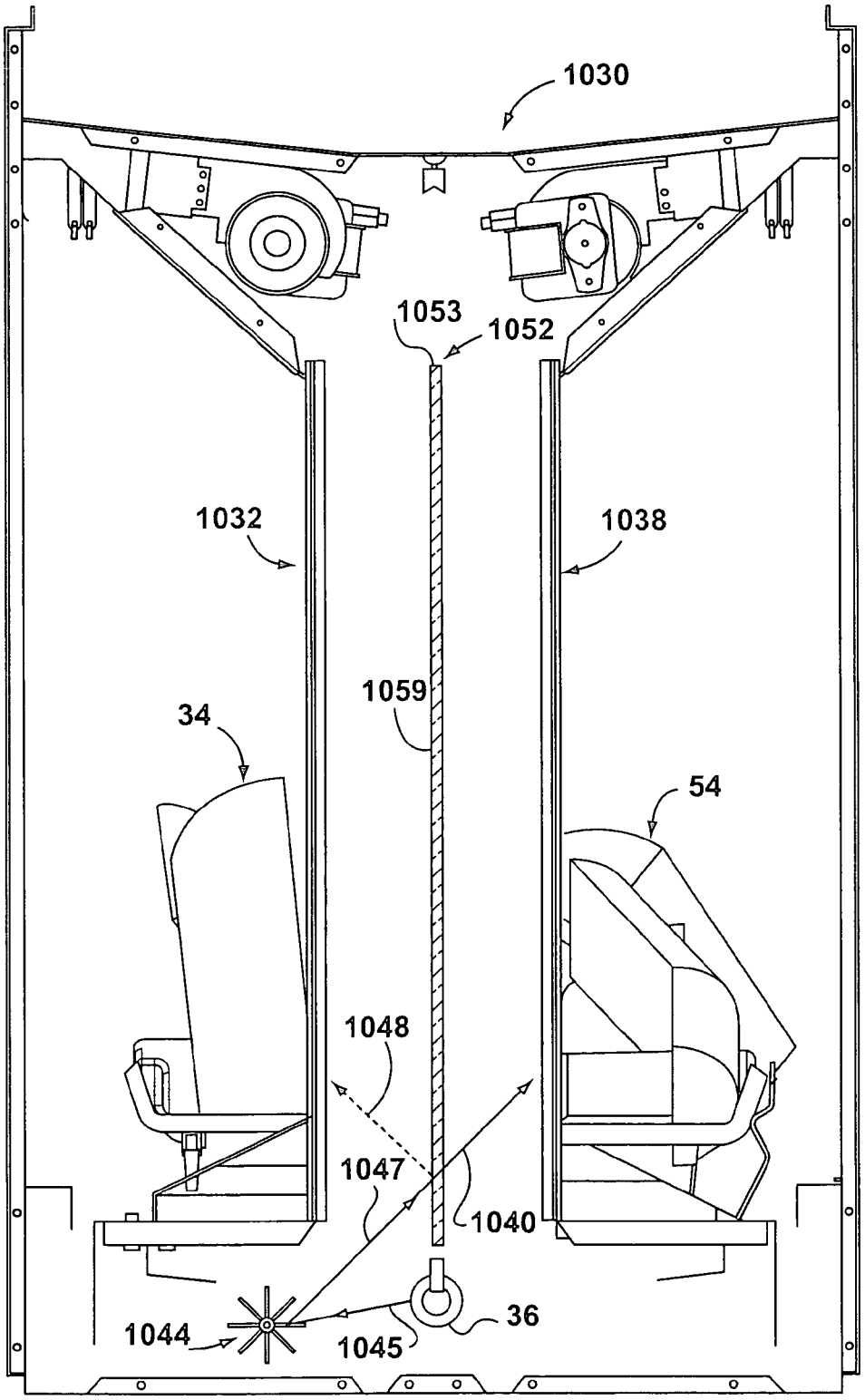
FIG. 30A is a cross section viewed from the side of another alternative embodiment of the flame simulating assembly, drawn at a smaller scale.

Another embodiment 1052 of the flame effect element is provided, as shown in FIGS. 29A and 29B. The flame effect element 1052 includes a body portion 1053 (FIG. 30A) with a first surface 1049 and a second surface 1051, the surfaces 1049, 1051 facing the first screen 1032 and the second screen 1038 respectively, as will be described (FIG. 30A). Preferably, the body portion 1053 is transparent or translucent glass or plastic or any other suitable material. As can be seen in FIGS. 29A and 29B, the flame effect element 1052 preferably includes a flame configuration portion 1050 comprising a plurality of semi-silvered, flame-shaped areas positioned on the first surface 1049. The flame effect element 1052 also includes a first mask portion 1059 having apertures 1061 configured to conform to the flame configuration portion 1050. As can be seen in FIG. 29A, the flame configuration portion 1050 includes a number of flame-shaped exposed parts 1063 of the first surface 1049. Preferably, the first mask portion 1059 is a layer of flat black paint or any other suitable material.

As can be seen in FIG. 29B, the exposed parts 1063 of the flame configuration portion 1050 are viewable through the second surface 1051. Preferably, the flame configuration portion 1050 is semi-silvered on both of its sides, i.e., on the side thereof which is in contact with the first surface 1049, and also on the side thereof which is opposite thereto. Accordingly, the exposed parts 1063 are reflective on both sides thereof.

The flame-shaped configuration portion 1050 could be cut out of silvered film. Alternatively, the flame-shaped configuration portion 1050 could be sprayed onto the front surface 1049, shaped using a stencil (not shown).

As shown in FIG. 30A, another alternative embodiment of a flame simulating assembly 1030 includes the flame effect element 1052. A first flicker element 1044 is positioned in a primary path of light (represented by arrows 1045, 1047) between the light source 36 and the flame effect element 1052. Light from the light source 36 is reflected by the first flicker element 1044, and the fluctuating light thus reflected (schematically represented by arrow 1047) is partially reflected from one or more parts 1063 of the flame configuration portion 1050, and partially transmitted through the parts 1063. Light from the light source 36 which is thus reflected from the parts 1063 and light from the light source 36 which is thus transmitted through the parts 1063 is configured by the apertures 1061 to form one or more images of flames 31.

Accordingly, light reflected by the parts 1063 (schematically represented by arrow 1048) forms one or more images of flames 31 which are transmitted through the first screen 1032. Also, light transmitted through the parts 1063 (schematically represented by arrow 1040) forms one or more images of flames 31 which are transmitted through the second screen 1038.

Figure 30B:
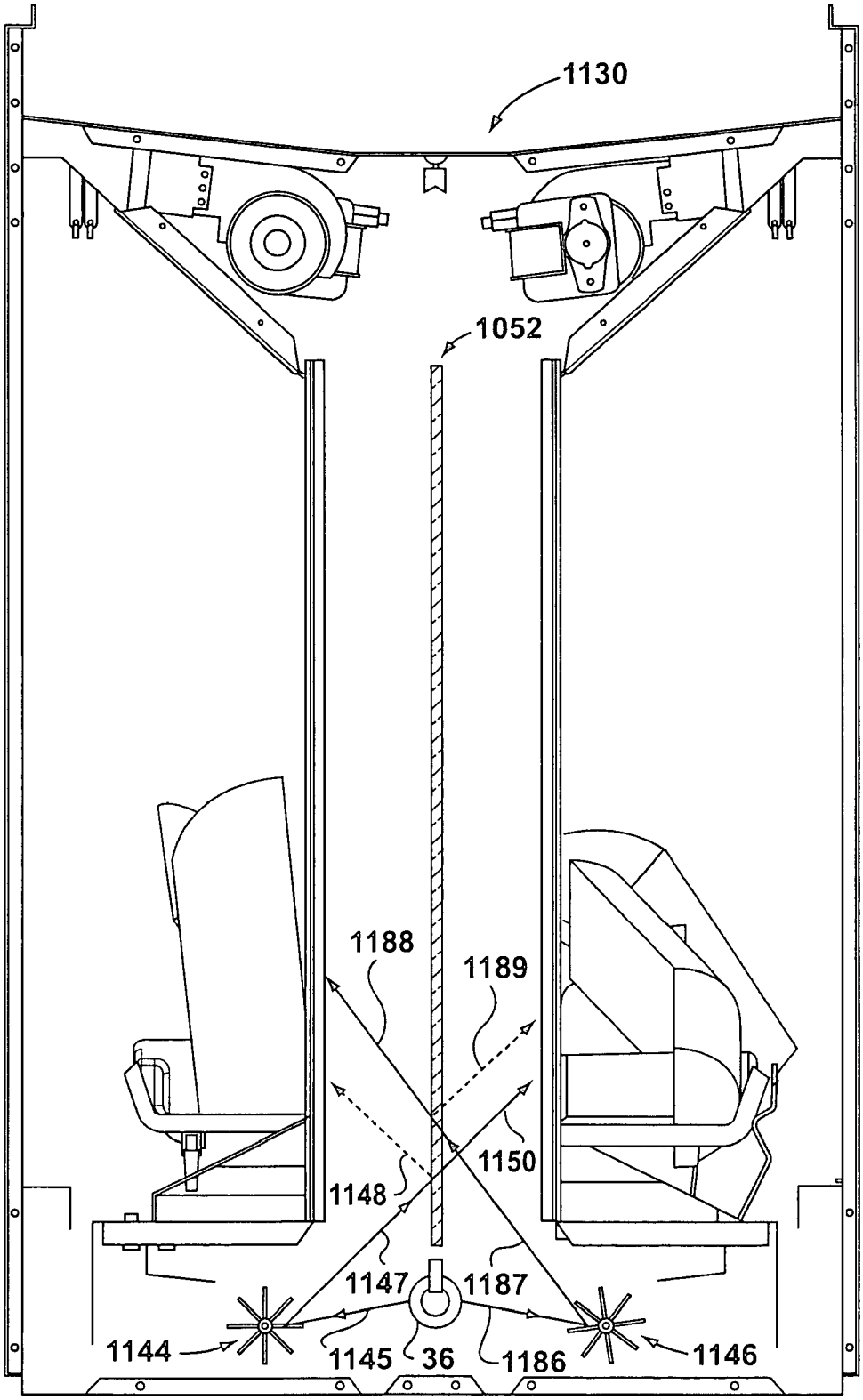
FIG. 30B is a cross section viewed from the side of another alternative embodiment of the flame simulating assembly.

As can be seen in FIG. 30B, another alternative embodiment of a flame simulating assembly 1130 includes the flame effect element 1052, a first flicker element 1144, and a second flicker element 1146. The first flicker element 1144 is positioned in a primary path of light (schematically represented by arrows 1145, 1147) between the light source 36 and the flame effect element 1052 (FIG. 30B). Light from the light source 36 is reflected by the first flicker element 1144, and the fluctuating light thus reflected (schematically represented by arrow 1147) is partially reflected from the exposed parts 1063, and partially transmitted through the exposed parts 1063. Light from the light source 36 which is thus reflected by the exposed parts 1063 and light from the light source 36 which is thus transmitted through the exposed parts 1063 is configured by the apertures 1061 to form one or more images of flames 31. Accordingly, light reflected by the exposed parts 1063 (schematically represented by arrow 1148) forms one or more images of flames 31 which are transmitted through the first screen 1132. Also, light transmitted through the exposed parts 1063 (schematically represented by arrow 1150) forms one or more images of flames 31 which are transmitted through the second screen 1138. A first path of light 1155 between the light source 36 and the first screen 1132 is schematically represented by arrows 1145, 1147, and 1148. A second path of light 1157 between the light source 36 and the second screen 1138 is represented by arrows 1145, 1147, and 1150.

In addition, the second flicker element 1146 is positioned in a secondary path of light (schematically represented by arrows 1186, 1187) between the light source 36 and the flame effect element 1052. Light from the light source 36 is reflected by the second flicker element 1146, and the fluctuating light thus reflected (schematically represented by arrow 1187) is directed to the second surface 1051 of the flame effect element 1052. The fluctuating light (schematically represented by arrow 1187) is partially transmitted through the exposed parts 1063 and partially reflected by the exposed parts 1063.

Light from the light source 36 which is thus transmitted through the exposed parts 1063 is configured by the apertures 1061 to form one or more images of flames 31. Light from the light source 36 which is thus reflected from the exposed parts 1063 is configured by the parts 1063 viewable through the second surface 1051 of the body portion 1053. The images of flames resulting are well-defined because the parts 1063 are flame-shaped.

Accordingly, light transmitted through the parts 1063 (schematically represented by arrow 1188) is transmitted through the first screen 1132, to produce images of flames 31. Light reflected by the parts 1063 (schematically represented by arrow 1189) is also transmitted through the second screen 1138, to produce images of flames 31.

Figure 30C:
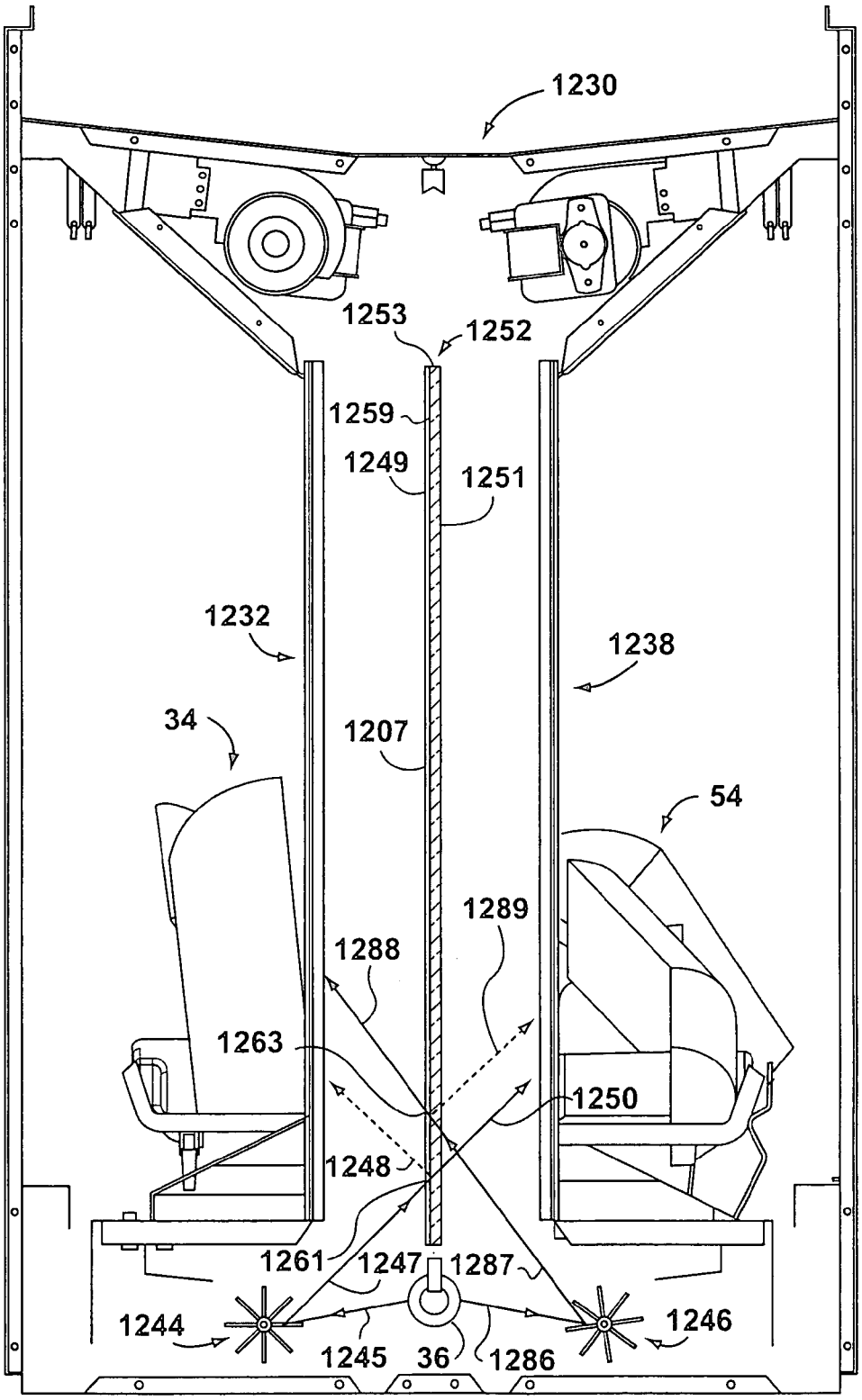
FIG. 30C is a cross section viewed from the side of another alternative embodiment of the flame simulating assembly.

In another alternative embodiment, a flame effect element 1252 includes a first mask portion 1259 which is preferably made of sheet metal (FIG. 30C). The mask portion 1259 could alternatively be made of plastic or any other suitable material. The mask portion 1259 includes one or more apertures 1261 cut, stamped out of the piece, or formed in any other suitable manner. Also, the sheet metal mask element 1259 has an outside surface 1207 which is preferably colored black, with a substantially non-reflective finish. The flame element 1252 also includes a body portion 1253, with a first surface 1249 and a second surface 1251. The apertures 1261 define one or more exposed parts 1263 of the first surface 1249 of the body portion 1253. Because each aperture 1261 is substantially flame-shaped, each exposed part 1263 is also substantially flame-shaped.

As can be seen in FIG. 30C, another alternative embodiment of a flame simulating assembly 1230 includes the flame effect element 1252, a first flicker element 1244, and a second flicker element 1246. The first flicker element 1244 is positioned in a primary path of light (schematically represented by arrows 1245, 1247) between the light source 36 and the flame effect element 1252. Light from the light source 36 is reflected by the first flicker element 1244, and the fluctuating light thus reflected (schematically represented by arrow 1247) is partially reflected from the exposed parts 1263, and partially transmitted through exposed parts 1263. Light from the light source 36 which is thus reflected by the exposed parts 1263 and light from the light source 36 which is thus transmitted through the exposed parts 1263 is configured by the apertures 1261 to form one or more images of flames 31. Accordingly, light reflected by the exposed parts 1263 (schematically represented by arrow 1248) forms one or more images of flames 31 which are transmitted through the first screen 1232. Also, light transmitted through the exposed parts 1263 (schematically represented by arrow 1250) forms one or more images of flames 31 which are transmitted through the second screen 1238.

In addition, the second flicker element is positioned in a secondary path of light (schematically represented by arrows 1286, 1287) between the light source 36 and the flame effect element 1252. Light from the light source 36 is reflected by the second flicker element 1246, and the fluctuating light thus reflected (schematically represented by arrow 1287) is directed to the second surface 1251 of the flame effect element 1252. The fluctuating light (schematically represented by arrow 1287) is partially transmitted through the exposed parts 1263 and partially reflected by the exposed parts 1263.

Light from the light source 36 which is thus transmitted through the exposed parts 1263 is configured by the apertures 1261 to form one or more images of flames 31. Light from the light source 36 which is thus reflected from the exposed parts 1263 is configured by the parts 1263 viewable through the second surface 1251 of the body portion 1253. The images of flames resulting are well-defined because the parts 1263 are flame-shaped.

Accordingly, light transmitted through the exposed parts 1263 (schematically represented by arrow 1288) is transmitted through the first screen 1232, to produce images of flames 31. Light reflected by the exposed parts 1263 (schematically represented by arrow 1289) is also transmitted through the second screen 1238, to produce images of flames 31.

It will be evident to those skilled in the art that the invention can take many forms, and that such forms are within the scope of the invention as claimed. Therefore, the spirit and scope of the appended claims should not be limited to the description of the preferred versions contained herein.

We claim:

1. A flame simulating assembly for providing at least one image of flames, the flame simulating assembly comprising:

at least one light source;

at least one flame effect element for configuring light from said at least one light source to produce said at least one image of flames;

a first screen positioned in a first path of light from said at least one light source, the first screen being adapted to receive light from said at least one light source to form said at least one image of flames transmittable through the first screen;

a second screen positioned in a second path of light from said at least one light source, the second screen being adapted to receive light from said at least one light source to form said at least one image of flames transmittable through the second screen;

the first screen and the second screen at least partially defining substantially vertical planes respectively; and said at least one light source being positioned substantially between said planes.

2. A flame simulating assembly according to claim 1, wherein said at least one flame effect element is positioned in said first path of light and said second path of light.

3. A flame simulating assembly according to claim 1, wherein said at least one flame effect element is positioned in said first path of light between said at least one light source and the first screen and in said second path of light between said at least one light source and the second screen.

4. A flame simulating assembly according to claim 3 in which the first screen and the second screen are positioned on opposite sides of said at least one flame effect element.

5. A flame simulating assembly according to claim 3 in which said at least one flame effect element includes a body portion which is at least partially translucent.

6. A flame simulating assembly according to claim 5 in which the body portion is positioned substantially between the first screen and the second screen, the body portion including a first surface facing said first screen and a second surface facing said second screen.

7. A flame simulating assembly according to claim 6 in which at least one of said first surface and said second surface of the body portion is at least partially reflective.

8. A flame simulating assembly according to claim 7 in which:

the first surface of the body portion is at least partially reflective;

the flame effect element includes a substantially non-reflective portion disposed on the first surface;

the non-reflective portion including at least one aperture positioned in said first path of light and in said second path of light, said at least one aperture being formed such that said at least one aperture configures light from said at least one light source to form said at least one image of flames; and said at least one image of flames being transmitted through the first screen and the second screen respectively.

9. A flame simulating assembly according to claim 8 in which said at least one aperture defines at least one exposed part of the first surface of the body portion, such that light from said at least one light source is substantially reflected by said at least one exposed part of the first surface to the first screen, to form said at least one image of flames transmittable therethrough.

10. A flame simulating assembly according to claim 8 in which said at least one aperture defines at least one exposed part of the first surface of the body portion, such that light from said at least one light source is substantially transmitted through said at least one exposed part of the first surface of the body portion to the second screen, to form said at least one image of flames transmittable therethrough.

11. A flame simulating assembly according to claim 8 in which the substantially non-reflective portion includes an outside surface facing the first screen, the outside surface having a matte finish.

12. A flame simulating assembly according to claim 8 in which the non-reflective portion comprises a layer of substantially non-reflective black paint.

13. A flame simulating assembly according to claim 8 in which the non-reflective portion comprises a sheet metal element with an outside surface facing the first screen, the outside surface being coloured black, with a substantially non-reflective finish.

14. A flame simulating assembly according to claim 8 additionally including at least one flicker element for creating a fluctuating light, said at least one flicker element being positioned in at least one path of light selected from the group consisting of the first path of light and the second path of light, said at least one path of light extending from said at least one light source through said at least one flame effect element to at least one screen selected from the group consisting of the first screen and the second screen, whereby the fluctuating light forms said at least one image of flames transmittable through said at least one screen.

15. A flame simulating assembly according to claim 8 additionally including:

a first flicker element for creating fluctuating light, the first flicker element being positioned in a primary path of light between said at least one light source and the flame effect element, said fluctuating light forming said at least one image of flames transmitted through the first screen and the second screen respectively; and a second flicker element for creating fluctuating light, the second flicker element being positioned in a secondary path of light between said at least one light source and the flame effect element, said fluctuating light forming said at least one image of flames transmitted through the first screen and the second screen respectively.

16. A flame simulating assembly according to claim 1 additionally comprising:

a first flicker element for causing light from said at least one light source to fluctuate, for producing a first image of flames transmitted through the first screen, the first flicker element being positioned in said first path of light between said at least one light source and the first screen; and a second flicker element for causing light from said at least one light source to fluctuate, for producing a second image of flames transmitted through the second screen, the second flicker element being positioned in said second path of light between said at least one light source and the second screen.

17. A flame simulating assembly according to claim 16 additionally comprising at least one flame effect element for configuring the fluctuating light to simulate flames, said at least one flame effect element being positioned in the first and second paths of light to form the first and the second images of flames transmittable through the first screen and the second screen respectively.

18. A flame simulating assembly according to claim 1 additionally comprising a first simulated fuel bed and a second simulated fuel bed positioned adjacent to the first screen and the second screen respectively such that the first image of flames and the second image of flames transmitted through the first and second screens respectively are positioned proximal to the first simulated fuel bed and the second simulated fuel bed respectively.

19. A flame simulating assembly for providing at least one image of flames, the flame simulating assembly comprising:

a first simulated fuel bed;

a second simulated fuel bed;

at least one light source;

a first screen comprising a first front surface and positioned behind the first simulated fuel bed in a first path of light from said at least one light source for transmitting said at least one image of flames through the first front surface proximal to the first simulated fuel bed; and a second screen comprising a second front surface and positioned behind the second simulated fuel bed in a second path of light from said at least one light source for transmitting said at least one image of flames through the second front surface proximal to the second simulated fuel bed.

20. A flame simulating assembly according to claim 19 additionally comprising at least one flicker element for creating a fluctuating light, said at least one flicker element being positioned in at least one path of light selected from the group consisting of said first path of light and said second path of light, whereby the fluctuating light forms said at least one image of flames transmittable through the first and the second front surfaces respectively.

21. A flame simulating assembly according to claim 20 additionally comprising at least one flame effect element for configuring light from said at least one light source to produce said at least one image of flames, said at least one flame effect element being positioned in said first path of light between said at least one light source and the first screen and in said second path of light between said at least one light source and the second screen.

22. A flame simulating assembly according to claim 19 additionally comprising:

a first flicker element for causing light from said at least one light source to fluctuate, for producing a first image of flames transmitted through the first front surface, the first flicker element being positioned in said first path of light between said at least one light source and the first screen; and a second flicker element for causing light from said at least one light source to fluctuate, for producing a second image of flames transmitted through the second front surface, the second flicker element being positioned in said second path of light between said at least one light source and the second screen.

23. A flame simulating assembly according to claim 22 additionally comprising at least one flame effect element for configuring the fluctuating light to simulate flames, said at least one flame effect element being positioned in the first and second paths of light to form the first and the second images of flames transmittable through the first front surface and the second front surface respectively.

24. A flame simulating assembly according to claim 23 in which said at least one flame effect element includes:

at least one opening positioned in said second path of light to permit light from said at least one light source to pass through said at least one opening to said second screen; and at least one reflective region positioned in said first path of light for reflecting light from said at least one light source to said first screen.

25. A flame simulating assembly according to claim 23 in which said at least one flame effect element comprises at least one opening for configuring light from the light source to simulate flames.

26. A flame simulating assembly according to claim 23 in which said at least one flame effect element includes a first side facing the first screen and a second side facing the second screen, the second side and the first side being disposed opposite to each other, and in which each of the first and second sides includes a reflective portion for reflecting light from said at least one light source to the first screen and the second screen respectively to produce said first and second images of flames respectively.

27. A flame simulating assembly according to claim 19 in which at least one of said screens comprises a pattern on the front surface thereof for simulating a firebrick wall positioned adjacent to said at least one image of flames transmitted through said at least one of said screens.

28. A flame simulating assembly according to claim 19 in which the first front surface and the second front surface are at least partially reflective and in which each of the first screen and the second screen comprises a back surface for diffusing light from said at least one light source and transmitting said at least one image of flames.

29. A flame simulating assembly according to claim 28 in which each of the partially reflective front surfaces comprises a substantially non-reflective matte region thereon, each said non-reflective matte region being disposed distal from the first simulated fuel bed and the second simulated fuel bed respectively, each of the screens comprising a portion of the front surface which is a generally reflective region, such that the first simulated fuel bed and the second simulated fuel bed are substantially the only objects reflected in the reflective regions respectively, whereby light from said at least one light source is transmitted through the front surfaces of the screens respectively to produce said at least one image of flames.

30. A flame simulating assembly according to claim 29 which each said front surface further comprises a transition region which is partially reflective and partially non-reflective, each said transition region being positioned between each said non-reflective matte region and each said reflective region on each said partially reflective surface on each said screen respectively.

31. A flame simulating assembly according to claim 28 in which at least one of the back surfaces of the first screen and the second screen is non-planar such that said at least one image of flames transmitted through said at least one back surface appears to be substantially three-dimensional.

32. A flame simulating assembly according to claim 19 additionally comprising at least one reflector positioned in front of at least one of the first simulated fuel bed and the second simulated fuel bed, said at least one reflector being positioned to reflect light from said at least one light source onto said at least one simulated fuel bed to simulate glowing embers.

33. A flame simulating assembly according to claim 19 in which each of the first screen and the second screen includes a top region positioned distal from the first simulated fuel bed and the second simulated fuel bed respectively, the top regions being adapted to permit substantially unobstructed observation therethrough.

34. A flame simulating assembly according to claim 33 in which each of the top regions is substantially transparent.

35. A flame simulating assembly according to claim 33 in which each of the top regions is substantially translucent.

36. A flame simulating assembly according to claim 19 additionally including a frame and in which each of the first screen and the second screen is positioned within the frame to maintain the screens in substantially upright positions, each of the first screen and the second screen including a top edge distal from the first simulated fuel bed and the second simulated fuel bed respectively, the top edges of the screens being spaced apart from an upper portion of the frame to define upper openings formed in the flame simulating assembly to permit substantially unobstructed observation therethrough.

37. A flame simulating assembly comprising:

a first simulated fuel bed;

a second simulated fuel bed;

at least one light source;

at least one flicker element positioned in a path of light from the light source, for creating a fluctuating light;

a first screen positioned behind the first simulated fuel bed for transmitting the fluctuating light; and a second screen positioned behind the second simulated fuel bed for transmitting the fluctuating light, whereby the fluctuating light is transmitted through the first screen and the second screen to simulate flames appearing above the first simulated fuel bed and the second simulated fuel bed respectively.

38. A flame simulating assembly for providing at least one image of flames, the flame simulating assembly comprising:

at least one light source;

a first screen having a first front surface and an opposed first back surface;

a second screen having a second front surface and an opposed second back surface;

the first and second screens being disposed relative to each other such that the first and the second front surfaces face in substantially opposite directions and the first and second back surfaces face each other;

a flame effect element positioned in at least one path of light between said at least one light source and the first and second screens respectively, the flame effect element being positioned at least partially between the first and second screens; and the flame effect element being adapted to configure light from said at least one light source to form said at least one image of flames transmittable through the front surfaces of the first and second screens respectively.

39. A flame simulating assembly according to claim 38 additionally comprising at least one flicker element positioned in said at least one path of light between said at least one light source and the flame effect element, for causing light from the light source to fluctuate.

40. A flame simulating assembly according to claim 38 in which the flame effect element comprises a body portion having a first side facing the first screen and a second side facing the second screen.

41. A flame simulating assembly according to claim 40 in which the body portion is substantially transparent.

42. A flame simulating assembly according to claim 41 in which the flame effect element includes a partially reflective flame-shaped portion positioned on the first side of the body portion, the flame-shaped portion being adapted to configure light from the light source to form said at least one image of flames.

43. A flame simulating assembly according to claim 42 in which the flame effect element includes a first mask portion positioned on the first side of the body portion, the first mask portion including at least one aperture substantially conforming to the flame-shaped portion.

44. A flame simulating assembly according to claim 43 in which the first mask portion comprises a layer of paint.

45. A flame simulating assembly according to claim 43 in which the first mask portion comprises sheet metal.

46. A flame simulating assembly according to claim 43 additionally including at least one flicker element for causing light from the light source to fluctuate, said at least one flicker element being positioned in a path of light between said at least one light source and the flame effect element.

47. A flame simulating assembly according to claim 43 comprising:

a first flicker element for causing light from said at least one light source to fluctuate, the first flicker element being positioned in a primary path of light between said at least one light source and the flame effect element; and a second flicker element for causing light from said at least one light source to fluctuate, the second flicker element being positioned in a secondary path of light between said at least one light source and the flame effect element.

48. A flame simulating assembly according to claim 40 in which the body portion is substantially translucent.

49. A flame simulating assembly according to claim 40 in which the first side is at least partially reflective.

50. A flame simulating assembly according to claim 49 in which the flame effect element includes a first mask portion positioned on the first side of the body portion, the first mask portion including at least one aperture positioned in said at least one path of light, said at least one aperture being formed to configure light from the light source into said at least one image of flames.

51. A flame simulating assembly according to claim 50 comprising:

a first flicker element for causing light from said at least one light source to fluctuate, the first flicker element being positioned in a primary path of light between said at least one light source and the flame effect element; and a second flicker element for causing light from said at least one light source to fluctuate, the second flicker element being positioned in a secondary path of light between said at least one light source and the flame effect element.

52. A flame simulating assembly according to claim 50 in which the flame effect element additionally includes a second mask portion positioned on the second side of the body portion, the second mask portion including at least one aperture positioned in said at least one path of light, said at least one aperture being formed to configure light from the light source into said at least one image of flames.

53. A flame simulating assembly according to claim 52 comprising:

a first flicker element for causing light from said at least one light source to fluctuate, the first flicker element being positioned in a primary path of light between said at least one light source and the flame effect element; and a second flicker element for causing light from said at least one light source to fluctuate, the second flicker element being positioned in a secondary path of light between said at least one flight source and the flame effect element.

54. A flame simulating assembly according to claim 50 in which the first mask portion comprises a layer of paint.

55. A flame simulating assembly according to claim 50 in which the first mask portion comprises sheet metal.

* * * * *